US005272049A

United States Patent [19]

Sakanoue et al.

[11] Patent Number: 5,272,049

[45] Date of Patent: Dec. 21, 1993

[54] SILVER HALIDE COLOR PHOTOGRAPHIC LIGHT-SENSITIVE MATERIAL AND IMAGE FORMING METHOD

[75] Inventors: Kei Sakanoue; Mamoru Sakurazawa; Tadahisa Sato, all of Minami-Ashigara, Japan

[73] Assignee: Fuji Photo Film Co., Ltd., Kanagawa, Japan

[21] Appl. No.: 959,107

[22] Filed: Oct. 9, 1992

[30] Foreign Application Priority Data

Oct. 9, 1991 [JP] Japan ..... 3-289537
Nov. 15, 1991 [JP] Japan ..... 3-326750

[51] Int. Cl.[5] ..... G03C 1/46

[52] U.S. Cl. ..... 430/506; 430/505; 430/558; 430/957; 430/379

[58] Field of Search ..... 430/506, 505, 957, 558, 430/379

[56] References Cited

U.S. PATENT DOCUMENTS 4,804,619 2/1989 Yamada et al. ..... 430/957
4,824,772 4/1989 Ichyima et al. ..... 430/957

FOREIGN PATENT DOCUMENTS 0034950 9/1981 European Pat. Off. .
272604 6/1988 European Pat. Off. .
56-133734 10/1981 Japan .
153548 6/1988 Japan .
63-311252 12/1988 Japan .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

Disclosed is a silver halide color photographic light-sensitive material having at least two green-sensitive silver halide emulsion layers having different sensitivities on a support. The layer having the lowest sensitivity of the green-sensitive layers contains at least one type of coupler represented by Formula (M), and the layer having the highest sensitivity of the green-sensitive layers contains at least on type of coupler represented by Formula (N), Formula (I) or Formula (II), Formula (M)

wherein $R_1$ represents a hydrogen atom or a substituent, Z represents a nonmetallic atom group required to form a 5-membered azole ring containing two to four nitrogen atoms, said azole ring being able to have a substituent including a condensed ring, and X represents a group except for a hydrogen atom, which can split off during a coupling reaction with an oxidized form of a developing agent. Formula (N) represents a compound represented by Formula (M) in which the split-off group X is replaced by a hydrogen atom.

5 Claims, No Drawings

SILVER HALIDE COLOR PHOTOGRAPHIC LIGHT-SENSITIVE MATERIAL AND IMAGE FORMING METHOD

BACKGROUND OF THE INVENTION

1. Field of the Invention

The present invention relates to a silver halide color photographic light-sensitive material and an image forming method using the material and, more particularly, to a silver halide color photographic light-sensitive material having good color reproducibility and graininess and an image forming method using the material.

2. Description of the Related Art

In recent years, a sensitivity and an image quality of a color photographic light-sensitive material have been improved to meet the needs of users. The improvement in image quality has been promoted mainly by improving color reproducibility, sharpness, and graininess. These factors are very important in discussing the performance of a light-sensitive material, so it is obvious that they must be further improved in future.

Formation of a dye image in a silver halide color photographic light-sensitive material is normally performed such that an aromatic primary amine color developing agent is oxidized when it reduces silver halide grains in an exposed silver halide color photographic light-sensitive material, and this oxidized form of the color developing agent causes a coupling reaction with couplers which have been contained in the silver halide color photographic light-sensitive material. Since color reproduction according to subtractive color processes is performed in the silver halide color photographic light-sensitive material, three types of couplers for forming yellow, magenta, and cyan dyes are normally used.

Since color dyes formed by yellow, magenta, and cyan couplers used in a conventional silver halide color photographic light-sensitive material have unnecessary side absorption, color reproducibility tends to be degraded. Therefore, as a technique of improving color reproducibility, a coupler capable of forming a color dye which causes less side absorption has been studied.

Recently, improvements in a hue of a magenta color obtained by the use of a pyrazoloazole-based magenta coupler, in place of a 5-pyrazolone type coupler which has been conventionally used, have attracted attention. An azomethine dye formed by a reaction between this coupler and the oxidized form of a color developing agent has a high saturation because it has little side absorption harmful for color reproducibility near 430 nm and is therefore preferred in terms of color reproducibility. Examples of the coupler of this type are described in U.S. Pat. No. 3,725,067, JP-A-60-172982 ("JP-A" means Published Unexamined Japanese Patent Application), JP-A-60-33552, JP-A-61-72238, and U.S. Pat. Nos. 4,500,630 and 4,540,654.

Since, however, these couplers have a very high efficiency in color formation, sensitivity and graininess are largely degraded in a material for photography, particularly a color reversal light-sensitive material. For this reason, these couplers cannot be put directly into practical use. To solve this problem, it is possible to employ a method of using a 4-equivalent coupler having a low equivalence as described in JP-A-63-153548. However, a light-sensitive material using a 4-equivalent pyrazoloazole coupler is still inferior to that using a pyrazolone type magenta coupler in sensitivity and graininess.

In a color photographic light-sensitive material for photography, in order to adjust gradation in designing a desired characteristic curve and to meet the need for a high image quality by mainly improving graininess, a light-sensitive layer sensitive to one color is generally constituted by two or more emulsion layers having different sensitivities. However, although the pyrazoloazole-based magenta coupler can improve color reproducibility, graininess is degraded when it is used in an emulsion layer having a high sensitivity. Therefore, a certain solution for this problem has been desired.

JP-A-63-311252 or JP-A-1-131560 describes that graininess is improved by the use of a coupler for releasing a scavenger for the oxidized form of a developing agent in combination with the pyrazoloazole-based magenta coupler. If, however, a light-sensitive layer has a multilayered structure constituted by two or more layers, this method is still unsatisfactory to improve both the graininess and color reproducibility of a green-sensitive layer. That is, the aspects of the present invention are not described in detail in these patent specifications.

SUMMARY OF THE INVENTION

It is, therefore, an object of the present invention to provide a color photographic light-sensitive material having a good color reproducibility, in which graininess is not degraded even with the use of a pyrazoloazole type magenta coupler.

It is another object of the present invention to provide an image forming method of a color photographic light-sensitive material for achieving the above object.

The above objects of the present invention are achieved by the following means.

(1) A silver halide color photographic light-sensitive material having at least two green-sensitive silver halide emulsion layers with different sensitivities on a support, wherein a layer having a lowest sensitivity of the green-sensitive layers contains at least one type of a coupler represented by Formula (M), and a layer having a highest sensitivity of the green-sensitive layers contains at least one type of a coupler represented by Formula (N) Formula (I) or Formula (II):

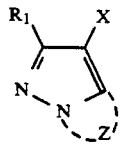

Formula (M)

wherein $R_1$ represents a hydrogen atom or a substituent, Z represents a nonmetallic atom group required to form a 5-membered azole ring containing two to four nitrogen atoms, the azole ring being able to have a substituent including a condensed ring, and X represents a group except for a hydrogen atom, which can split off during a coupling reaction with the oxidized form of a developing agent;

Formula (N) represents a compound represented by Formula (M) in which the split-off group X is replaced by a hydrogen atom;

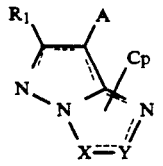

Formula (I)

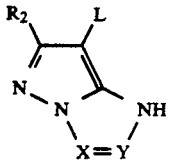

Formula (II)

wherein $R_1$ and $R_2$ each represent a hydrogen atom or a substituent, A represents a hydrogen atom, a halogen atom, an aryloxy group, an alkoxy group, an arylthio group, an alkylthio group, or a 1-azolyl group, Cp represents a coupling block group which reacts with the oxidized form of a color developing agent to produce a colorless or alkali-soluble product and bonds on the nitrogen atom, L represents a scavenger for an oxidized form of a color developing agent, which can capture the oxidized form of a color developing agent through a redox reaction or a coupling reaction after released by a reaction with the oxidized form of a color developing agent, X and Y each represent a nitrogen atom or a carbon atom, X and Y being not simultaneously nitrogen atoms, and . . . represents a $\pi$ electron pair for forming a conjugated double bond.

(2) An image forming method using a silver halide color photographic light-sensitive material described in item (1) above, wherein an image is obtained by performing color development after black/white development.

Although the couplers used in the present invention are all known to those skilled in the art, the fact that the combinations of the present invention can achieve a greatest effect of improving graininess has not been found yet.

It is conventionally known that pyrazolone type magenta couplers are used such that high-activity couplers are added to high-speed layers whereas low-activity couplers are added to low-speed layers. However, the pKa of the pyrazoloazole-based coupler is largely different from that of the pyrazolone type coupler, therefore, the relationship between activity and graininess of a 2-equivalent coupler and a 4-equivalent coupler especially in a high-pH developing solution with a pH 11 or more cannot be easily predicted by conventional techniques.

A coupler represented by Formula (M) will be described in detail below. Of coupler skeletons represented by Formula (M), preferable skeletons are 1H-imidazo[1,2-b]pyrazole,
1H-pyrazolo[1,5-b][1,2,4]triazole,
1H-pyrazolo[5,1-c][1,2,4]triazole,
1H-pyrazolo[1,5-d]tetrazole, and
1H-pyrazolo[1,5-a]benzimidazole.

These skeletons are represented by Formulas (M-I), (M-II), (M-III), (M-IV), and (M-V), respectively.

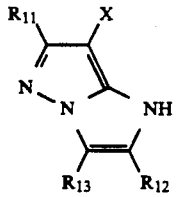

(M-I)

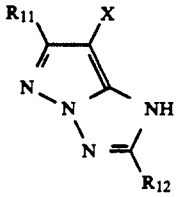

(M-II)

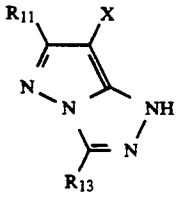

(M-III)

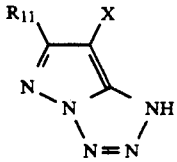

(M-IV)

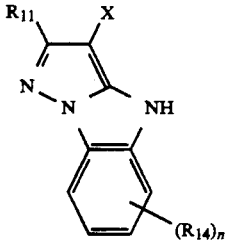

(M-V)

Substituents $R_{11}$, $R_{12}$, $R_{13}$, and $R_{14}$, n, and X in these formulas will be described in detail below.

$R_{11}$ represents a hydrogen atom, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, urethane group, or an azolyl group. $R_{11}$ may be a divalent group to form a bis form.

More specifically, $R_{11}$ is a hydrogen atom, a halogen atom (e.g., chlorine and bromine), an alkyl group (e.g., a straight-chain or branched alkyl group having 1 to 32 carbon atoms, an aralkyl group, an alkenyl group, an alkinyl group, a cycloalkyl group, and a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)-phenoxy]dodecaneami do}phenyl}propyl, 2-ethoxytridecyl, trifluoromethyl, cyclopentyl, and 3-(2,4-di-t-amylphenoxy)propyl), an aryl group (e.g., phenyl, 4-t-butylphenyl, 2,4-di-t-amylphenyl, 2,4,6-trimethylphenyl, 3-tridecaneamido-2,4,6-trimethylphenyl, and 4-tetradecaneamidophenyl), a heterocyclic group (e.g., 2-furyl, 2-thienyl, 2-pyrimidinyl, and 2-benzothiazolyl), a cyano group, a hydroxyl group, a nitro group, a carboxyl group, a sulfo group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecaneamido, 2-(2,4-di-t-amylphenoxy)butaneamido, 4-(3-t-butyl-4-hydroxyphenoxy)butaneamido, and 2-{4-(4-(4-hydroxyphenylsulfonyl)phenoxy}decaneamido), an alkylamino group (e.g., methylamino, butylamino, dodecylamino, diethylamino, and methylbutylamino), an anilino group (e.g., phenylamino, 2-chloroanilino, 2-chloro-5-tetradecaneaminoanilino, 2-chloro-5-dodecyloxycarbonylanilino, N-acetylanilino, and 2-chloro-5-{2-(3-t-butyl-4-hydroxyphenoxy)-dodecaneamido} anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxyphenylazo, 4-pybaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-di-phenoxy-1,3,5-triazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, or 4-dodecyloxybenzoyl), and an azolyl group (e.g., imidazolyl, pyrazolyl, 3-chloro-pyrazole-1-yl, and triazolyl). Of these substituents, a group which can further have a substituent may further have an organic substituent, which is bonded by a carbon atom, an oxygen atom, a nitrogen atom, or a sulfur atom, or a halogen atom.

Of these substituents, preferable examples of $R_{11}$ are an alkyl group, an aryl group, an alkoxy group, an aryloxy group, an alkylthio group, a ureido group, a urethane group, and an acylamino group.

$R_{12}$ represents groups having the same meaning as to the substituents enumerated above for $R_{11}$ and is preferably a hydrogen atom, an alkyl group, an aryl group, a heterocyclic group, an alkoxycarbonyl group, a carbamoyl group, sulfamoyl group, a sulfinyl group, an acyl group, or a cyano group.

$R_{13}$ represents groups having the same meanings as L the substituents enumerated for $R_{11}$ and is preferably a hydrogen atom, an alkyl group, an aryl group, a heterocyclic group, an alkoxy group, an aryloxy group, an alkylthio group, an arylthio group, an alkoxycarbonyl group, a carbamoyl group, and an acyl group, and more preferably an alkyl group, an aryl group, a heterocyclic group, an alkylthio group, and an arylthio group.

$R_{14}$ represents groups having the same meanings as the substituents enumerated for $R_{11}$ and is preferably a hydrogen atom, an alkyl group, an aryl group, a heterocyclic group, an alkoxy group, an aryloxy group, an alkoxycarbonyl group, a carbamoyl group, a sulfamoyl group, a sulfonyl group, an acyl group, an acylamino group, an alkoxycarbonylamino group, a sulfonamido group, a sulfamoylamino group, or a cyano group.

n represents an integer from 1 to 4, and preferably an integer from 1 to 3.

X represents a group except for a hydrogen atom, which can split off during a reaction with an oxidized form of an aromatic primary amine color developing agent. Specific examples of the split-off group are a halogen atom, an alkoxy group, an aryloxy group, an acyloxy group, an alkylsulfonyloxy or arylsulfonyloxy group, an acylamino group, an alkylsulfonamido or arylsulfonamido group, an alkoxycarbonyloxy group, an aryloxycarbonyloxy group, an alkylthio, arylthio, or heterocyclic thio group, a carbamoylamino group, a 5- or 6-membered nitrogen-containing heterocyclic group, an imido group, and an arylazo group. These groups may have further substituent permitted as the substituents for $R_{11}$.

More specifically, examples of X are a halogen atom (e.g., fluorine, chlorine, and bromine), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3-ethoxycarbonylphenoxy, 4-methoxycarbonylphenoxy, 3-acetylaminophenoxy, and 2-carboxyphenoxy), an acyloxy group (e.g., acetoxy, tetradecanoyloxy, and benzoyloxy), alkylsulfonyloxy and arylsulfonyloxy groups (e.g., methanesulfonyloxy and toluenesulfonyloxy), an acylamino group (e.g., dichloroacetylamino and heptafluorobutyrylamino), alkylsulfonamido and arylsulfonamido groups (e.g., methanesulfonamino, trifluoromethanesulfonamino, and p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), alkylthio, arylthio, and heterocyclic thio groups (e.g., dodecylthio, 1-carboxydodecylthio, phenylthio, 2-butoxy-5-t-octylphenylthio, 2-benzyloxycarbonylaminophenylthio, and tetrazolylthio), a carbamoylamino group (e.g., N-methylcarbamoylamino and N-phenylcarbamoylamino), a 5- or 6-membered nitrogen-containing heterocyclic group (e.g., 1-imidazolyl, 1-pyrazolyl, 1,2,4-triazole-1-yl, tetrazolyl, 3,5-dimethyl-1-pyrazolyl, 4-cyano-1-pyrazolyl, 4-methoxycarbonyl-1-pyrazolyl, 4-acetylamino-1-pyrazolyl, and 1,2-dihydro-2-oxo-1-pyridyl), an imido group (e.g., succinimido and hydantoinyl), and an arylazo group (e.g., phenylazo and 4-methoxyphenylazo). In addition, X sometimes group for forming a bis-type coupler obtained by condensing a 4-equivalent coupler with aldehydes or ketones, as a split-off group which is bonded via a carbon atom. Also, X can contain a photographically useful group such as a development inhibitor or a development accelerator. X is preferably a halogen atom, an alkoxy group, an aryloxy group, an alkylthio or arylthio group, or a 5- or 6-membered nitrogen-containing heterocyclic group which bonds to a coupling active position by a nitrogen atom, and most preferably a halogen atom, a substituted aryloxy group, a substituted arylthio group, or a substituted 1-pyrazolyl group.

Examples of a compound of a magenta coupler represented by Formula (M) will be presented below. However, the present invention is not limited to these examples.

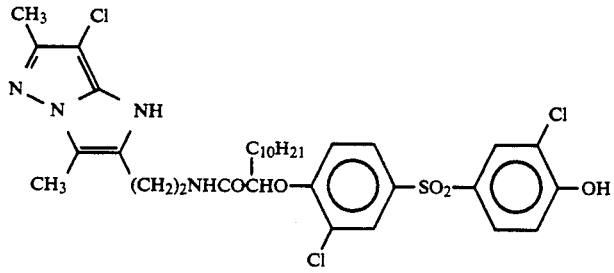
(M-1)

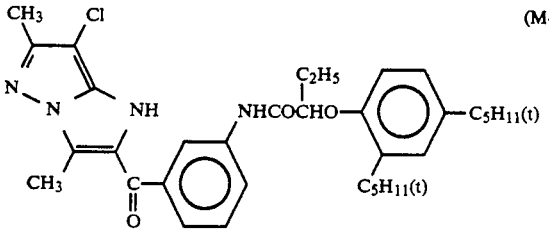
(M-2)

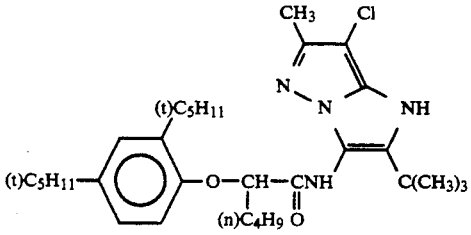
(M-3)

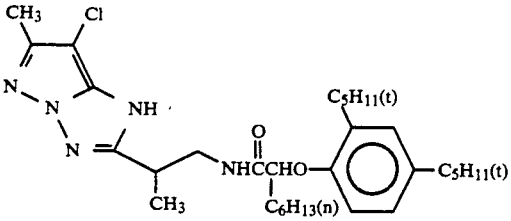
(M-4)

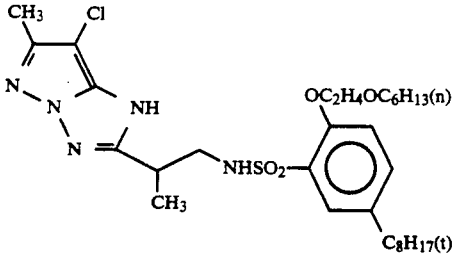
(M-5)

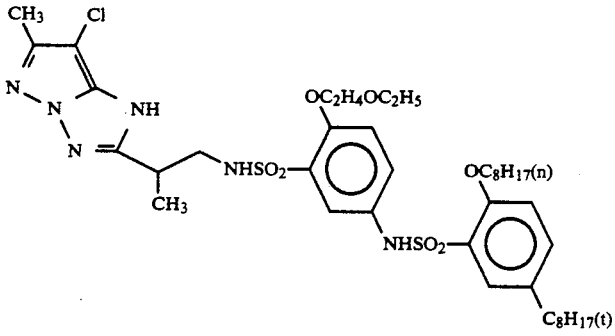
(M-6)

-continued
(M-7)
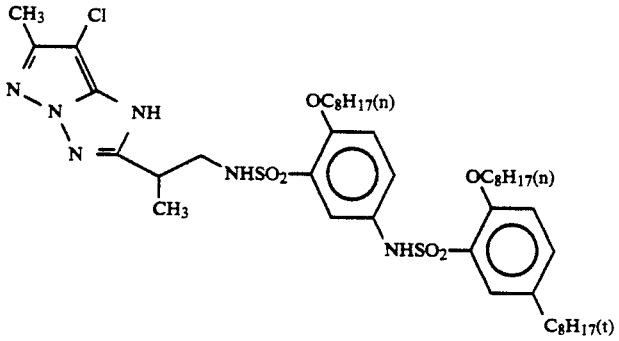
(M-8)
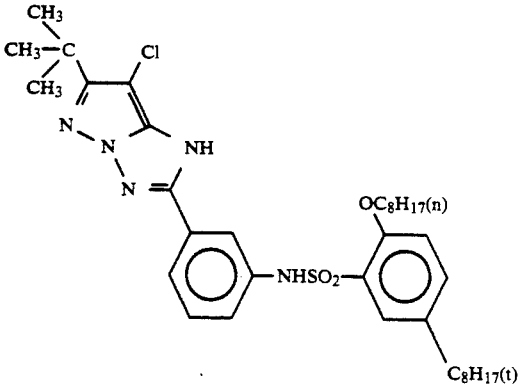
(M-9)
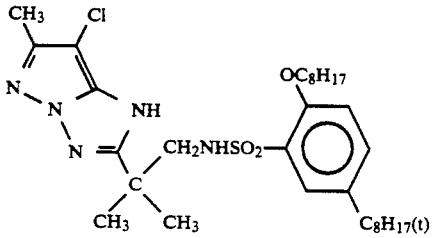
(M-10)
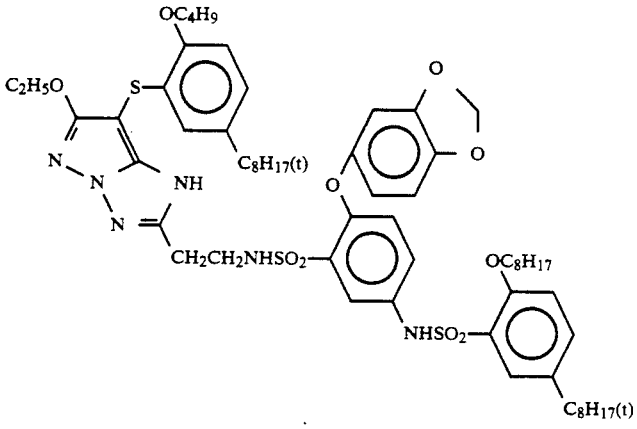
(M-11)
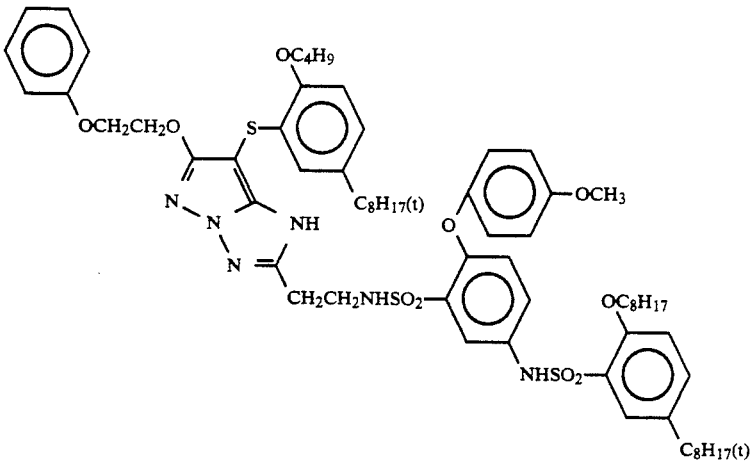

-continued
(M-12)
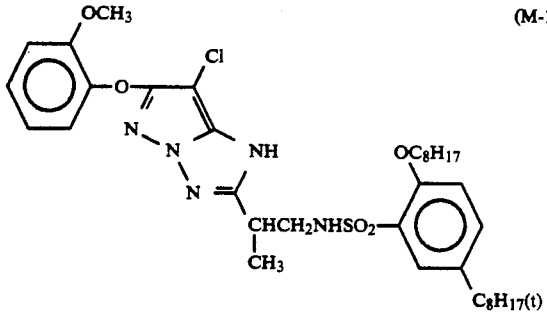
(M-13)
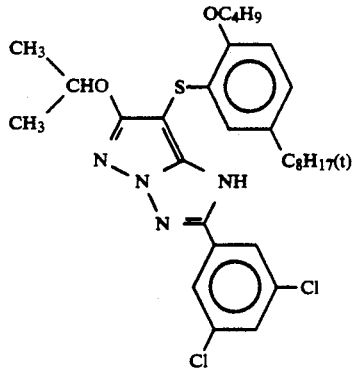
(M-14)
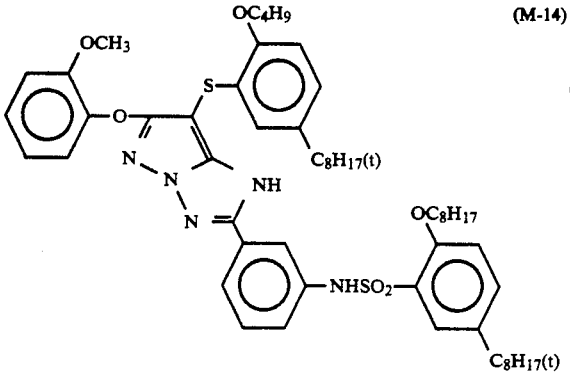
(M-15)
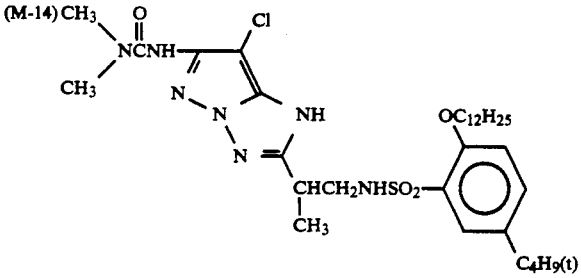
(M-16)
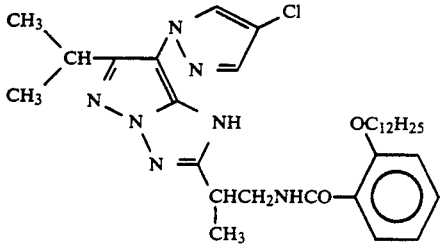
(M-17)
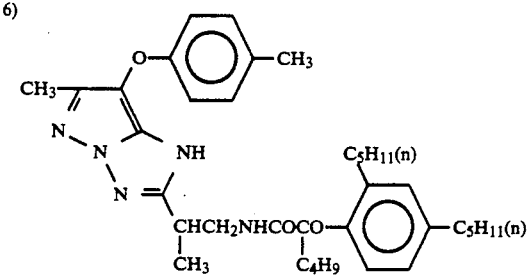
(M-18)
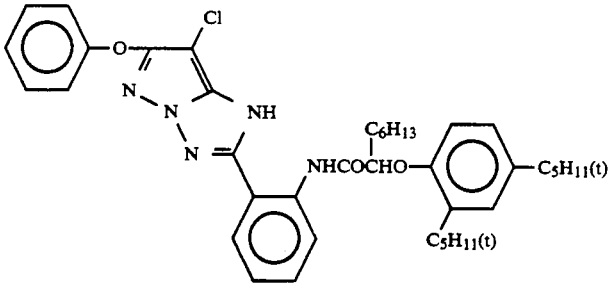
(M-19)
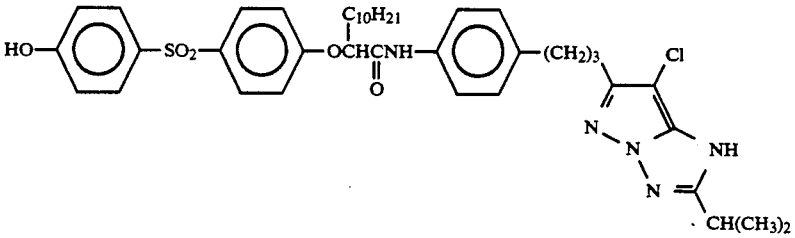

-continued
(M-20)
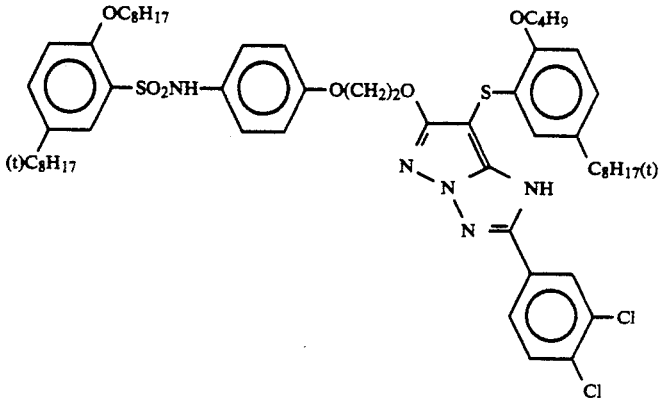
(M-21)
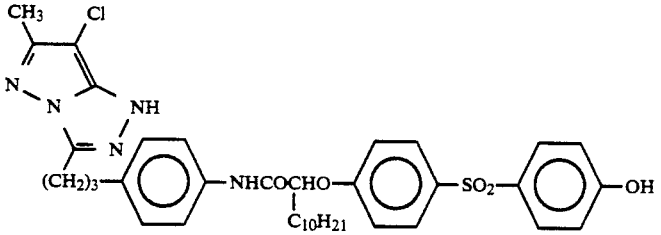
(M-22)
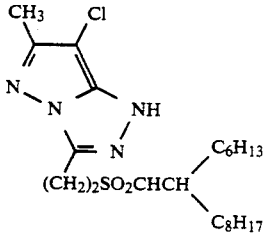
(M-23)
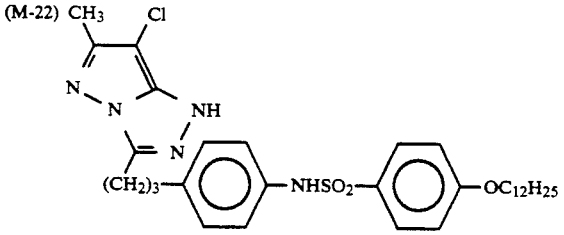
(M-24)
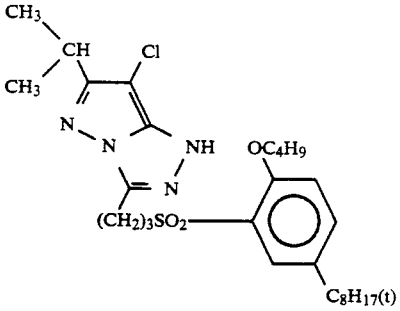
(M-25)
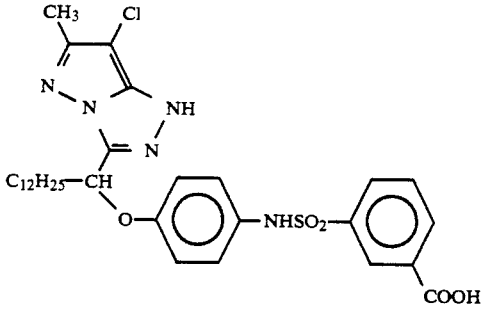
(M-26)
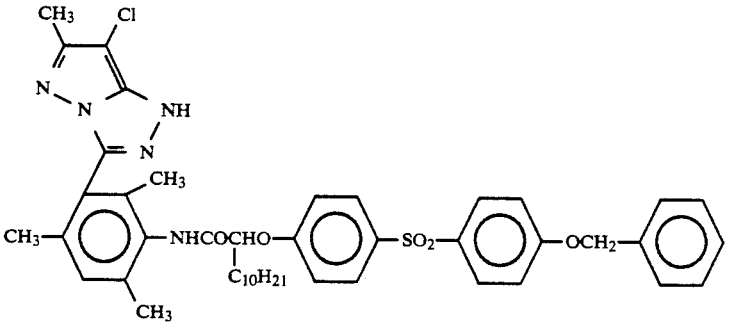

-continued
(M-27)
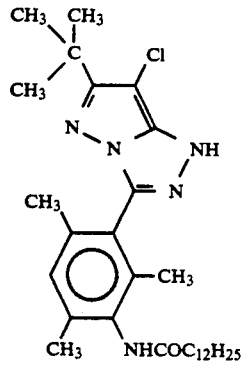
(M-28)
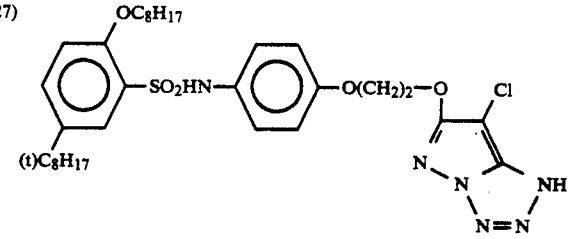
(M-29)
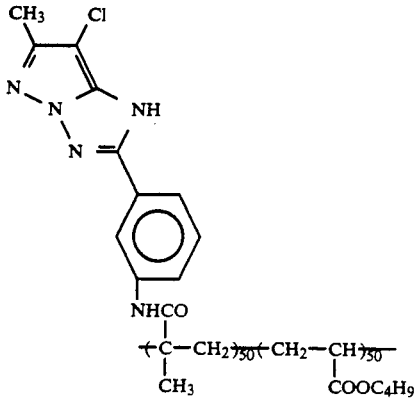
(M-30)
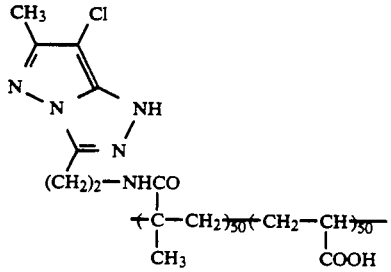
(M-31)
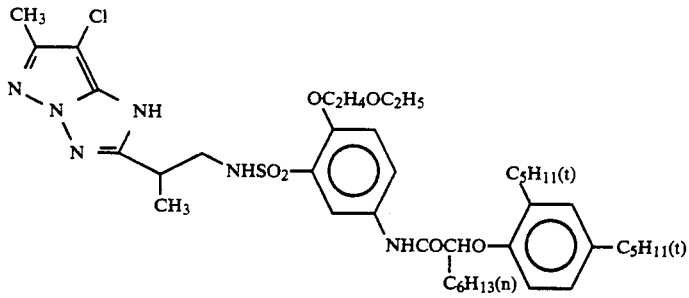
(M-32)
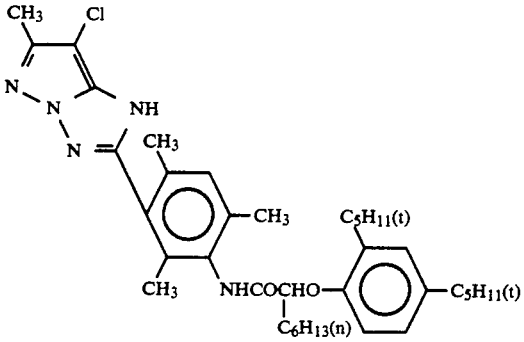

-continued
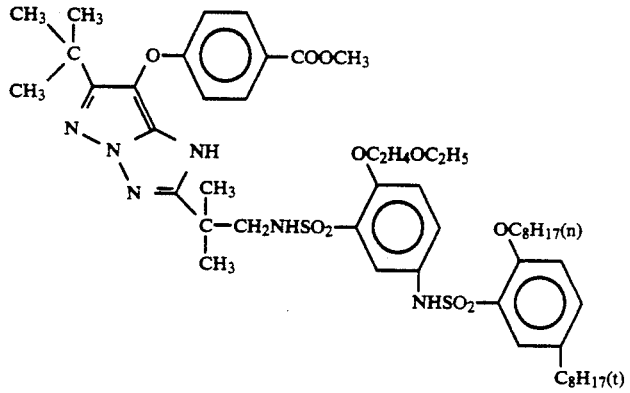
(M-33)
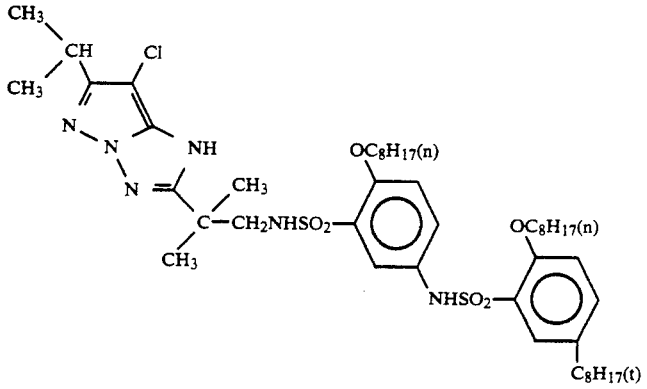
(M-34)
(M-35)
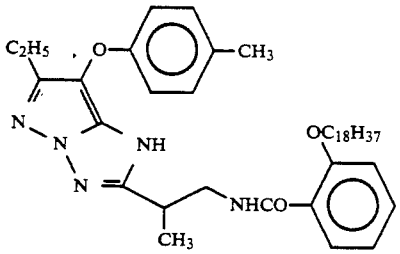
(M-36)
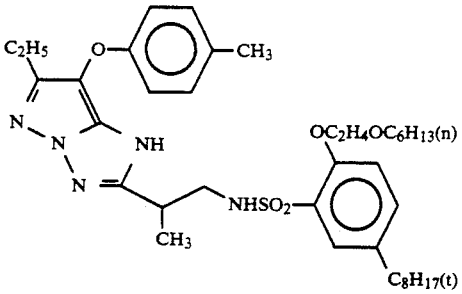
(M-37)
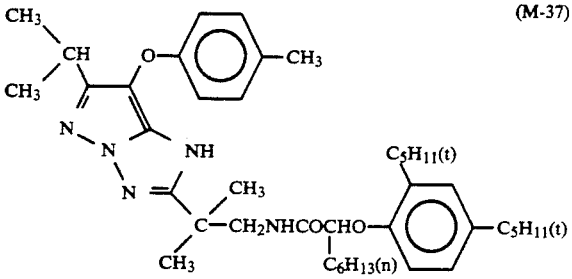
(M-38)
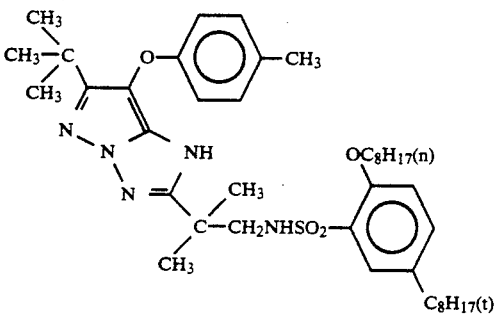

-continued
(M-39)
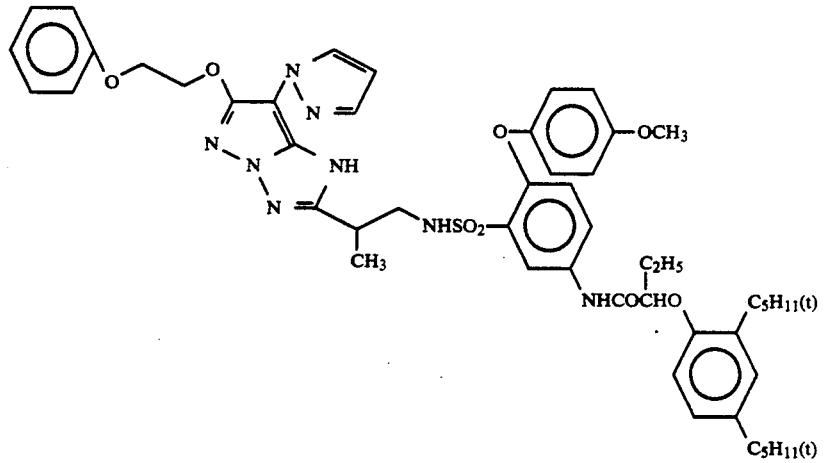
(M-40)
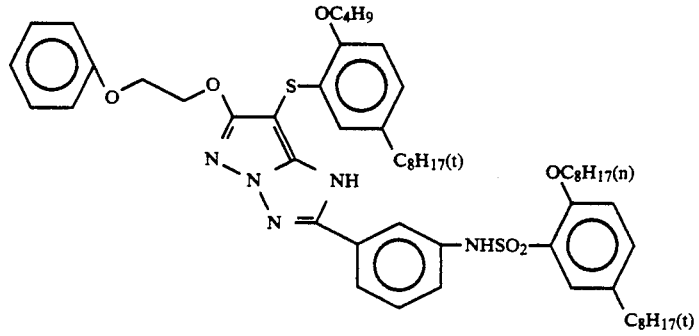
(M-41)
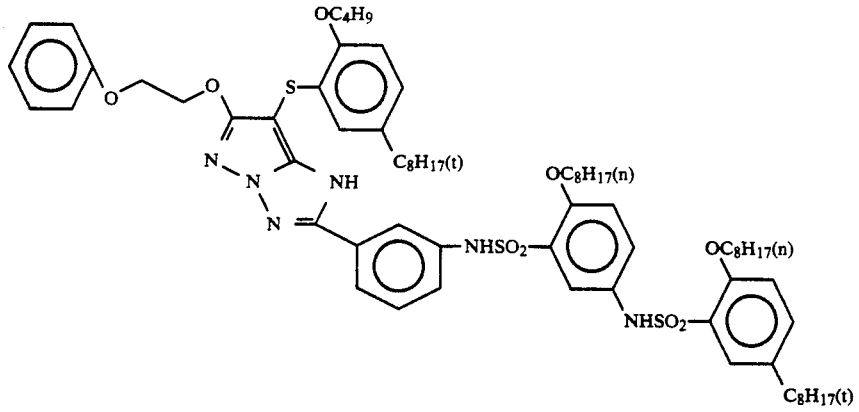
(M-42)
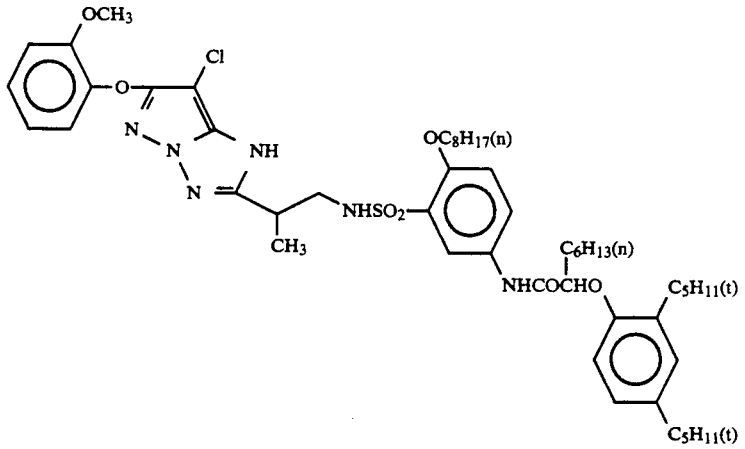

-continued
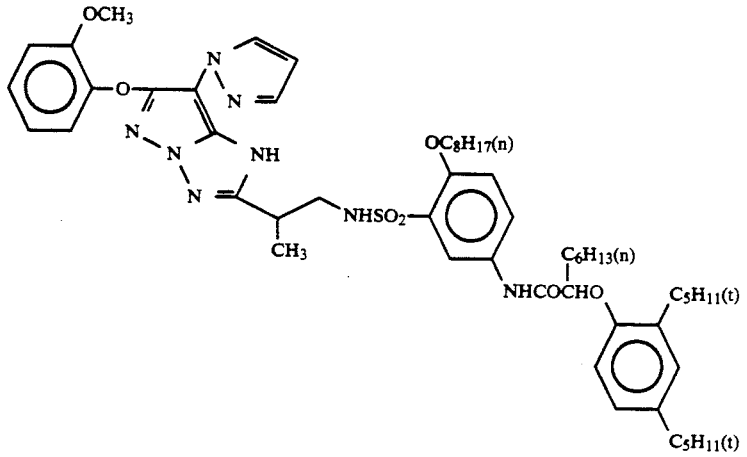
(M-43)
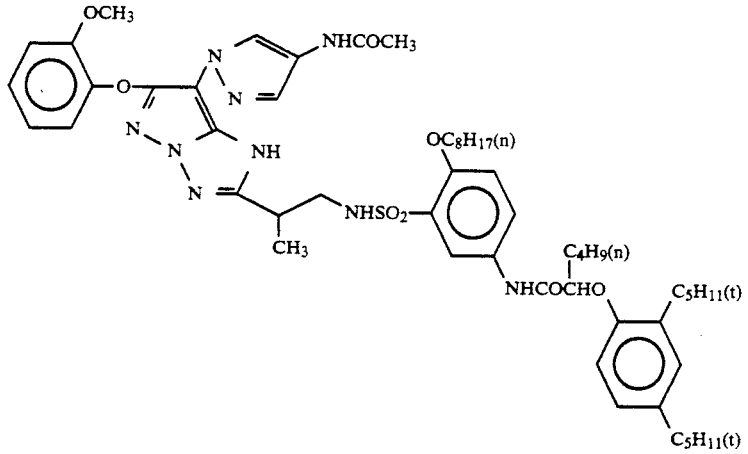
(M-44)
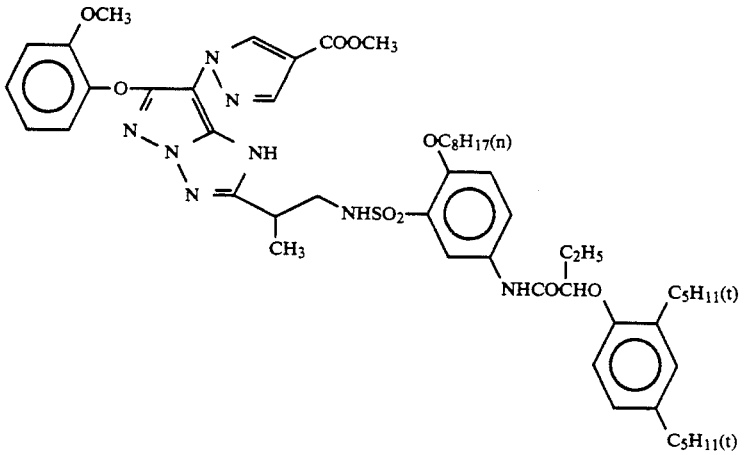
(M-45)

-continued
(M-46)
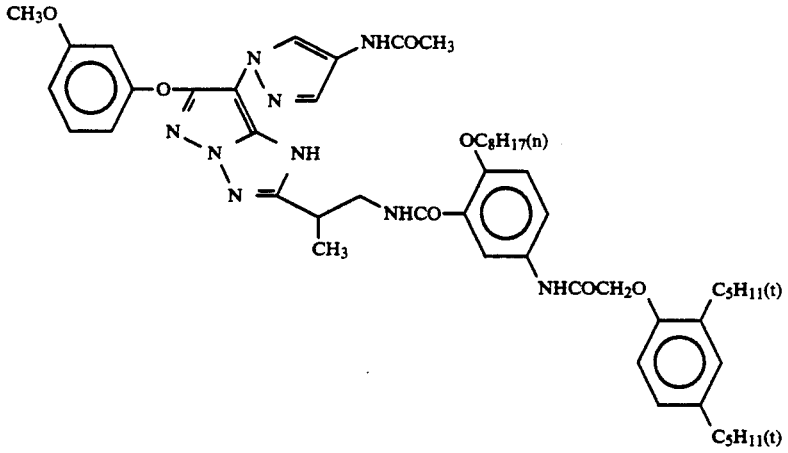
(M-47)
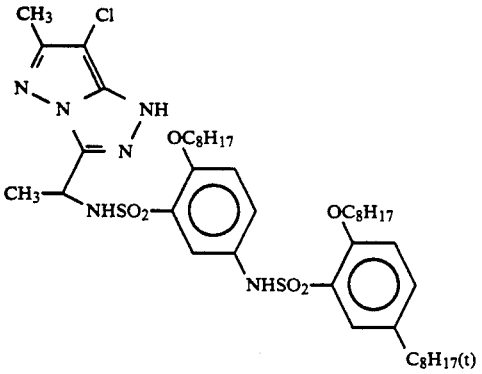
(M-48)
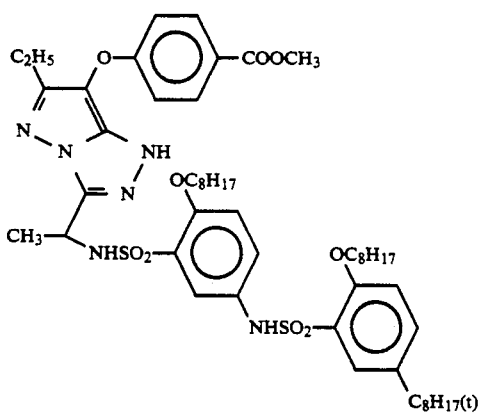
(M-49)
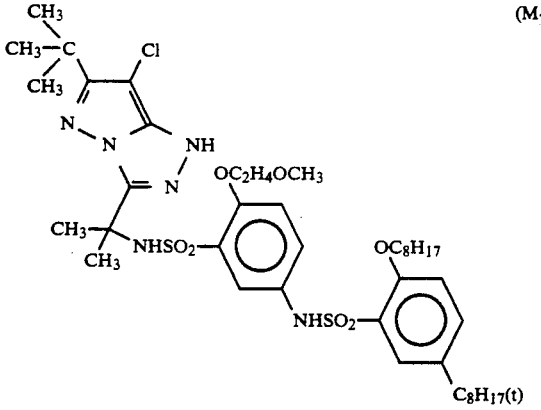
(M-50)
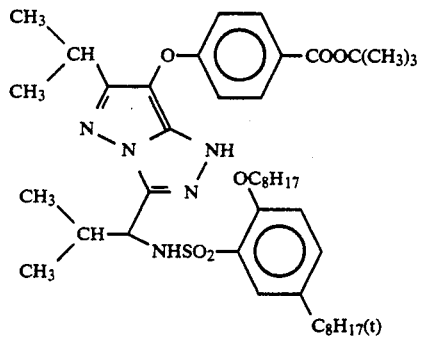
(M-51)
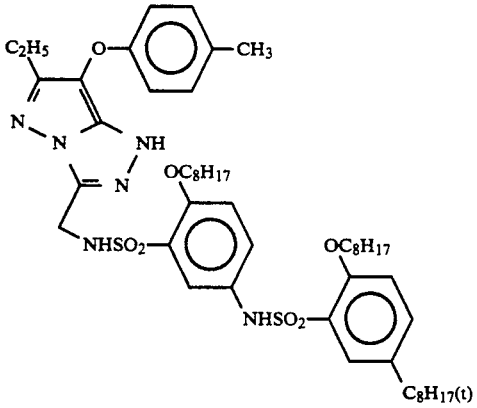
(M-52)
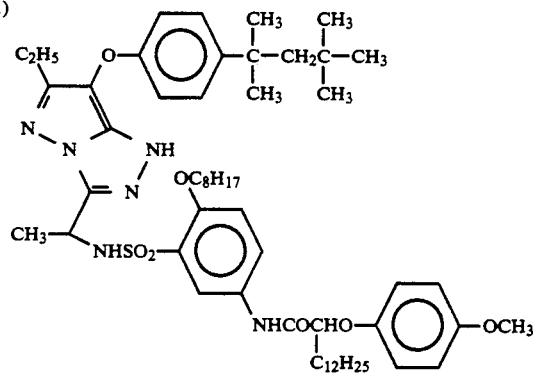

-continued
(M-53)
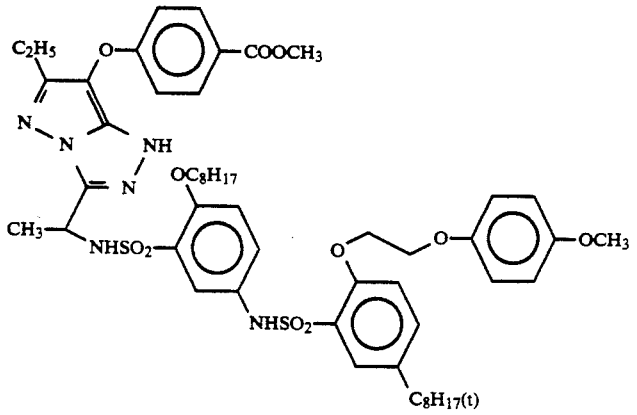
(M-54)
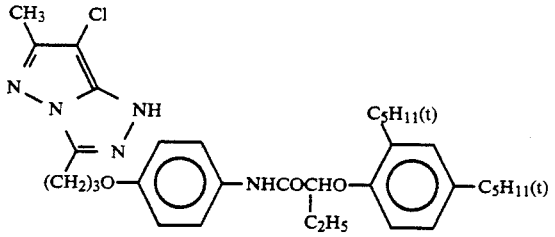
(M-55)
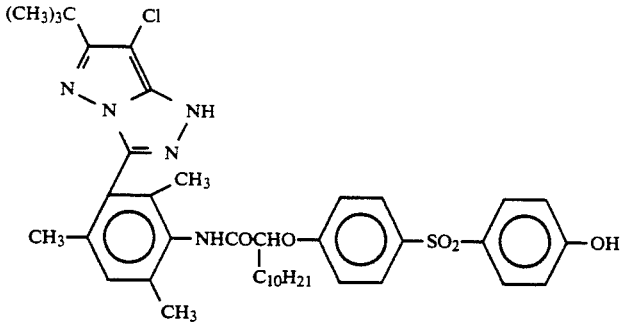
(M-56)
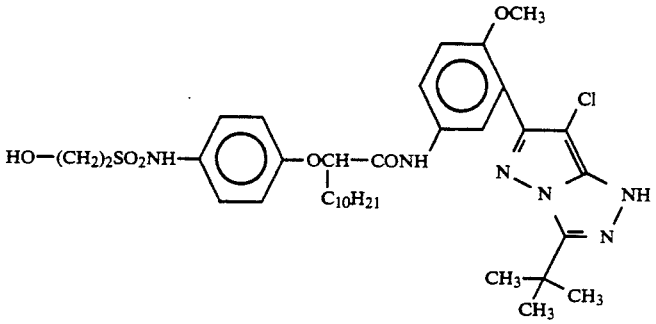

-continued
(M-57)
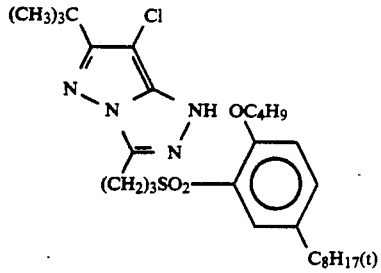
(M-58)
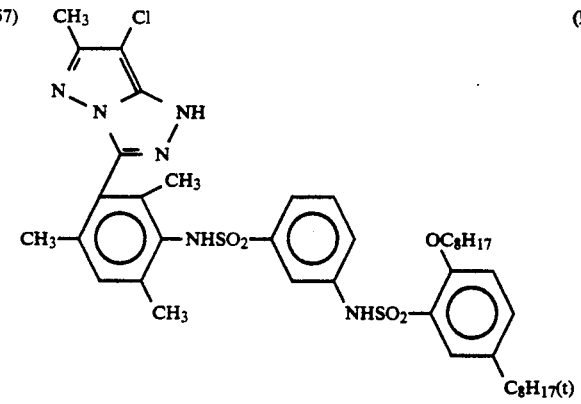
(M-59)
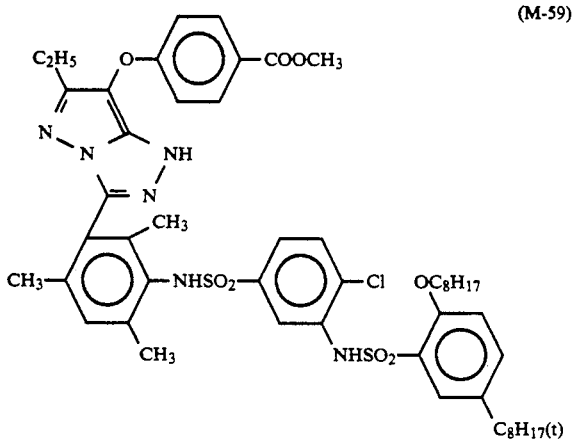
(M-60)
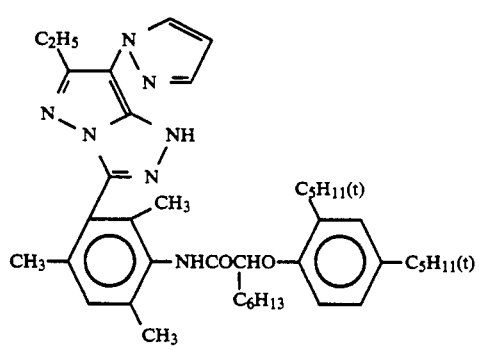
(M-61)
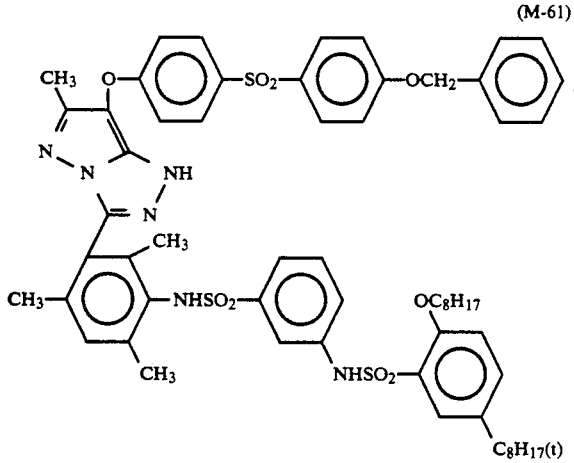
(M-62)
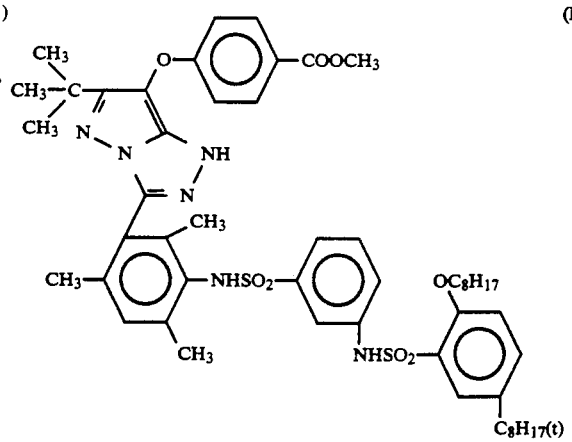

-continued
(M-63)
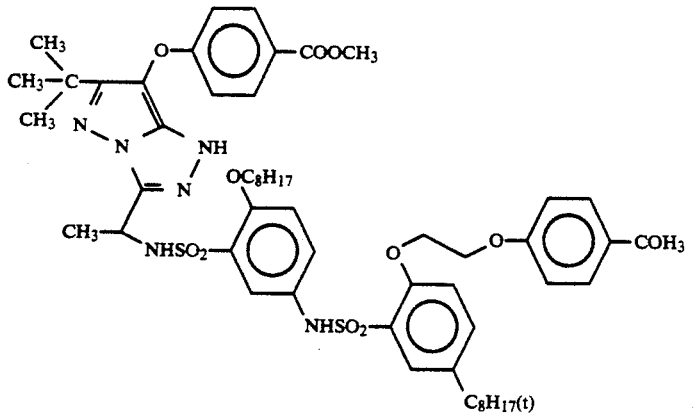
(M-64)
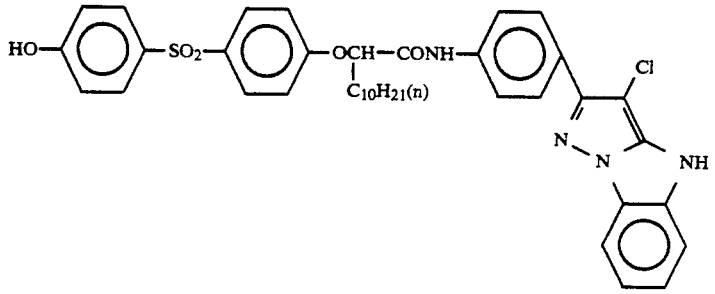
(M-65)
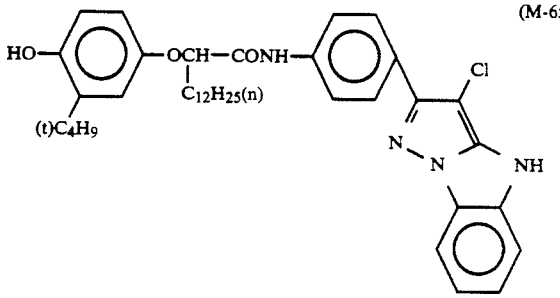
(M-66)
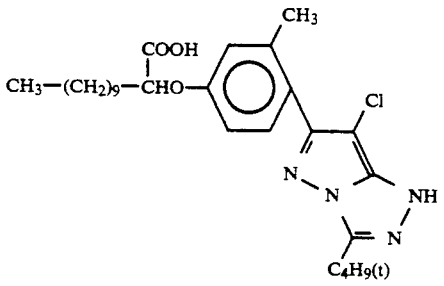
(M-67)
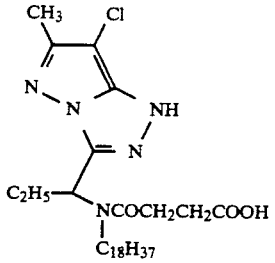
(M-68)
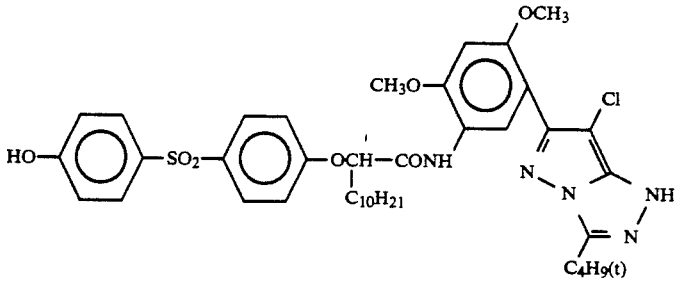

-continued
(M-69)
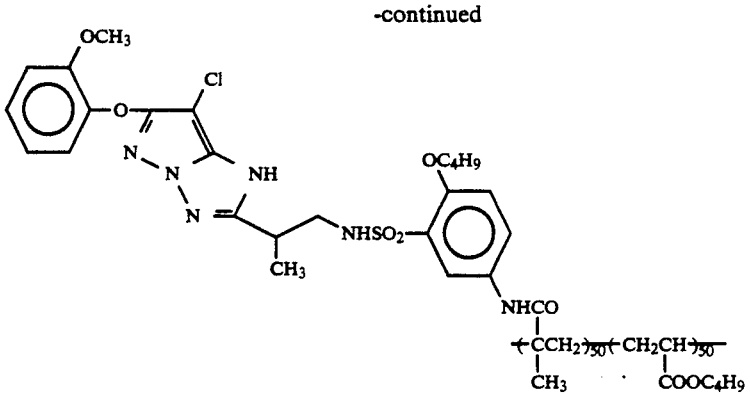
(M-70)
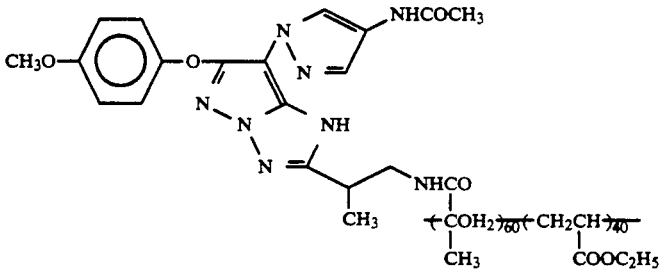
(M-71)
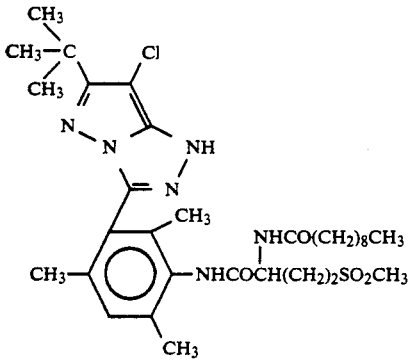
(M-72)
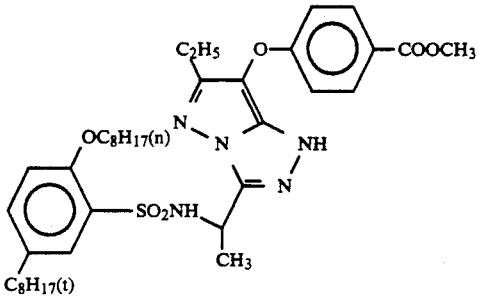
(M-73)
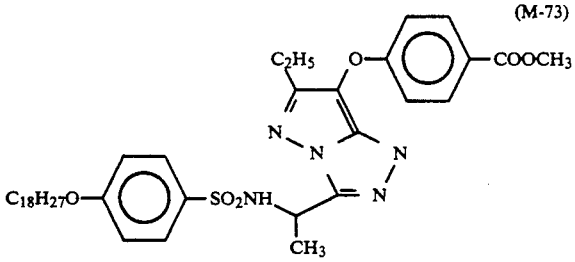
(M-74)
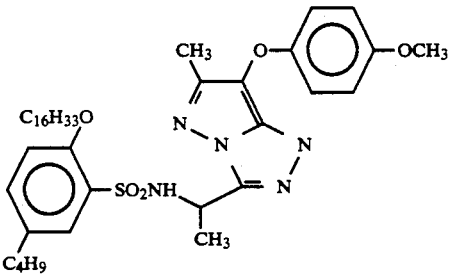
(M-75)
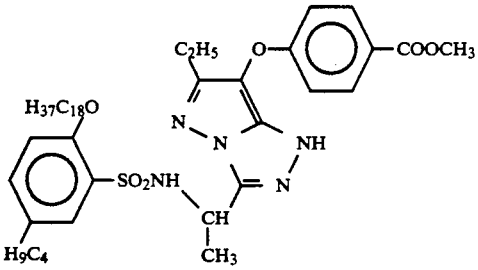
(M-76)
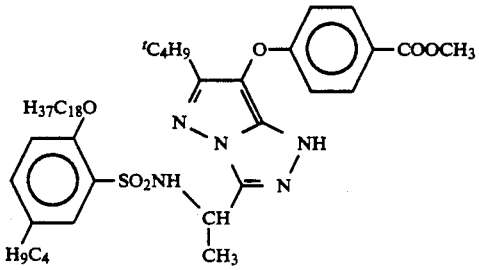

References describing methods of synthesizing couplers represented by Formula (M) will be enumerated below.

A compound represented by Formula (M-I) can be synthesized by a method described in, e.g., U.S. Pat. No. 4,500,630. A compound represented by Formula (M-II) can be synthesized by methods described in, e.g., U.S. Pat. Nos. 4,540,654 and 4,705,863, JP-A-61-65245, JP-A-62-209457, and JP-A-62-249155. A compound represented by Formula (M-III) can be synthesized by methods described in, e.g., JP-B-47-27411 ("JP-B" means Published Examined Japanese Patent Application) and U.S. Pat. No. 3,725,067. A compound represented by Formula (M-IV) can be synthesized by a method described in, e.g., JP-A-60-33552.

A 4-equivalent pyrazoloazole type coupler represented by Formula (N) of the present invention represents a compound represented by Formula (M) in which the split-off group X is replaced by a hydrogen atom. The other substituents represent the same.

Examples of a compound represented by Formula (N) will be enumerated below, but the present invention is not limited to these examples.

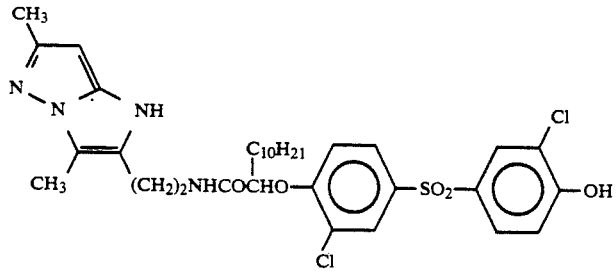
(N-1)

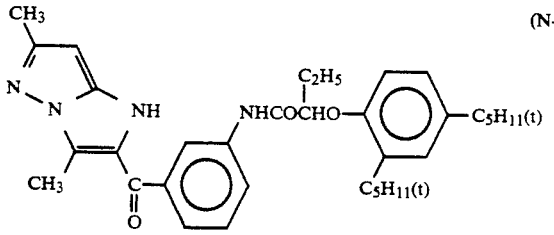
(N-2)

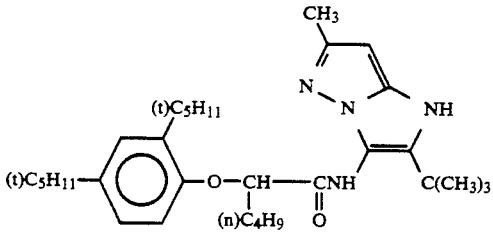
(N-3)

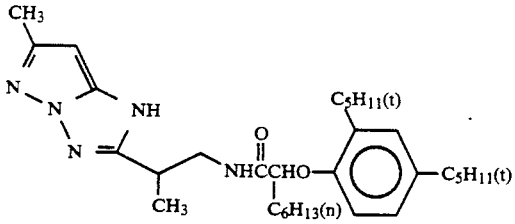
(N-4)

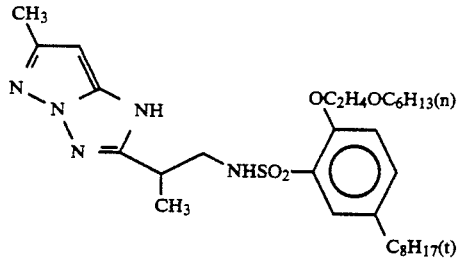
(N-5)

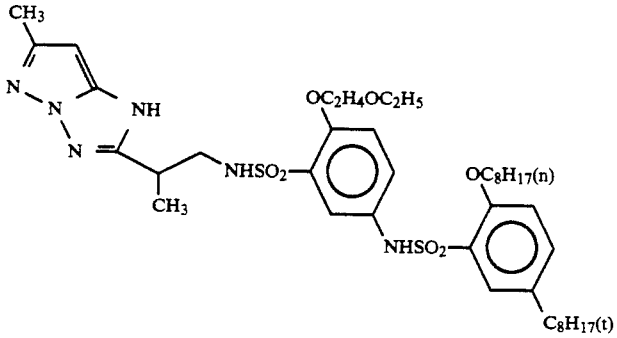
(N-6)

-continued
(N-7)
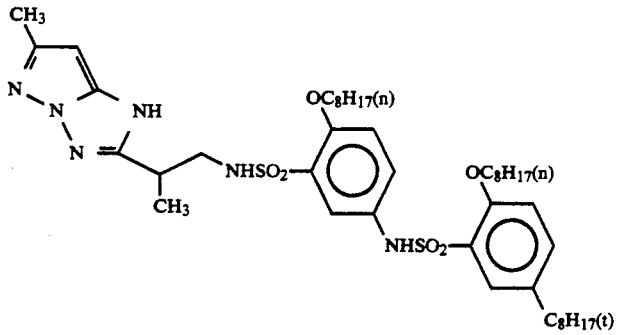
(N-8)
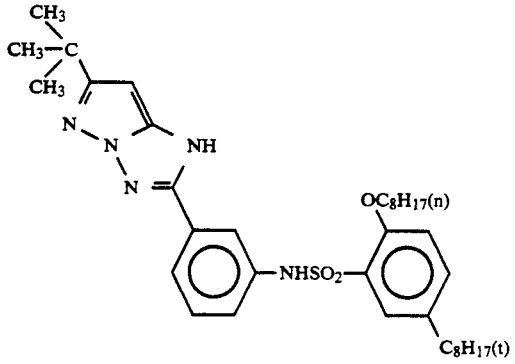
(N-9)
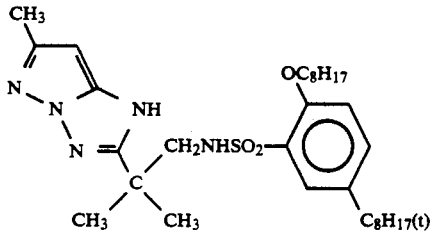
(N-10)
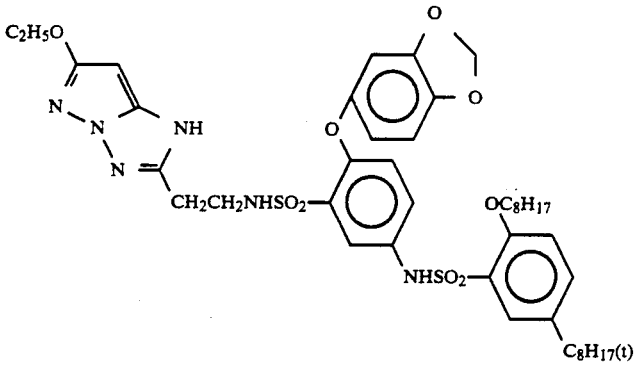
(N-11)
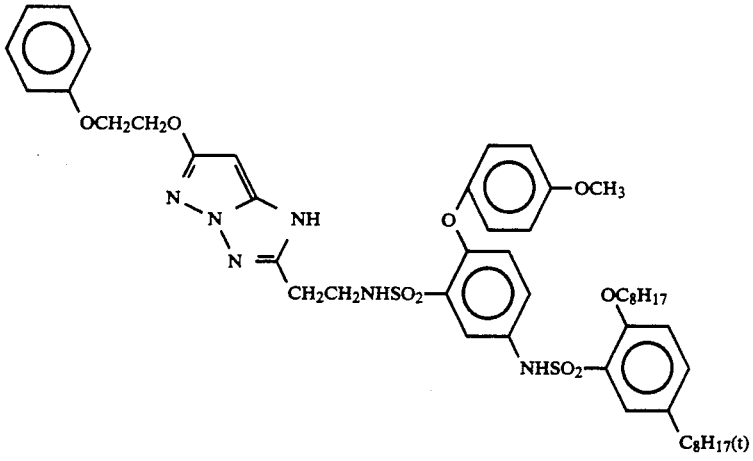

-continued
(N-12)
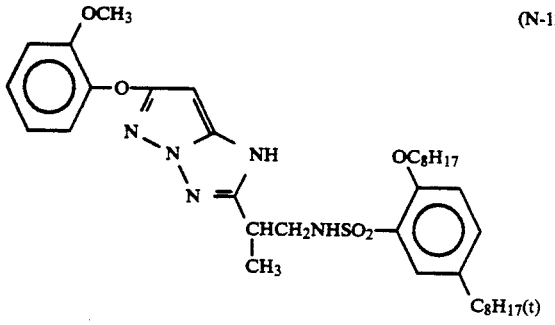
(N-13)
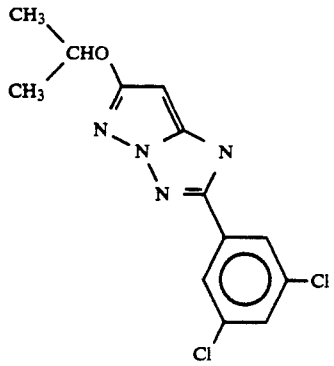
(N-14)
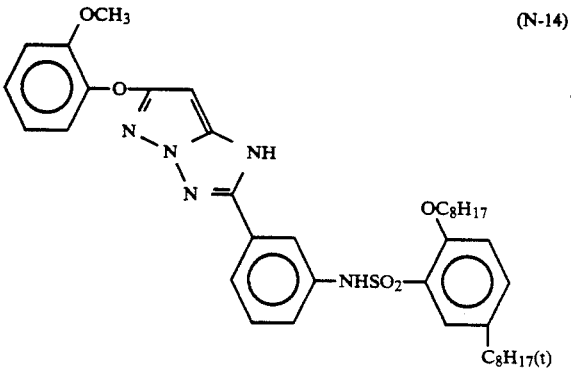
(N-15)
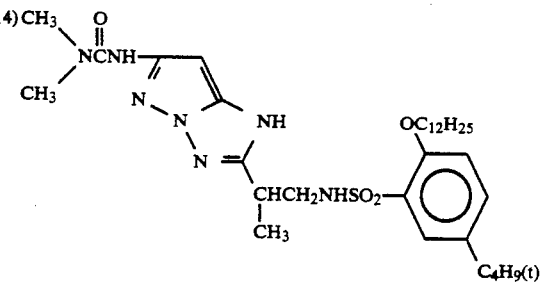
(N-16)
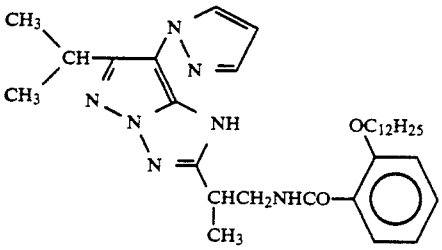
(N-17)
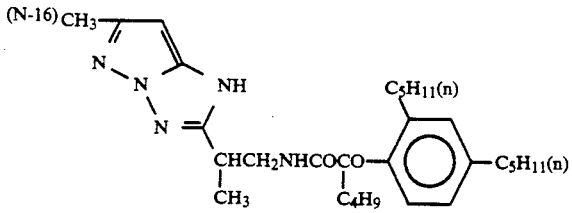
(N-18)
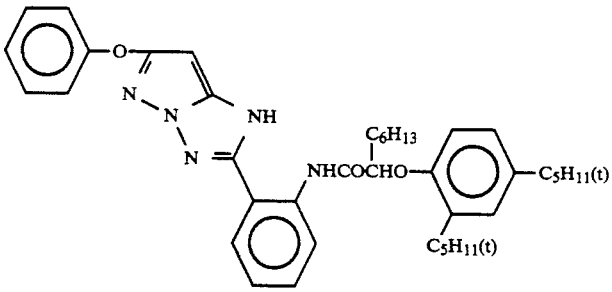
(N-19)
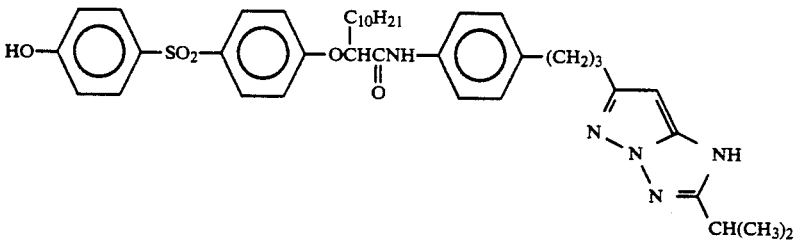

-continued
(N-20)
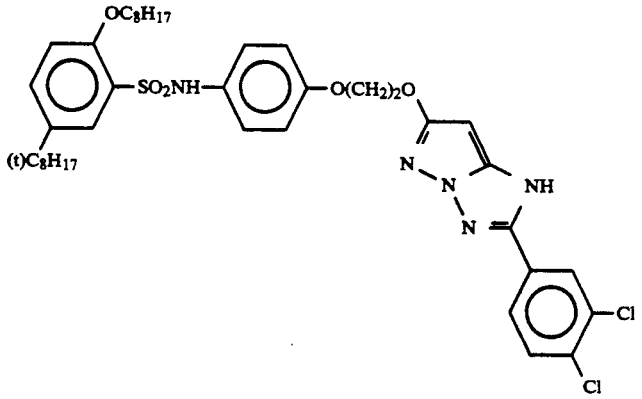
(N-21)
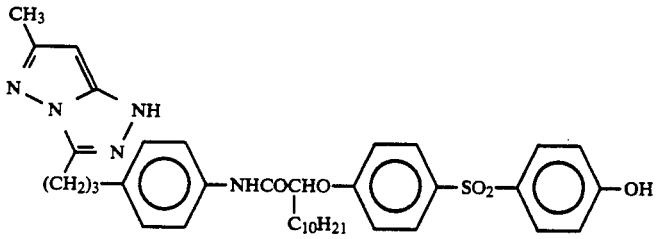
(N-22)
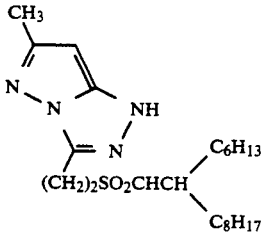
(N-23)
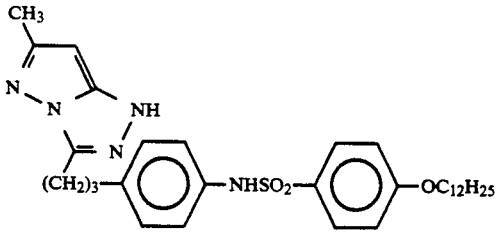
(N-24)
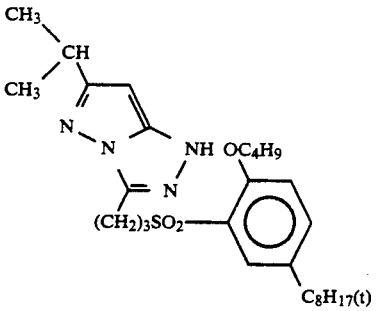
(N-25)
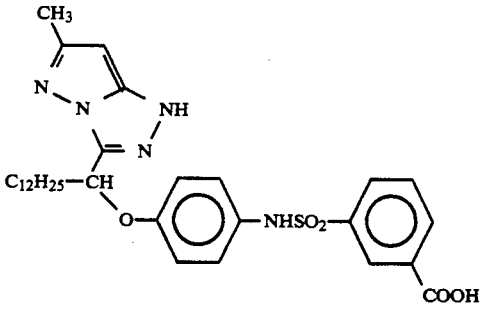
(N-26)
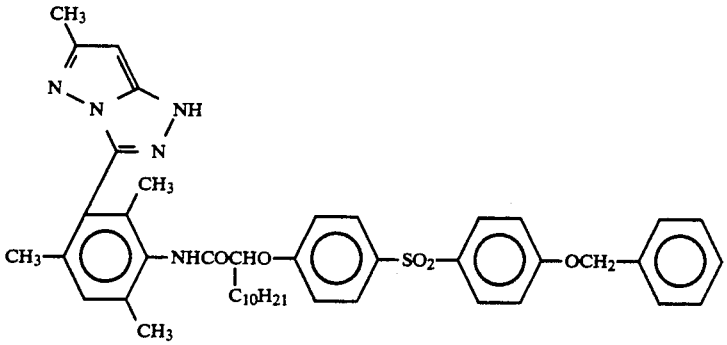

-continued
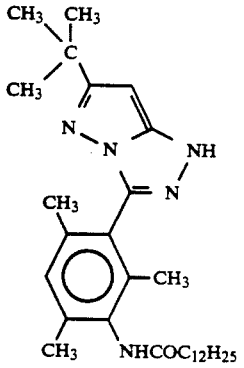
(N-27)
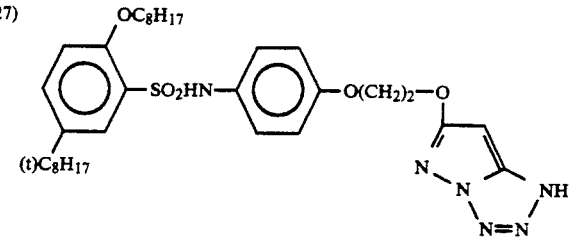
(N-28)
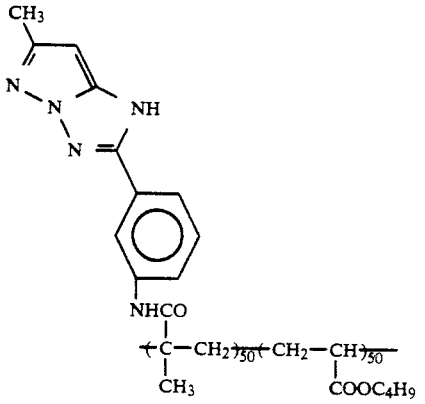
(N-29)
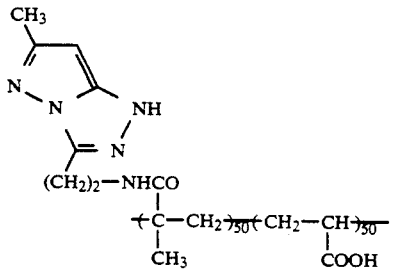
(N-30)
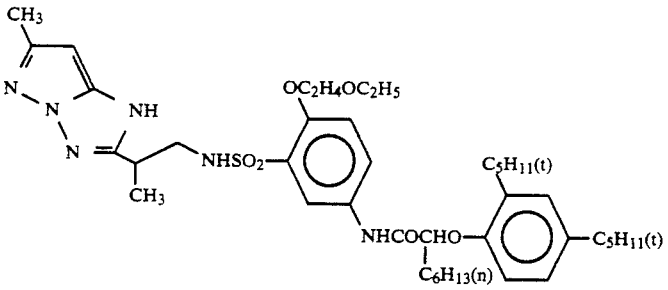
(N-31)
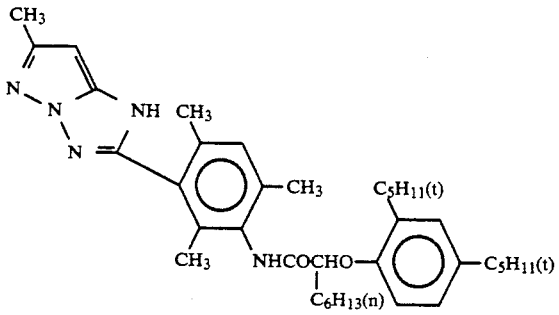
(N-32)

-continued
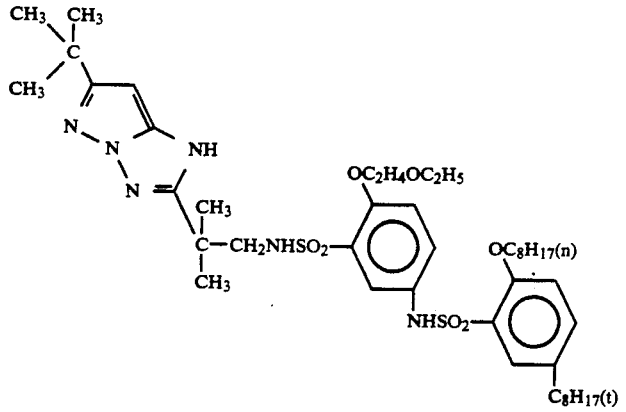
(N-33)
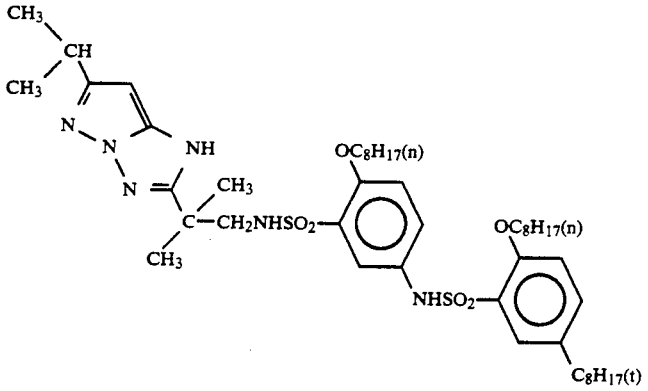
(N-34)
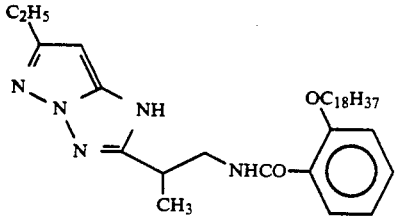
(N-35)
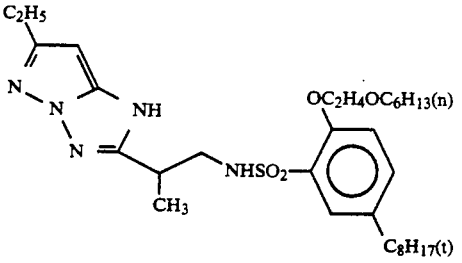
(N-36)
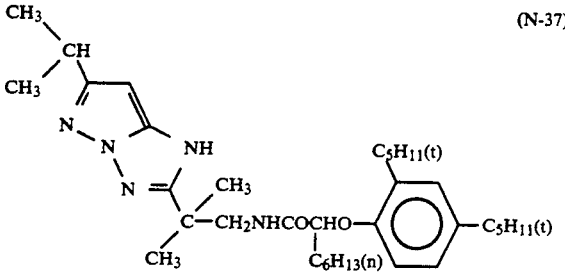
(N-37)
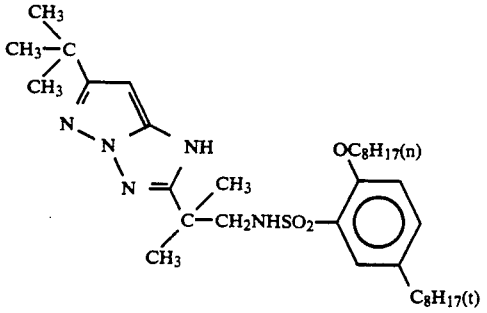
(N-38)

-continued
(N-39)
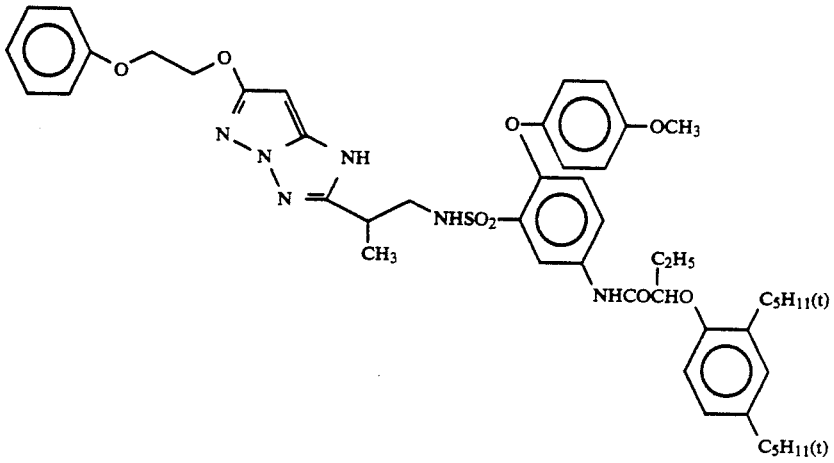
(N-40)
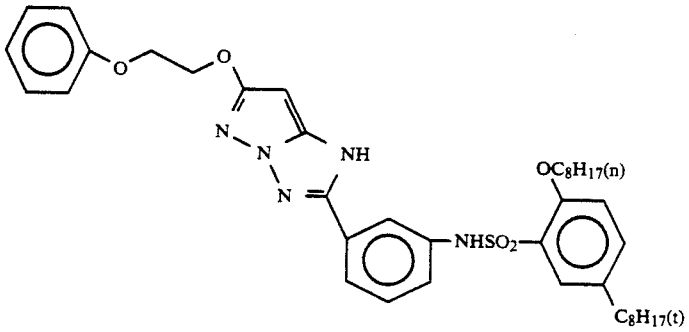
(N-41)
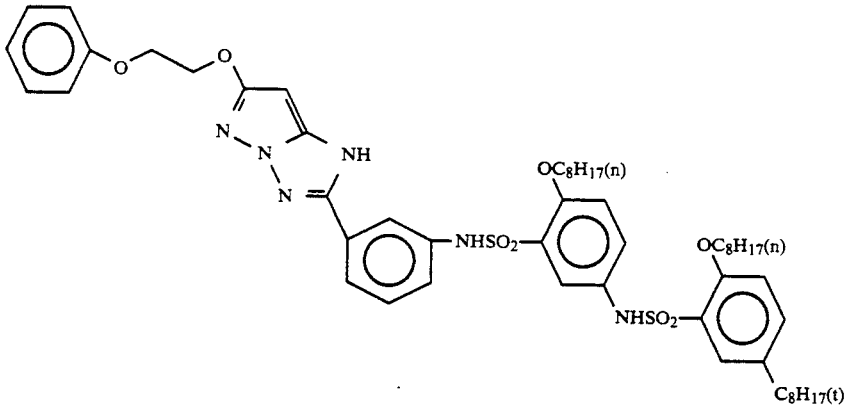
(N-42)
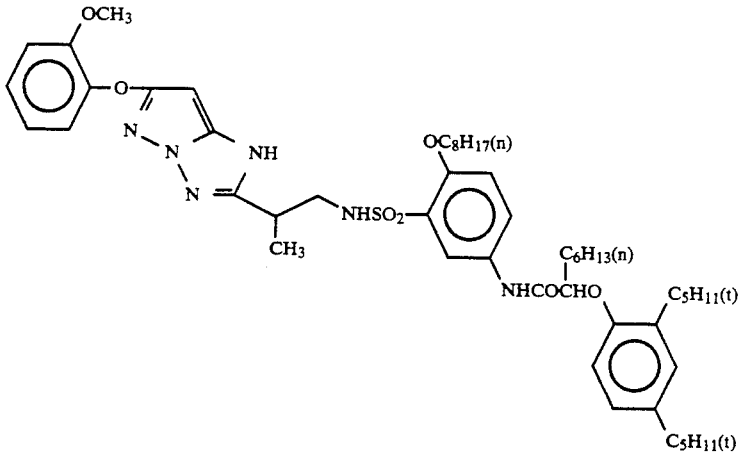

-continued
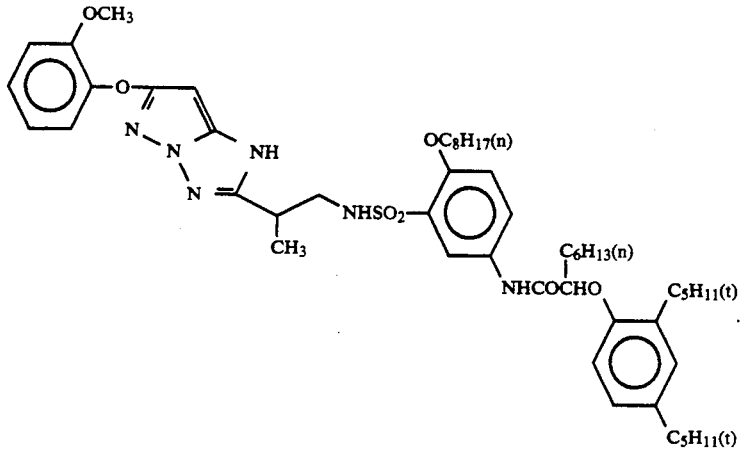
(N-43)
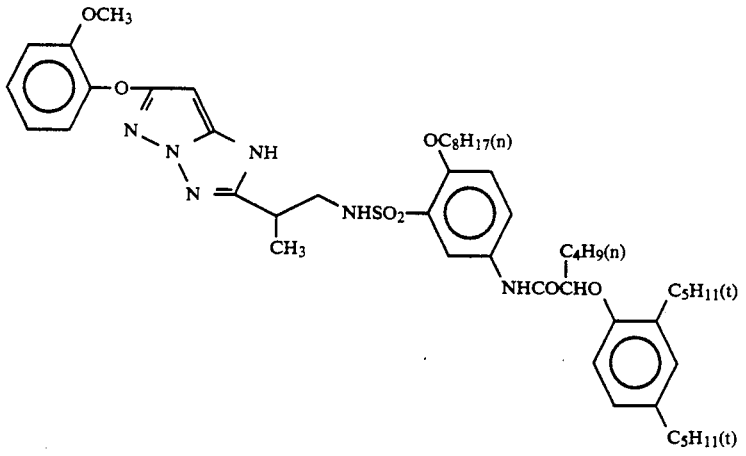
(N-44)
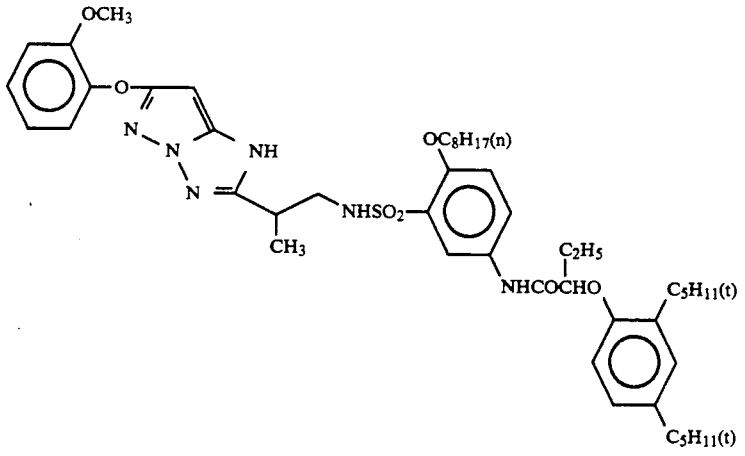
(N-45)

-continued
(N-46)
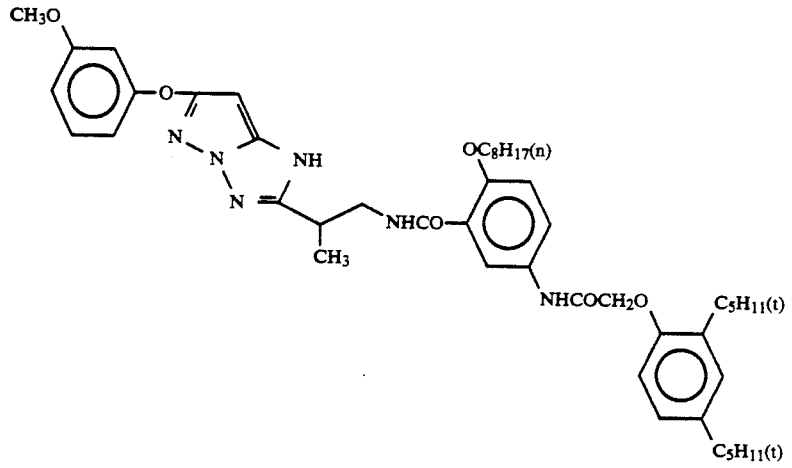
(N-47)
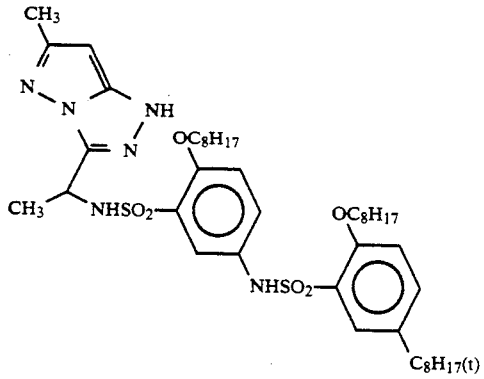
(N-48)
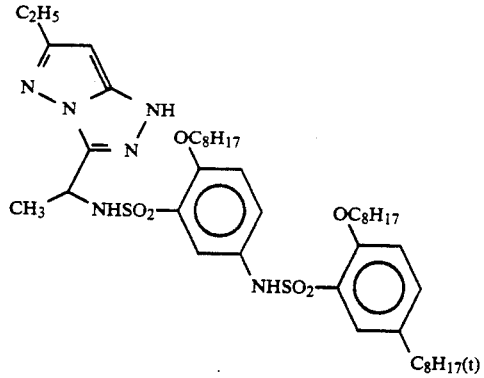
(N-49)
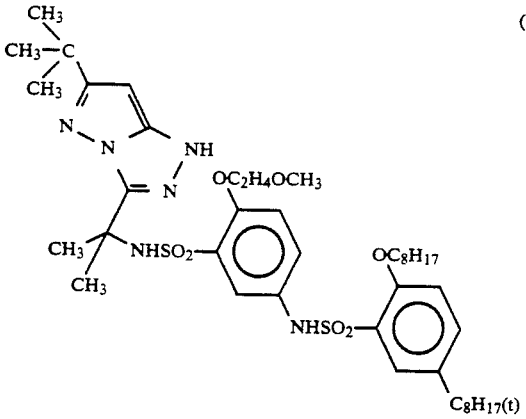
(N-50)
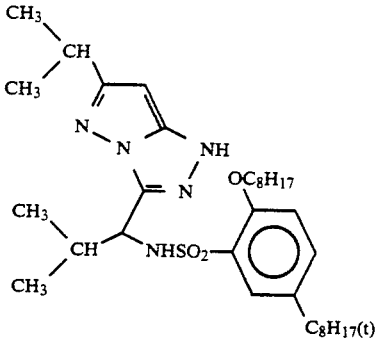
(N-51)
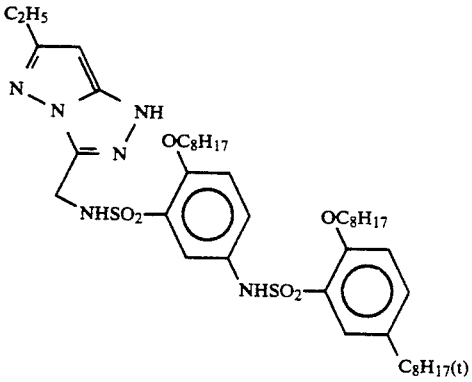
(N-52)
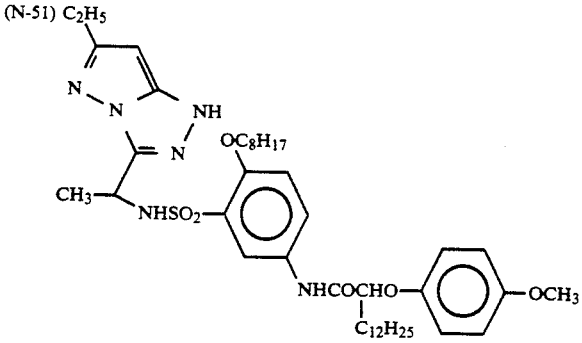

-continued
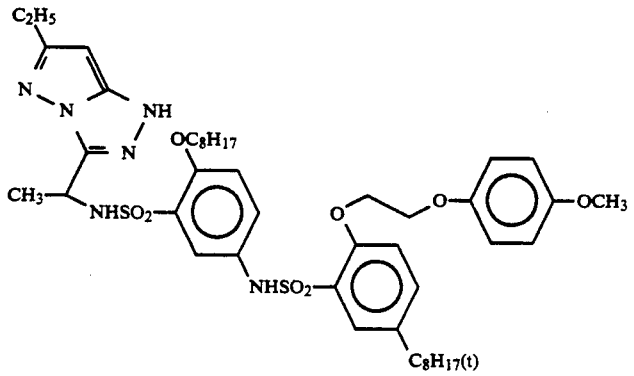
(N-53)
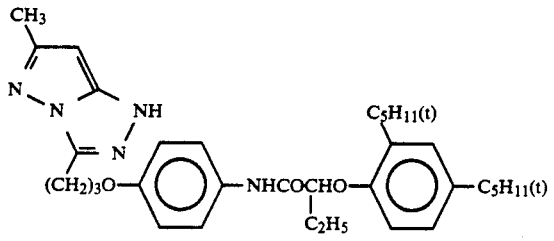
(N-54)
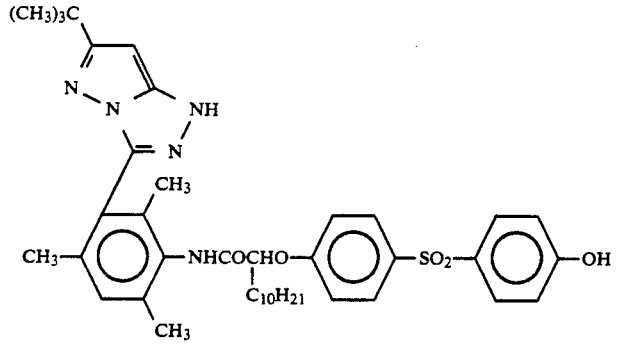
(N-55)
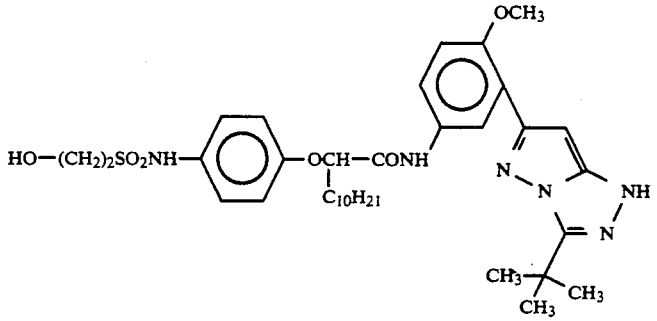
(N-56)

-continued
(N-57)
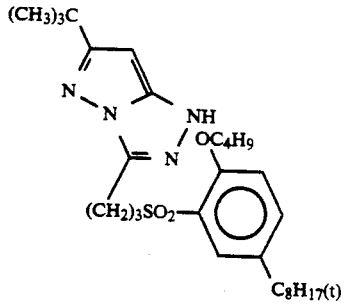
(N-58)
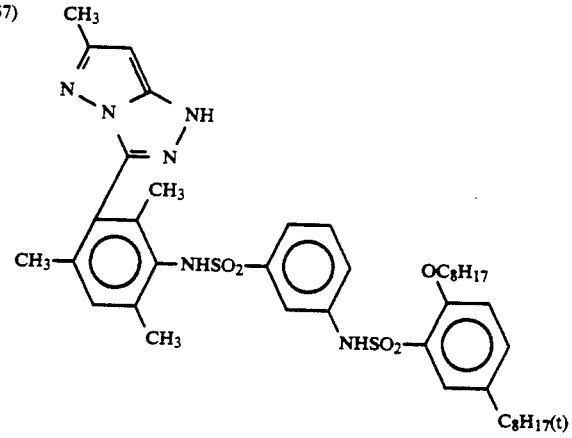
(N-59)
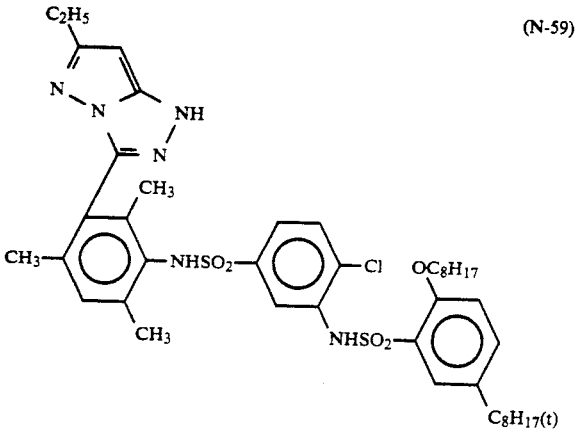
(N-60)
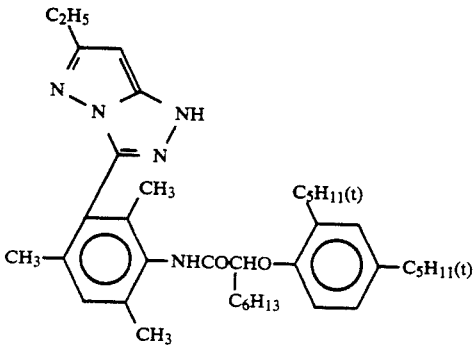
(N-61)
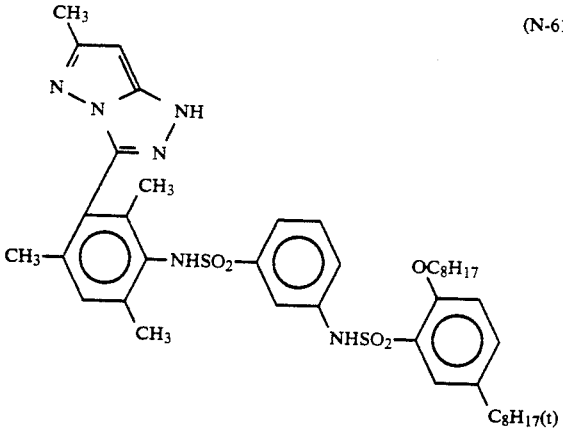
(N-62)
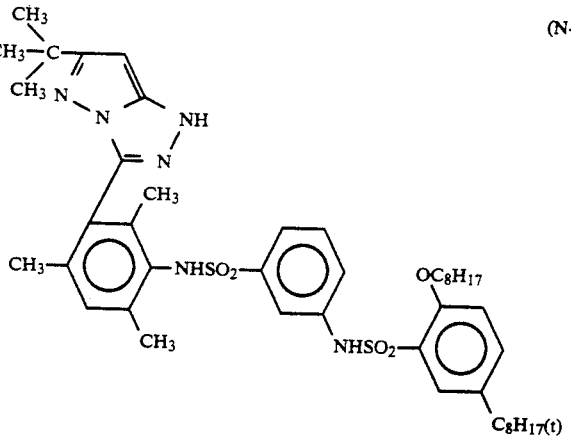
(N-63)
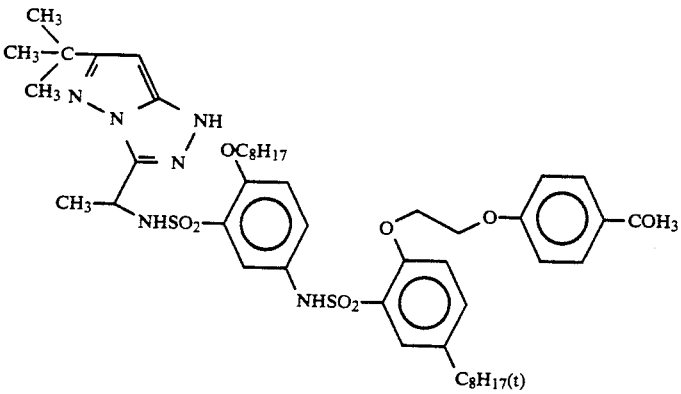

-continued
(N-64)
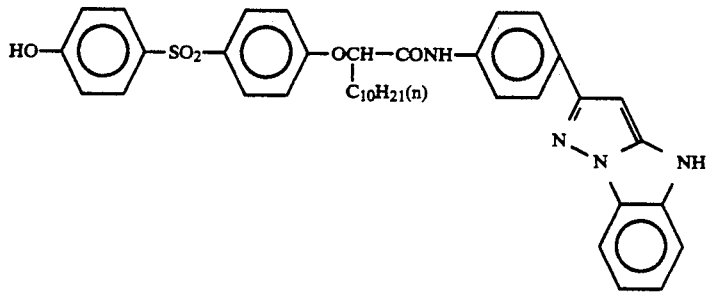
(N-65)
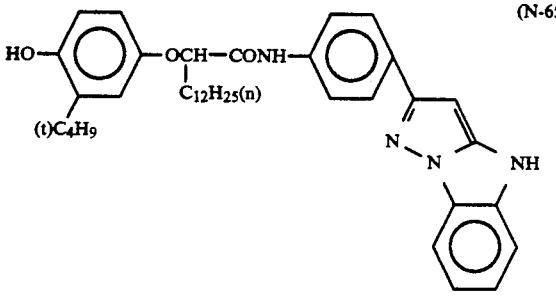
(N-66)
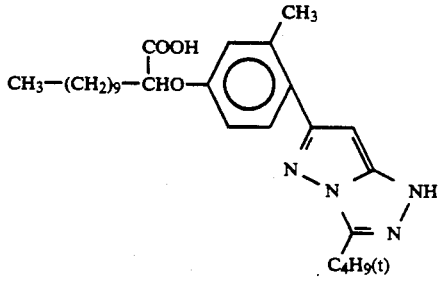
(N-67)
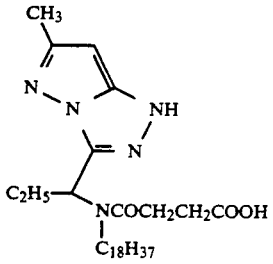
(N-68)
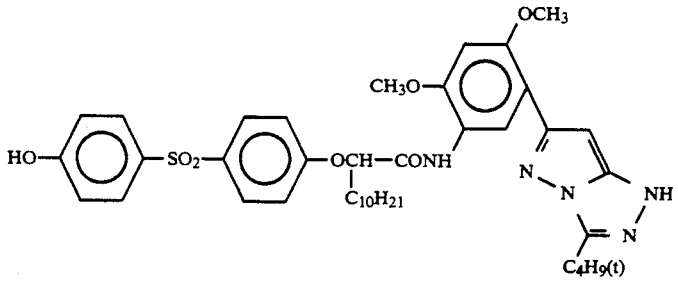
(N-69)
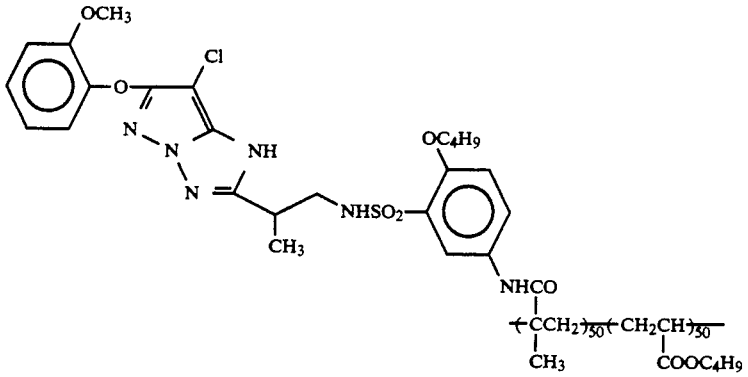

-continued (N-70)

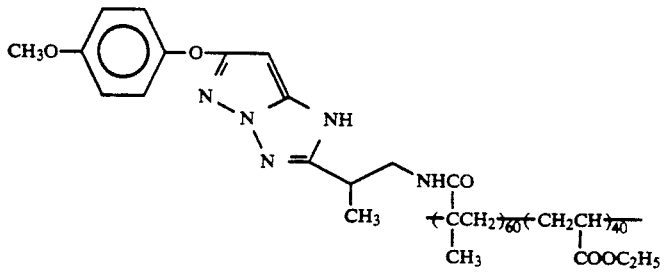

(N-71)

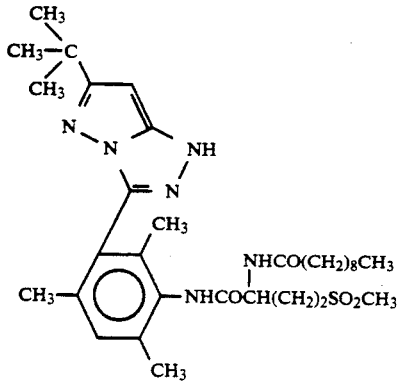

(N-72)

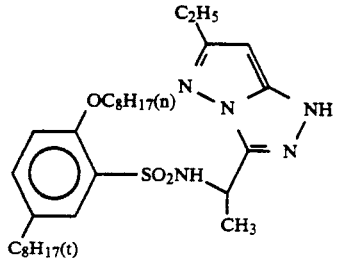

(N-73)

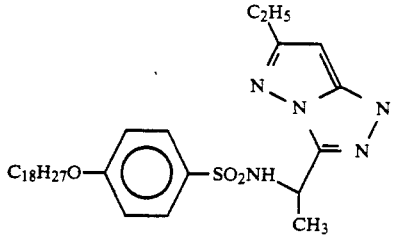

(N-74)

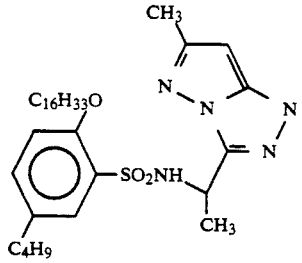

(N-75)

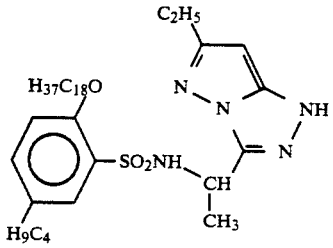

(N-76)

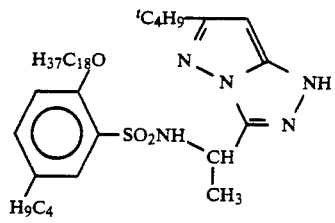

These compounds can be synthesized by methods similar to the synthesizing methods for compounds of Formula (M).

Poly-equivalent couplers represented by Formulas (I) and (II) of the present invention will be described below.

Each of $R_1$ and $R_2$ represents a hydrogen atom or a substituent. Examples of the substituent are a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group.

More specifically, $R_1$ and $R_2$ each represent a hydrogen atom, a halogen atom (e.g., chlorine and bromine), an alkyl group (e.g., a straight-chain or branched alkyl group having 1 to 32 carbon atoms, an aralkyl group, an alkenyl group, an alkinyl group, a cycloalkyl group, or a cycloalkenyl group, such as methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy]dodecaneami do}phenyl}propyl, 2-ethoxytridecyl, trifluoromethyl, cyclopentyl, and 3-(2,4-di-t-amylphenoxy)propyl), an aryl group (e.g., phenyl, 4-t-butylphenyl, 2,4-di-t-amylphenyl, 2,4,6-trimethylphenyl, 3-tridecaneamido-2,4,6-trimethylphenyl, and 4-tetradecaneamidophenyl), a heterocyclic group (e.g., 2-furyl, 2-thienyl, 2-pyrimidinyl, and 2-benzothiazolyl), a cyano group, a hydroxyl group, a nitro group, a carboxyl group, a sulfo group, an amino group, an alkoxy group (e.g., methoxy, ethoxy, 2-methoxyethoxy, 2-dodecylethoxy, and 2-methanesulfonylethoxy), an aryloxy group (e.g., phenoxy, 2-methylphenoxy, 4-t-butylphenoxy, 3-nitrophenoxy, 3-t-butyloxycarbamoylphenoxy, and 3-methoxycarbamoyl), an acylamino group (e.g., acetamido, benzamido, tetradecaneamido, 2-(2,4-di-t-amylphenoxy)-butaneamido, 4-(3-t-butyl-4-hydroxyphenoxy)-butaneamido, and 2-{4-(4-hydroxyphenylsulfonyl)-phenoxy}decaneamido), an alkylamino group (e.g., methylamino, butylamino, dodecylamino, diethylamino, and methylbutylamino), an anilino group (e.g., phenylamino, 2-chloroanilino, 2-chloro-5-tetradecaneaminoanilino, 2-chloro-5-dodecyloxycarbonylanilino, N-acetylanilino, and 2-chloro-5-{2-(3-t-butyl-4-hydroxyphenoxy)dodecaneamido) anilino), a ureido group (e.g., phenylureido, methylureido, and N,N-dibutylureido), a sulfamoylamino group (e.g., N,N-dipropylsulfamoylamino and N-methyl-N-decylsulfamoylamino), an alkylthio group (e.g., methylthio, octylthio, tetradecylthio, 2-phenoxyethylthio, 3-phenoxypropylthio, and 3-(4-t-butylphenoxy)propylthio), an arylthio group (e.g., phenylthio, 2-butoxy-5-t-octylphenylthio, 3-pentadecylphenylthio, 2-carboxyphenylthio, and 4-tetradecaneamidophenylthio), an alkoxycarbonylamino group (e.g., methoxycarbonylamino and tetradecyloxycarbonylamino), a sulfonamido group (e.g., methanesulfonamido, hexadecanesulfonamido, benzenesulfonamido, p-toluenesulfonamido, octadecanesulfonamido, and 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-{3-(2,4-di-t-amylphenoxy)-propyl}carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (e.g., methanesulfonyl, octanesulfonyl, benzenesulfonyl, and toluenesulfonyl), an alkoxycarbonyl group (e.g., methoxycarbonyl, butyloxycarbonyl, dodecyloxycarbonyl, and octadecyloxycarbonyl), a heterocyclic oxy group (e.g., 1-phenyltetrazole-5-oxy and 2-tetrahydropyranyloxy), an azo group (e.g., phenylazo, 4-methoxyphenylazo, 4-pybaloylaminophenylazo, and 2-hydroxy-4-propanoylphenylazo), an acyloxy group (e.g., acetoxy), a carbamoyloxy group (e.g., N-methylcarbamoyloxy and N-phenylcarbamoyloxy), a silyloxy group (e.g., trimethylsilyloxy and dibutylmethylsilyloxy), an aryloxycarbonylamino group (e.g., phenoxycarbonylamino), an imido group (e.g., N-succinimido, N-phthalimido, and 3-octadecenylsuccinimido), a heterocyclic thio group (e.g., 2-benzothiazolylthio, 2,4-diphenoxy-1,3,5-triazole-6-thio, and 2-pyridylthio), a sulfinyl group (e.g., dodecanesulfinyl, 3-pentadecylphenylsulfinyl, and 3-phenoxypropylsulfinyl), a phosphonyl group (e.g., phenoxyphosphonyl, octyloxyphosphonyl, and phenylphosphonyl), an aryloxycarbonyl group (e.g., phenoxycarbonyl), an acyl group (e.g., acetyl, 3-phenylpropanoyl, benzoyl, and 4-dodecyloxybenzoyl), and an azolyl group (e.g., imidazolyl, pyrazolyl, 3-chloro-pyrazole-1-yl, and triazolyl). Of these substituents, a group which can further have a substituent may further have an organic substituent, which is bonded by a carbon atom, an oxygen atom, a nitrogen atom, or a sulfur atom, or a halogen atom.

Of these substituents, preferable examples of $R_1$ and $R_2$ are an alkyl group, an aryl group, an alkoxy group, an aryloxy group, an alkylthio group, a ureido group, a urethane group, and an acylamino group.

In Formula (I), A represents a hydrogen atom, a halogen atom, an aryloxy group, an alkoxy group, an arylthio group, an alkylthio group, or 1-azolyl group. Examples of X are a halogen atom (e.g., fluorine, chlorine, and bromine), an aryloxy group (e.g., 4-methylphenoxy, 4-chlorophenoxy, 4-methoxyphenoxy, 4-carboxyphenoxy, and 3-methoxycarbonylphenoxy), an alkoxy group (e.g., ethoxy, methoxymethoxy, ethoxycarbonylmethoxy, methylsulfonylethoxy, 3-carboxypropyloxy), an arylthio group (e.g., phenylthio, 2-butoxy-5-t-octylphenylthio, and 2-pivaloylaminophenylthio), an alkylthio group (e.g., dodecylthio, 1-carboxydodecylthio, and 1-ethoxycarbonyldodecylthio), a 1-azolyl group (e.g., 1-pyrazolyl, 1-imidazolyl, 1-triazolyl, 4-chloro-1-pyrazolyl, 4-methoxycarbonyl-1-pyrazolyl, and 4-cyano-1-pyrazolyl).

A is preferably a hydrogen atom, a halogen atom, or an aryloxy group.

In Formula (I), a Cp group represents a coupling block group which produces a colorless or alkali-soluble reaction product after a reaction with the oxidized form of a color developing agent and is bonded at its coupling position, and preferably a group represented by Formula (III), (IV), (V), (VI), or (VII) below.

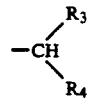

Formula (III)

$R_3$ represents an alkoxycarbonyl group, an aryloxycarbonyl group, a heterocyclic oxycarbonyl group, an alkylcarbamoyl group, an arylcarbamoyl group, a heterocyclic carbamoyl group, an alkylcarbonyl group, an arylcarbonyl group, a heterocyclic carbonyl group, an alkoxythiocarbonyl group, an aryloxythiocarbonyl group, an alkylsulfonyl group, an arylsulfonyl group, a heterocyclic sulfonyl group, an alkylsulfinyl group, an arylsulfinyl group, a heterocyclic sulfinyl group, an alkylsulfamoyl group, an arylsulfamoyl group, a heterocyclic sulfamoyl group, a nitro group, a cyano group, or a carboxyl group. $R_4$ represents, in addition to the groups defined above for $R_3$, a hydrogen atom, a halogen atom, an alkyl group (straight-chain, branched, or cyclic), an aryl group, an alkoxy group, an aryloxy group, an alkylthio group, an arylthio group, an acyloxy group, an amino group, an alkylcarbamoyl group, an arylcarbamoyl group, an acylcarbamoyl group, or a heterocyclic ring. $R_3$ and $R_4$ may close together to form a 5- or 6-membered hydrocarbon ring or a 5- or 6-membered heterocyclic ring having a carbonyl group at an $\alpha$ position with respect to —CH—.

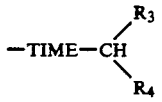

Formula (IV)

$R_3$ and $R_4$ have the same meanings as described above for Formula (III), and TIME represents a group which causes an intramolecular nucleophilic reaction or electric charge transistor along a conjugated system after a —CH($R_2$)C$R_3$ group reacts with the oxidized form of a color developing agent to release a —TIME— group.

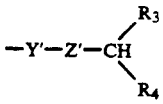

Formula (V)

$R_3$ and $R_4$ have the same meanings as described above for Formula (III), Y' represents an oxygen atom or a sulfur atom, and Z' represents a carbonyl group, a thiocarbonyl group, an oxalyl group, a sulfonyl group, a sulfinyl group, a methylene group, or a substituted methylene group.

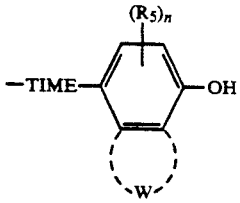

Formula (VI)

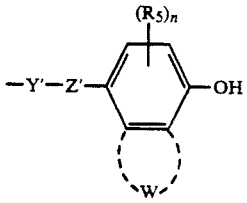

Formula (VII)

In Formulas (VI) and (VII), Formula (a)

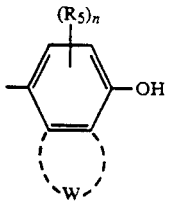

(a)

represents a cyan dye forming coupler moiety having a phenol nucleus or a naphthol nucleus, W represents an atom group which is condensed with a phenyl nucleus to form a naphthol nucleus, $R_5$ has the same meanings as described above for $R_1$ and $R_2$, n represents an integer from 1 to 4 when the cyan image forming coupler is a phenol nucleus and an integer from 1 to 6 when it is a naphthol nucleus, TIME represents the same meaning as defined above for Formula (IV), and —Y'—Z'— has the same meaning as defined above for Formula (V). If n=2 or more, a plurality of $R_5$'s may be the same or different.

A substituent represented by Formula (III), (IV), (V), (VI), or (VII) will be described in more detail below. $R_3$ represents an alkoxycarbonyl group (e.g., methoxycarbonyl, dodecyloxycarbonyl, and benzyloxycarbonyl, cyclohexyl carbonyl), an alkyl carbonyl group (e.g., acetyl, pivaloyl, i-butyloyl, cyclohexanoyl, 3-butyloyl, cyclopropanecarbonyl, and phenylacetyl), an arylcarbonyl group (e.g., benzoyl, 4-methoxybenzoyl, 2-chlorobenzoyl, β-naphthoyl, and 4-tert-butylbenzoyl), a heterocyclic carbonyl group (e.g., 2-pyridinecarbonyl), an alkoxythiocarbonyl group (e.g., benzyloxythiocarbonyl or ethoxythiocarbonyl), an arylthiocarbonyl group (e.g., phenoxythiocarbonyl), an alkylsulfonyl group (e.g., methanesulfonyl, octanesulfonyl, dodecanesulfonyl, and 2-ethylhexanesulfonyl), an arylsulfonyl group (e.g., a benzenesulfonyl group, p-toluenesulfonyl, and p-acetoamidophenylsulfonyl), a heterocyclic sulfonyl group (e.g., 2-pyridinesulfonyl and 2-thiophenesulfonyl), an alkylsulfinyl group (e.g., methanesulfinyl and octanesulfinyl), an arylsulfinyl group (e.g., benzenesulfinyl), a heterocyclic sulfinyl group (e.g., 4-pyridinesulfinyl and 5-quinolinesulfinyl), an alkylsulfamoyl group (e.g., an N-ethylsulfamoyl group or N-benzylsulfamoyl), an arylsulfamoyl group (e.g., N-phenylsulfamoyl, N-ethyl-N-phenylsulfamoyl, N-(4-methoxycarbonylphenyl)sulfamoyl, and N-(2-chlorophenyl)sulfamoyl), a heterocyclic sulfamoyl group (e.g., N-(2-pyridyl)sulfamoyl and N-(2-quinolyl)-sulfamoyl), a nitro group, a cyano group, or a carboxyl group.

$R_4$ represents, in addition to the groups defined above for $R_3$, a hydrogen atom, a halogen atom (e.g., chlorine and bromine), an alkyl group (e.g., methyl, t-butyl, i-propyl, cyclohexyl, and allyl), an aryl group (e.g., phenyl, 4-nitrophenyl, 2-nitro-4-cyanophenyl, a 4-cyanophenyl group, and 4-methanesulfonylphenyl), an alkoxy group (e.g., methoxy, ethoxy, and benzyloxy), an aryloxy group (e.g., phenoxy and 4-nitrophenoxy), an alkylthio group (e.g., ethoxythio, benzylthio, and 2-cyclohexane-1-thio), an arylthio group (e.g., phenylthio, 4-chlorophenylthio, 4-methoxyphenylthio, 4-cyanophenylthio, 2-chloro-4-tetradecaneamidophenylthio, and 2-butoxy-t-octylphenylthio), an acyloxy group (e.g., acetoxy, benzoyloxy, 2-pyridinecarbonyloxy, and hexanoyloxy), an amino group (e.g., amino, anilino, 2-chloroanilino, cyclopentylamino, α-ethoxycarbonyltridecylthio, N-piperidino, and N-morpholino), an alkylcarbazoyl group (e.g., ethylcarbazoyl), an arylcarbazoyl group (e.g., phenylcarbazoyl, 4-methoxycarbazoyl, and 2-chloro-4-methanesulfonylcarbazoyl), an acylcarbamoyl group (e.g., N-acetylcarbamoyl and N-phenylcarbamoyl), or a heterocyclic ring (e.g., 2-pyridyl, 2-pyrimidyl, 2-thiophenyl, and 2-furyl). $R_3$ and $R_4$ may close together to form a 5- or 6-membered hydrocarbon ring (e.g., Formulas (b) to (i)) or 6-membered heterocyclic ring (e.g., Formulas (j) to (w) wherein each of $R_6$ and $R_7$ represents a hydrogen atom or an alkyl group, an aryl group, an alkoxy group, an aryloxy group, an alkylthio group, an arylthio group, an amino group, an acylamino group, a carbamoyl group, a sulfamoyl group, a sulfonamide group, a sulfonyl group, a sulfinyl group, or an acyl group, each of which is defined above for $R_4$) having a carbonyl group at an α position with respect to —CH= or a 5-.

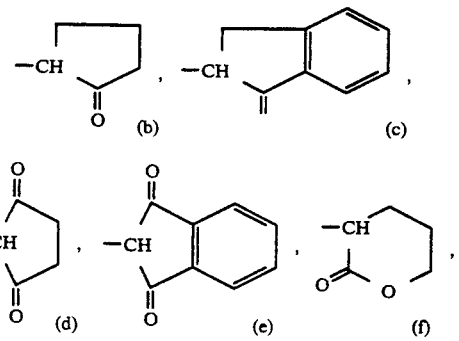

(b) (c) (d) (e) (f)

-continued

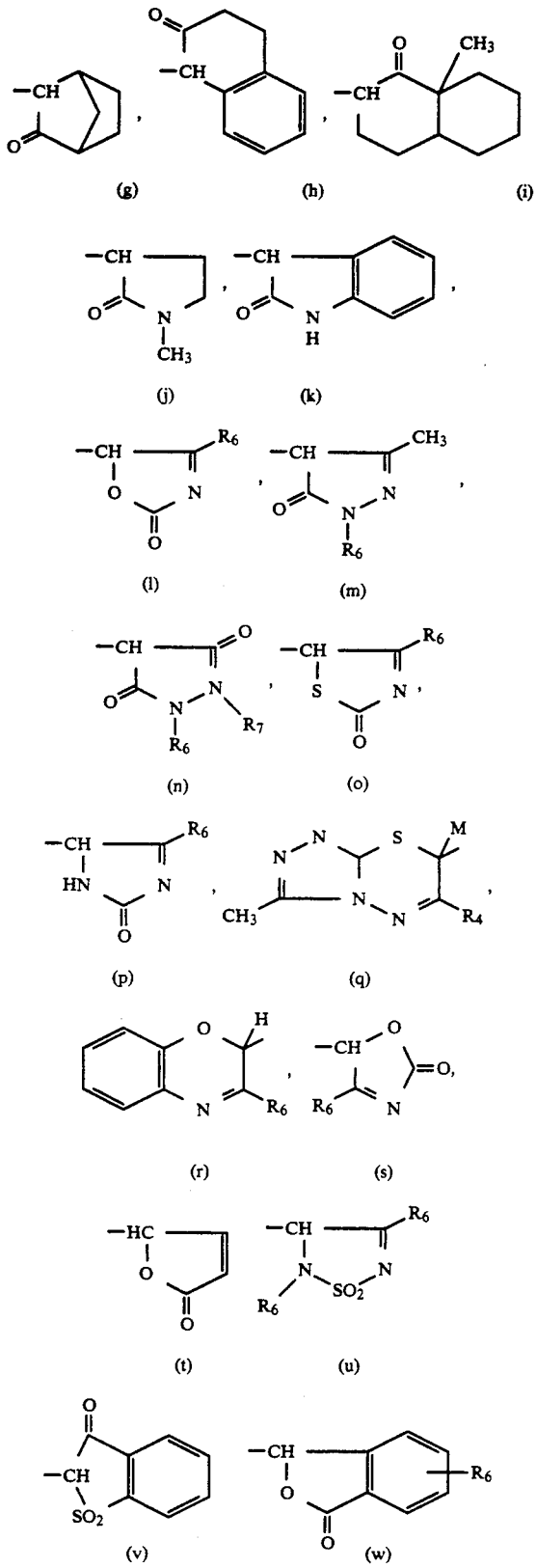

In Formulas (IV) and (VI), TIME represents a known timing control group described in U.S. Pat. No. 4,248,962, JP-A-56-114946, JP-A-57-56837, JP-A-57-154234, JP-A-57-188635, and JP-A-58-98723.

In Formulas (V) and (VII), Y' represents an oxygen atom or a sulfur atom, and z' represents a carbonyl group, a thiocarbonyl group, an oxalyl group, a sulfonyl group, a sulfinyl group, a methylene group, or a substituted methylene group (e.g., a methylmethylene group, an ethylmethylene group, a phenylmethylene group, a chloromethylene group, an iso-propylmethylene group, a 2-pyridylmethylene group, and a 1-imidazolyl-methylene group).

In Formula (II), L represents a scavenger for the oxidized form of a color developing agent, which can scavenge the oxidized form of a color developing agent through a redox reaction or a coupling reaction after released by a reaction with the oxidized form of a color developing agent. L will be described in more detail below.

When L represents a scavenger which scavenges the oxidized form of a color developing agent through a redox reaction after the release, a compound having this reducing power includes all compounds which follow a Kendall-Pelz rule. Examples are reducing agents described in Aagew, Chem. Int. Ed., 17 875 (1978), The Theory of the Photographic Process, 4th ed. (Macmillan 1977), 11th paragraph and JP-A-59-5247, and precursors capable of releasing these reducing agents during development. L is preferably a group represented by Formula (VIII), (IX), or (X) below.

Formula (VIII)

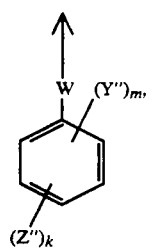

Formula (IX)

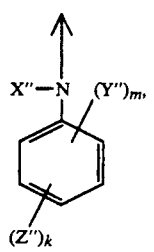

Formula (X)

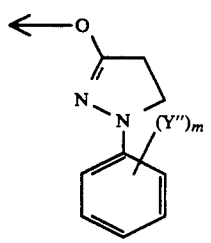

In Formula (VIII), an arrow represents a position of coupling with a pyrazoloazole skeleton, and W represents an oxygen atom or a sulfur atom. Z'' represents an —OH group, an —$OCOR_8$ group, an —$OSOR_8$ group, an —$OSO_2R_8$ group, an —$NHR_8$ group, an —$NR_9SOR_8$ group, and/or an —$NR_9SO_2R_8$ group at an ortho position and/or a para position with respect to W. $R_8$ represents an aliphatic group, an aromatic group, or a heterocyclic group, $R_9$ represents a hydrogen atom or an aliphatic group, and k represents an integer from 1 to 3. Y'' represents a substituent on a benzene ring, and m represents an integer from 0 to 3.

In Formula (IX), an arrow represents a position of coupling with a pyrazoloazole skeleton, and X'' represents an electron attracting group. Z'' is substituted at an ortho position and/or a para position with respect to a nitrogen atom. Z'', $R_8$, $R_9$, Y'', k, and m have the same meanings as defined above for Formula (VIII).

In Formula (X), an arrow and Y'' have the same meanings as defined above for Formula (VIII), and m represents an integer from 0 to 4.

Each of these scavengers may be bonded with a pyrazoloazole skeleton not directly but via a timing group. Methods of bonding the scavenger via a timing group are described in, e.g., U.S. Pat. No. 4,248,962, JP-A-56-114946, JP-A-57-154234, JP-A-57-188035, JP-A-57-56837, and JP-A-58-209740.

In Formulas (I) and (II), X and Y represent each a nitrogen atom or a carbon atom. X and Y do not simultaneously represent nitrogen atoms at the same time. . . . represents a $\pi$ electron pair for forming a conjugated double bond, and more specifically, represents 1H-pyrazolo[1,5-b][1,2,4]triazole, 1H-pyrazolo[5,1-c][1,2,4]triazole, or 1H-imidazo[1,2,b]pyrazole represented by Formula (A), (B), or (C) below. When X or Y represents a carbon atom, this carbon atom can have a substituent having the same meaning as defined above for $R_1$ and $R_2$.

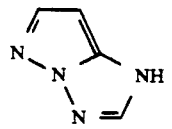
(A)

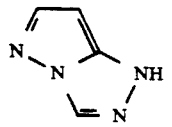
(B)

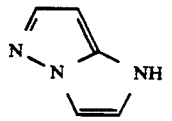
(C)

Practical examples of couplers of the present invention represented by Formulas (I) and (II) are presented below, but the present invention is not limited to these examples.

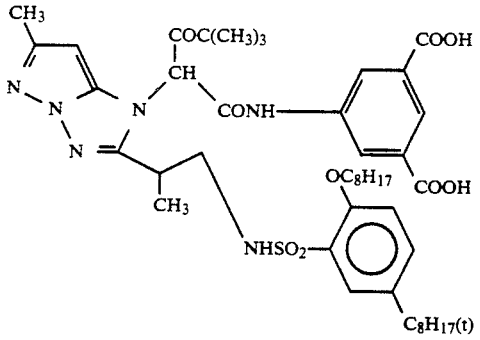
(1)

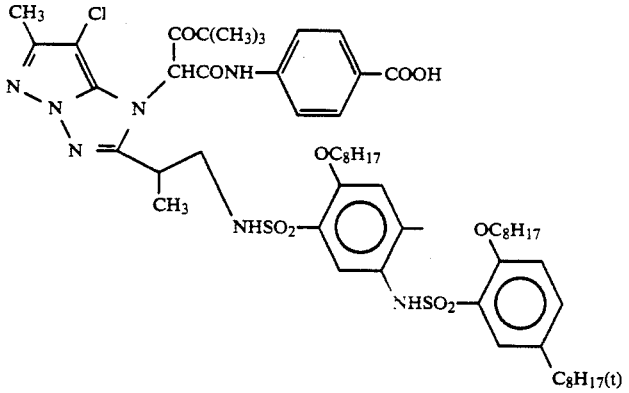
(2)

-continued
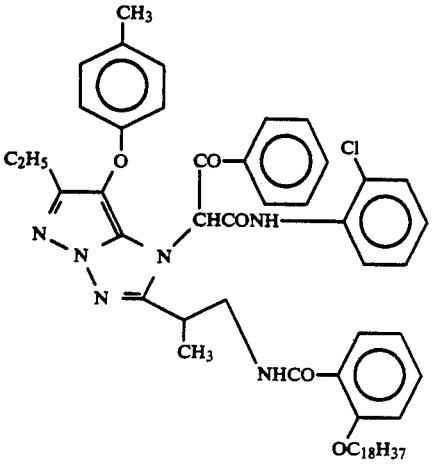
(3)
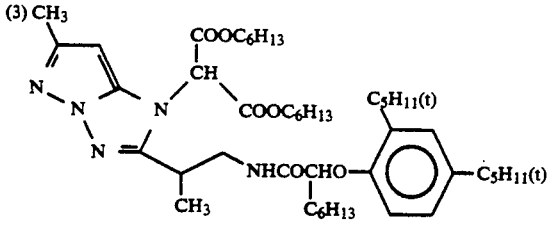
(4)
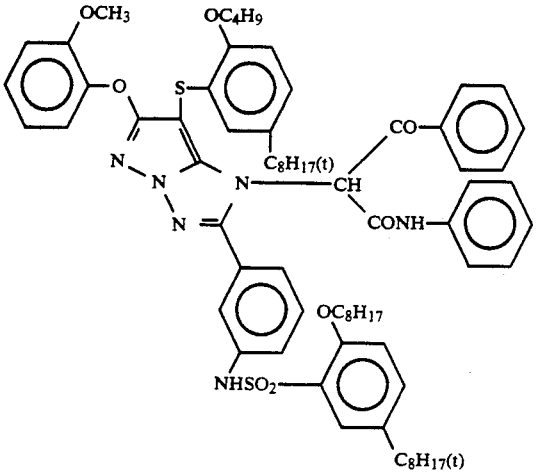
(5)
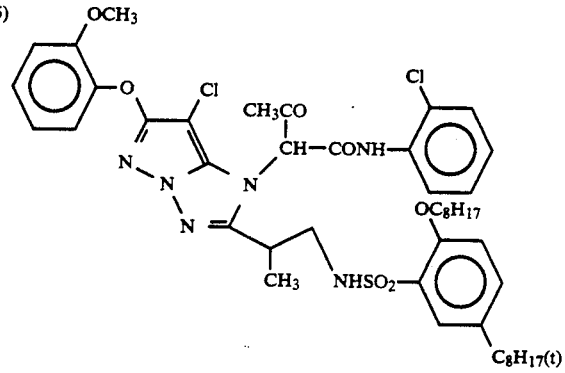
(6)
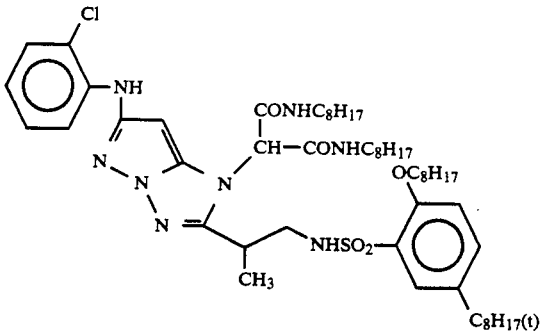
(7)
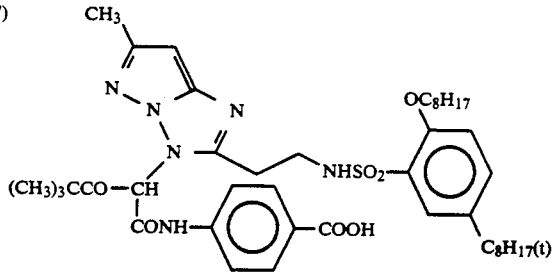
(8)
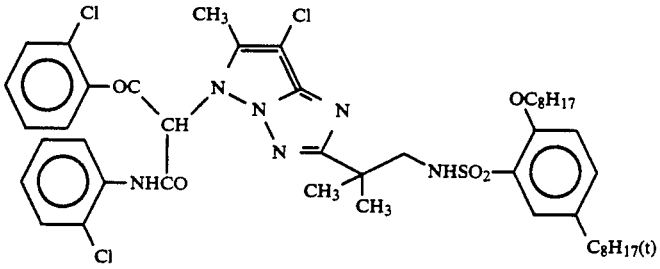
(9)

-continued
(10)
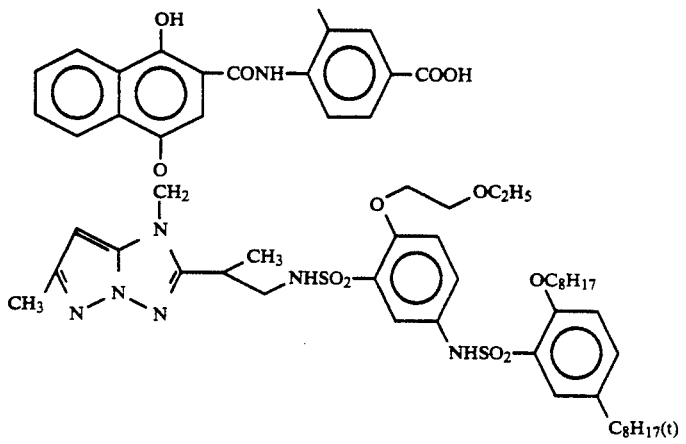
(11)
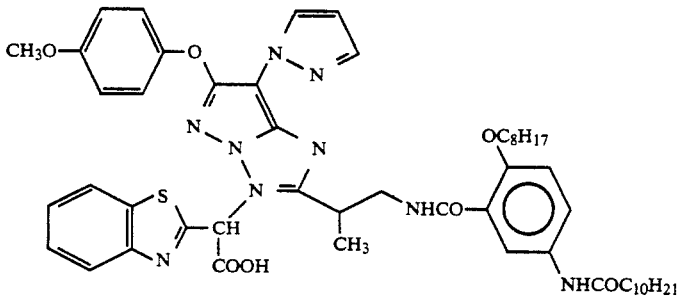
(12)
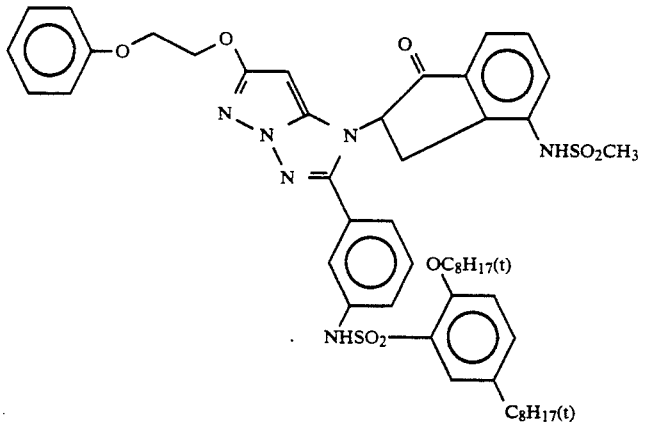
(13)
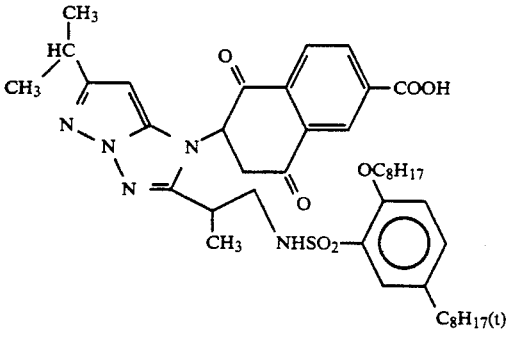
(14)
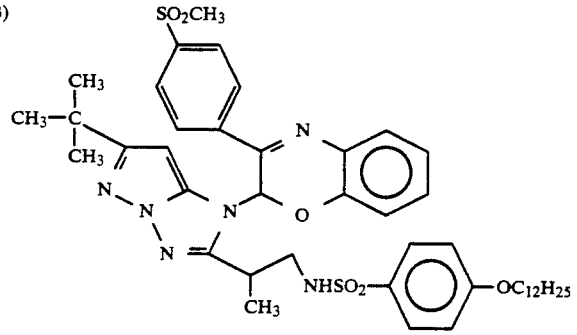

-continued
(15)
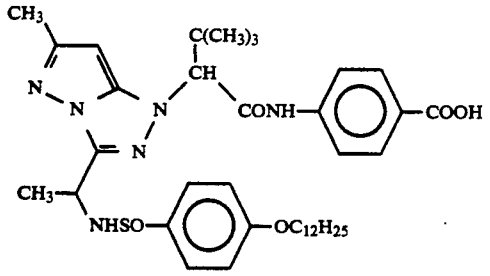
(16)
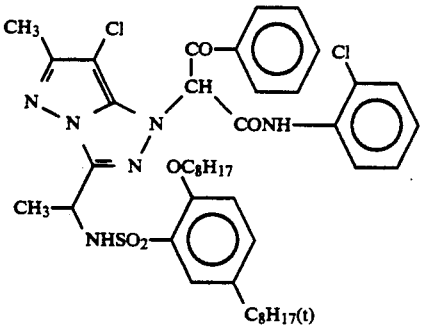
(17)
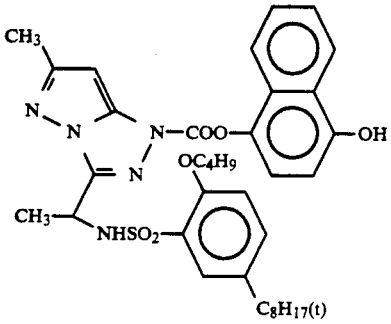
(18)
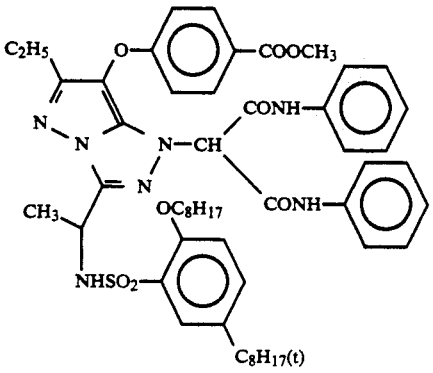
(19)
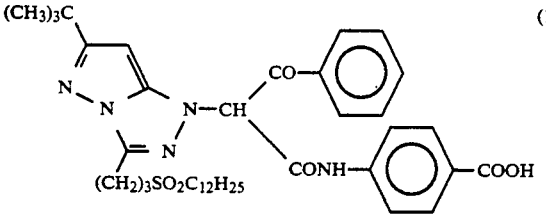
(20)
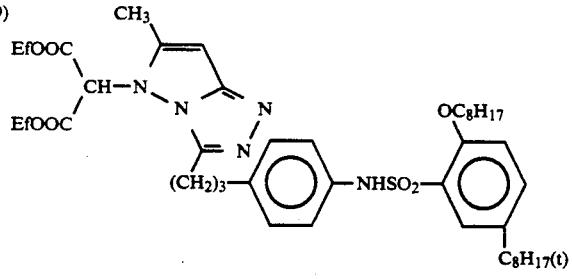
(21)
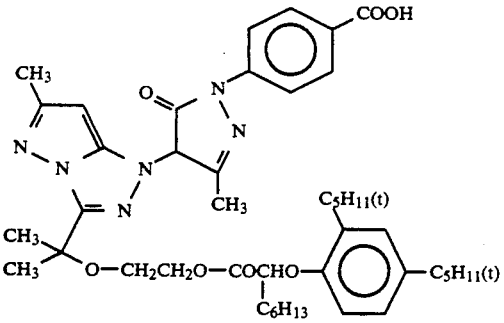
(22)
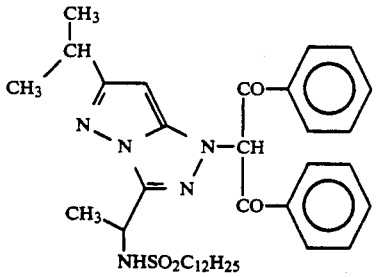
(23)
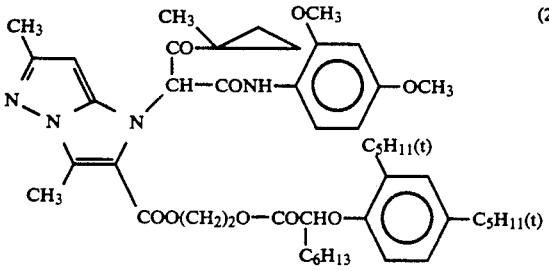
(24)
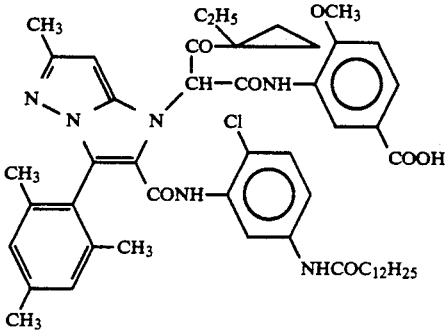

-continued
(25)
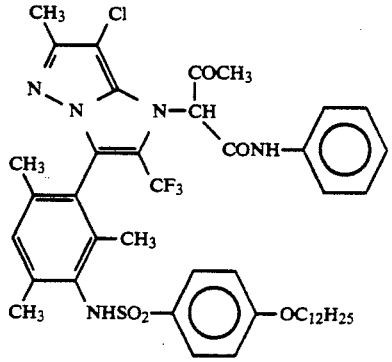
(26)
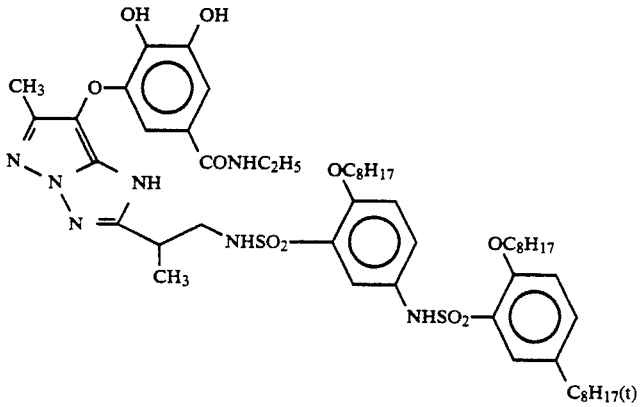
(27)
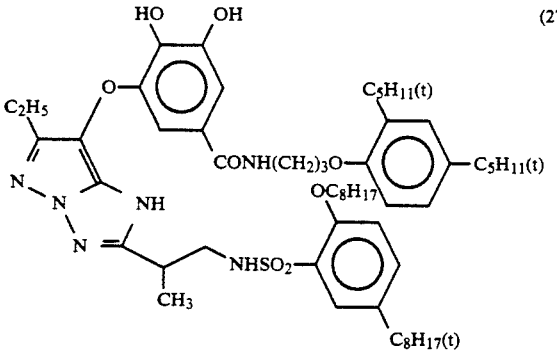
(28)
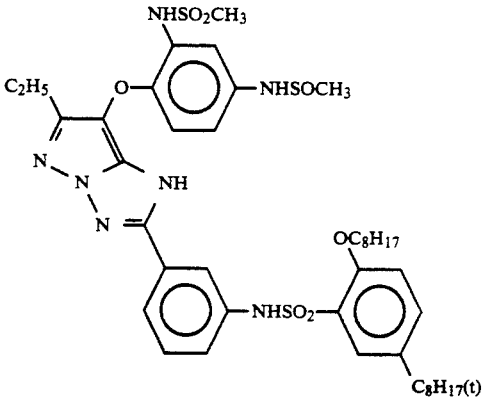
(29)
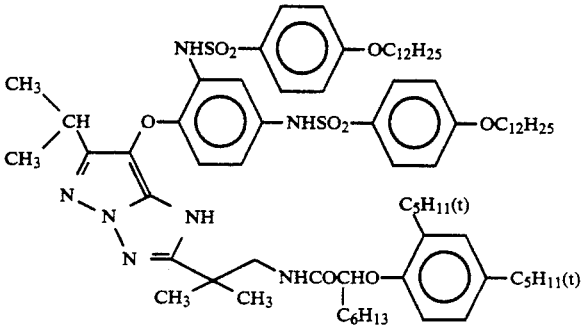

-continued
(30)
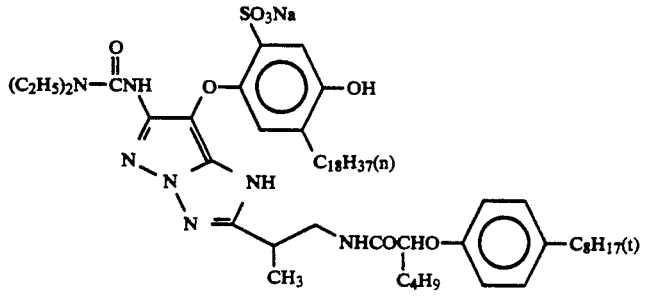
(31)
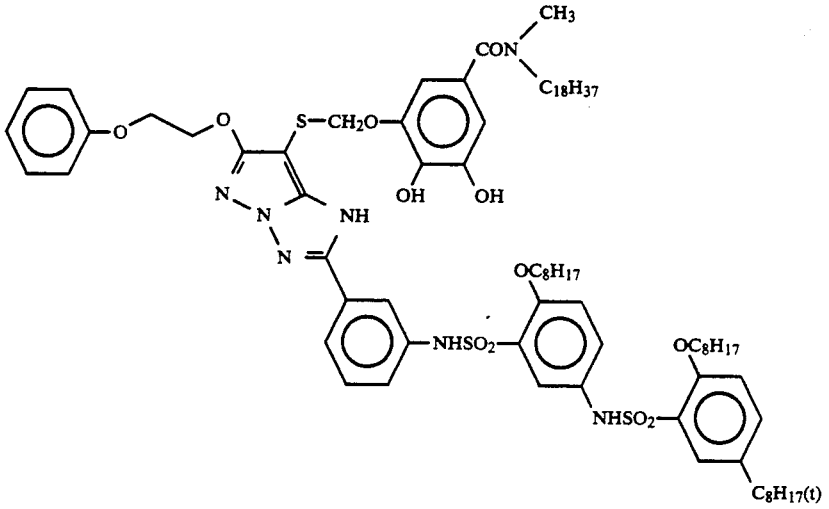
(32)
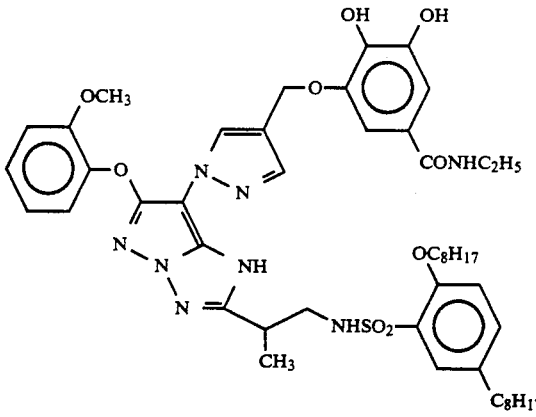
(33)
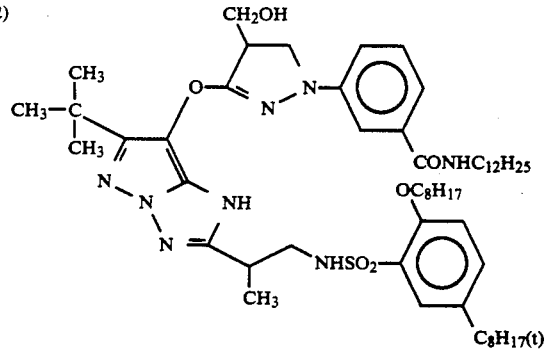
(34)
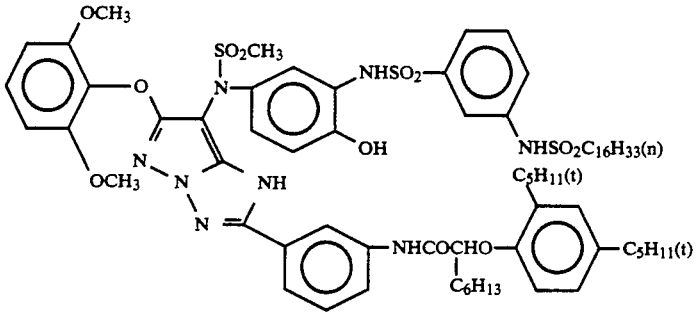

-continued
(35)
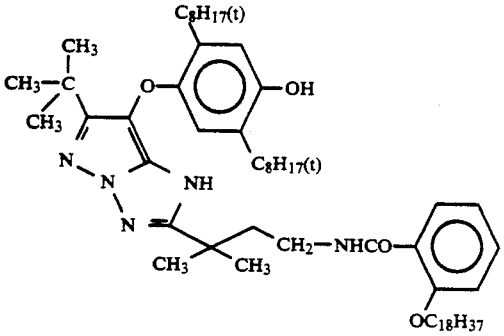
(36)
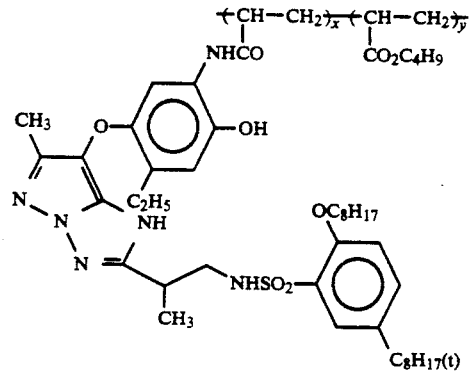
x:y = 1:2
mean molecular weight: 20,000
(37)
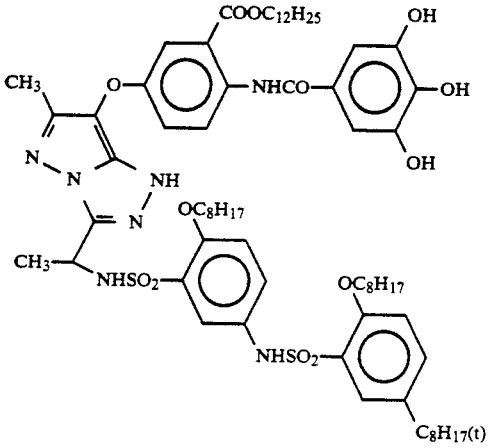
(38)
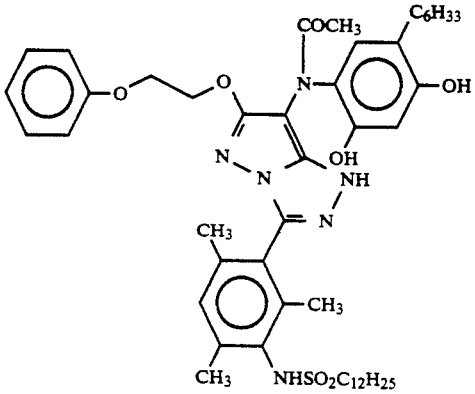
(39)
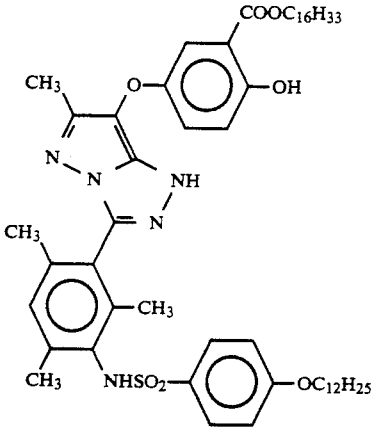
(40)
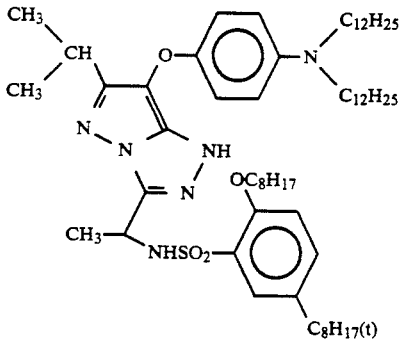
(41)
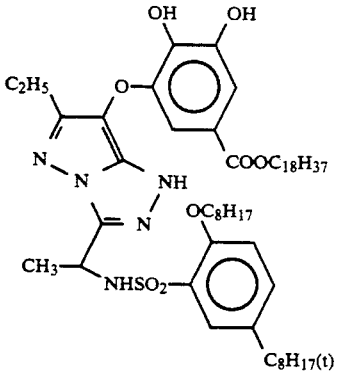
(42)
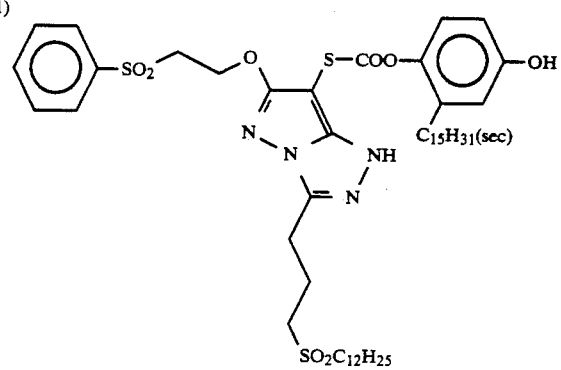

-continued (43)

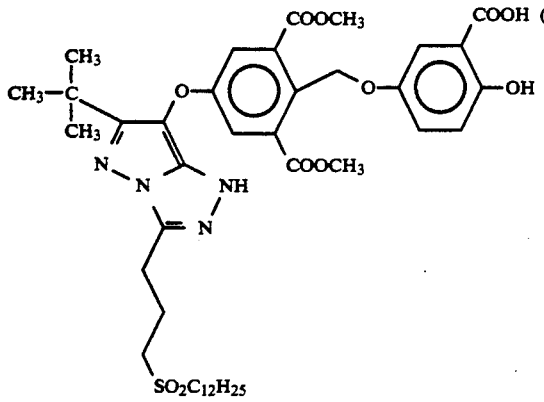

(44)

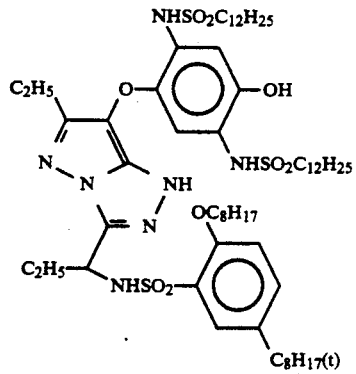

(45)

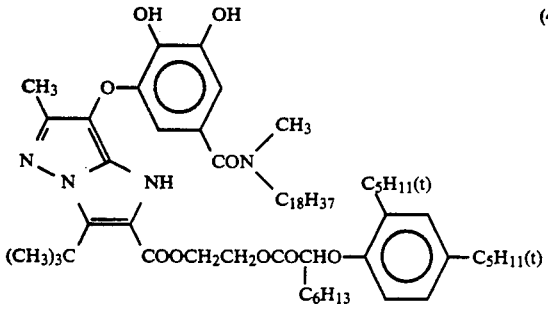

(46)

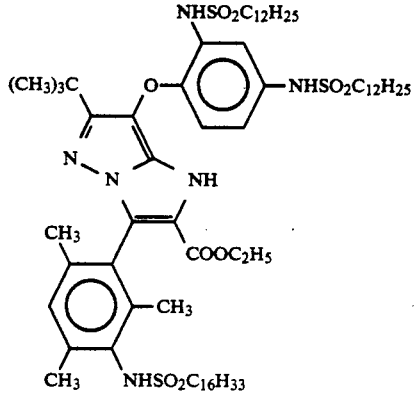

(47)

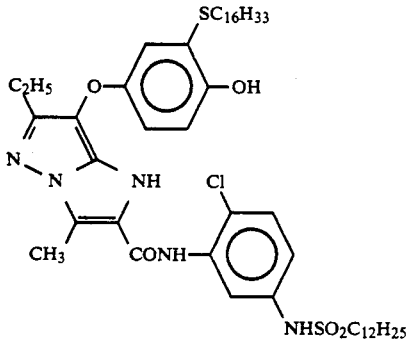

(48)

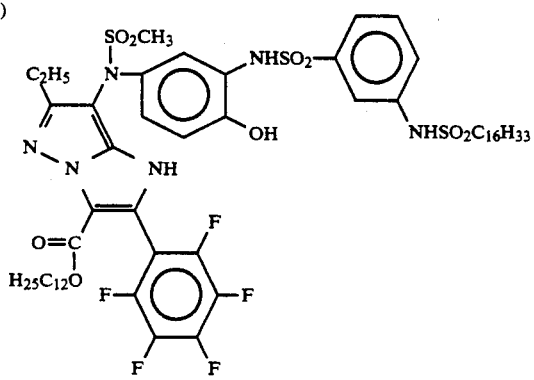

(49)

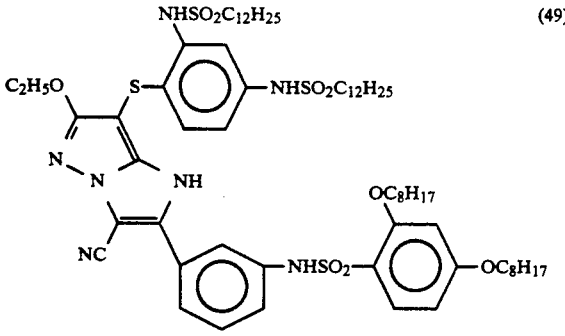

(50)

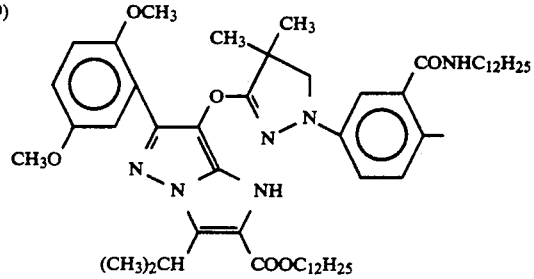

The couplers of the present invention can be synthesized by methods described in, e.g., JP-A-60-191253, JP-A-63-189865, and JP-A-64-548.

Of couplers represented by Formulas (I) and (II), the use of a coupler represented by Formula (I) is more preferable in the present invention.

Of the pyrazoloazole-based magenta couplers used in the present invention, a coupler represented by Formula (M-III) is excellent in color forming properties, a hue, and dye fastness. In addition, this coupler causes little interaction with a silver halide emulsion and has only an insignificant adverse effect on processibility.

For these reasons, the use of this coupler is preferred. The present inventors have found that when a light-sensitive material containing a coupler represented by Formula (M-III) is developed through processes including a B/W process, a change in photographic properties due to a variation in a pH of the first developing solution is small. This coupler is superior in color forming properties and an interaction with a silver halide emulsion especially in a color developing solution with a pH of 11 or more.

The couplers of the present invention are used in a light-sensitive material having a multilayered structure and added primarily to a green-sensitive silver halide emulsion layer. The green-sensitive emulsion layer is constituted by at least two layers essentially sensitive to the same color and having different sensitivities. In some cases, the green-sensitive emulsion layer can consist of three layers or four or more layers.

Couplers represented by Formulas (M), (N), (I) and (II) of the present invention can also be added to non-light-sensitive interlayers adjacent to the layers described in the appended claims, as well as to the layers described the claims. In addition, it is also preferred to use couplers represented by Formulas (M), (N), (I) and (II) together as long as the effect of the present invention is not degraded. The addition amount of each of couplers represented by Formulas (M), (N), (I) and (II) is generally 0.01 to 1 mmol, and preferably 0.05 to 0.5 mmol per 1 $m^2$ of a light-sensitive material.

In the present invention, the amount of 4-equivalent or poly-equivalent magenta couplers represented by Formulas (N), (I) or (II) to be added to a green-sensitive layer having a highest sensitivity is preferably 25 mol % or more, and more preferably 50 mol % or more, of entire magenta couplers contained in the layer. The amount of a 2-equivalent magenta coupler represented by Formula (M) to be added to a green-sensitive layer having a lowest sensitivity is preferably 25 mol % or more, and more preferably 50 mol % or more of entire magenta couplers contained in the layer.

In the present invention, a green-sensitive layer having a highest sensitivity is preferably located farther from a support than a green-sensitive layer having a lowest sensitivity. A preferable number of green-sensitive layers is three.

In the present invention, a color light-sensitive material is preferably a color light-sensitive material for photography, and more preferably a color light-sensitive material for photography developed by processes including a B/W process.

In the light-sensitive material of the present invention, at least one of blue-, and red-sensitive silver halide emulsion layers and at least two green-sensitive layers are formed on a support, and the number and order of the silver halide emulsion layers and non-light-sensitive layers are not particularly limited. A typical example is a silver halide photographic light-sensitive material having, on its support, at least one light-sensitive layer constituted by a plurality of silver halide emulsion layers which are sensitive to essentially the same color but have different sensitivities. This light-sensitive layer is a unit sensitive layer which is sensitive to one of blue light, green light, and red light. In a multilayered silver halide color photographic light-sensitive material, such unit light-sensitive layers are generally arranged in an order of red-, green-, and blue-sensitive layers from a support. However, according to the intended use, this arrangement order may be reversed, or light-sensitive layers sensitive to the same color may sandwich another light-sensitive layer sensitive to a different color.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity is sequentially decreased toward a support, and a non-light-sensitive layer may be formed between the respective silver halide emulsion layers. In addition, as described in JP-A-57-112751, JP-A-62-200350, JP-A-62-206541, and JP-A-62-206543, layers may be arranged such that a low-speed emulsion layer is formed farther from a support and a high-speed layer is formed closer to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

In addition, an order of high-speed emulsion layer/-low-speed emulsion layer/medium-speed emulsion layer or low-speed emulsion layer/medium-speed emulsion layer/high-speed emulsion layer may be adopted. Furthermore, the arrangement can be changed as described above even when four or more layers are formed.

In order to improve color reproducibility, a donor layer (CL) for an interlayer effect, which is described in U.S. Pat. No. 4,663,271, 4,705,744, or 4,707,436, JP-A-62-160448, or JP-A-63-89580 and different from the main light-sensitive layers BL, GL, and RL in spectral sensitivity distribution, is preferably formed adjacent to or close to the main light-sensitive layers.

As described above, various layer types and arrangements can be selected according to the intended use of the light-sensitive material. A preferable silver halide contained in photographic emulsion layers of the photographic light-sensitive material of the present invention is silver bromoiodide, silver iodochloride, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as twin planes, or composite shapes thereof.

The silver halide may be fine grains having a grain size of about 0.2 μm or less or large grains having a projected area diameter of about 10 μm, and an may be either a polydisperse emulsion or monodisperse emulsion.

A silver halide photographic emulsion which can be used in the light-sensitive material of the present invention can be prepared by methods described in, for example, "I. Emulsion preparation and types," Research Disclosure (RD) No. 17,643 (December, 1978), pp. 22 and 23, RD No. 18,716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

A crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be any of a surface latent image type emulsion which mainly forms a latent image on the surface of a grain, an internal latent image type emulsion which forms a latent image in the interior a grain, and an emulsion of another type which has latent images on the surface and in the interior of a grain. However, the emulsion must be a negative type emulsion. The internal latent image type emulsion may be a core/shell type internal latent image type emulsion described in JP-A-63-264740. A method of preparing this core/shell type internal latent image type emulsion is described in JP-A-59-133542. Although the thickness of a shell of this emulsion depends on, e.g., development conditions, it is preferably 3 to 40 nm, and most preferably 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105, and they are summarized in a table to be presented later.

In the light-sensitive material of the present invention, it is possible to simultaneously use, in a single layer, two or more types of emulsions different in at least one of characteristics of a light-sensitive silver halide emulsion, i.e., a grain size, a grain size distribution, a halogen composition, a grain shape, and a sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in light-sensitive silver halide emulsion layers and/or essentially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852.

A silver halide which forms the core of an internally fogged core/shell type silver halide grain may have either a single halogen composition or different halogen compositions. As the internally fogged or surface-fogged silver halide, any of silver chloride, silver chlorobromide, silver bromoiodide, and silver bromochloroiodide can be used. Although the grain size of these fogged silver halide grains is not particularly limited, the average grain size is preferably 0.01 to 0 75 μm, and most preferably 0.05 to 0.6 μm. Since the grain shape is not particularly limited either, regular grains may be used. The emulsion may be a polydisperse emulsion but is preferably a monodisperse emulsion (in which at least 95% in weight or the number of grains of silver halide grains have grain sizes falling within a range of ±40% of an average grain size).

In the present invention, it is preferable to use a non-light-sensitive fine grain silver halide. The non-light-sensitive fine grain silver halide preferably consists of silver halide grains which are not exposed during imagewise exposure for obtaining a dye image and are not essentially developed during development. These silver halide grains are preferably not fogged in advance.

In the fine grain silver halide, the content of silver bromide is 0 to 100 mol %, and silver chloride and/or silver iodide may be added if necessary. The fine grain silver halide preferably contains 0.5 to 10 mol % of silver iodide.

The average grain size (average value of an equivalent-circle diameter of a projected area) of the fine grain silver halide is preferably 0.01 to 0.5 μm, and more preferably 0.02 to 0.2 μm.

The fine grain silver halide can be prepared following the same procedures as for a common light-sensitive silver halide. In this case, the surface of each silver halide grain need not be optically sensitized nor spectrally sensitized. However, before the silver halide grains are added to a coating solution, it is preferable to add a well-known stabilizer such as a triazole-based compound, an azaindene-based compound, a benzothiazolium-based compound, a mercapto-based compound, or a zinc compound. Colloidal silver can be preferably added to this fine grain silver halide grain-containing layer.

The silver coating amount of the light-sensitive material of the present invention is preferably 6.0 g/m$^2$ or less, and most preferably 4.5 g/m$^2$ or less.

Well-known photographic additives usable in the present invention are also described in the three Research Disclosures described above, and they are summarized in the following table.

| | Additives | RD17643 | RD18716 | RD307105 |
|---|---|---|---|---|
| 1. | Chemical sensitizers | page 23 | page 648, right column | page 866 |
| 2. | Sensitivity increasing agents | | page 648, right column | |
| 3. | Spectral sensitizers, super, sensitizers | page 23–24 | page 648, right column to page 649, right column | pages 866–868 |
| 4. | Brighteners | page 24 | | page 868 |
| 5. | Antifoggants and stabilizers | pages 24–25 | page 649, right column | pages 868–870 |
| 6. | Light absorbent filter dye, ultraviolet absorbent | pages 25–26 | page 649, right column to page 650, left column | page 873 |
| 7. | Stain preventing agents | page 25, right column | page 650, left to right columns | page 872 |
| 8. | Dye image stabilizer | page 25 | page 650, left column | page 872 |
| 9. | Hardening agents | page 26 | page 651, left column | pages 874–875 |
| 10. | Binder | page 26 | page 651, left column | pages 873–874 |
| 11. | Plasticizers, lubricants | page 27 | page 650, right column | page 876 |
| 12. | Coating aids, surface active agents | pages 26–27 | page 650, right column | pages 875–876 |
| 13. | Antistatic agents | page 27 | page 650, right column | pages 876–877 |
| 14. | Matting agent | | | pages 878–879 |

In order to prevent deterioration in photographic properties caused by formaldehyde gas, the light-sensitive material is preferably added with a compound described in U.S. Pat. Nos. 4,411,987 or 4,435,503, which can react with formaldehyde to fix it.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains a compound described in JP-A-1-106052, which releases a fogging agent, a development accelerator, a silver halide solvent, or a precursor of any of them regardless of a developed amount of silver produced by development.

The light-sensitive material of the present invention preferably contains dyes dispersed by methods described in WO 04794/88 and PCT No. 1-502912, or dyes described in EP 317,308A, U.S. Pat. No. 4,420,555, and JP-A-1-259358.

Various color couplers can be used in the present invention, and specific examples of these couplers are described in patents described in above-mentioned Research Disclosure No. 17643, VII-C to VII-G and No. 307105, VII-C to VII-G.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler, which can be used together with the couplers of the present invention and except for the couplers of the present invention, are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,565,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. In addition, it is also possible to use pyrazoloazole couplers described in JP-A-64-553, JP-A-64-554, JP-A-64-555, and JP-A-64-556 or an imidazole coupler described in U.S. Pat. No. 4,818,672.

Typical examples of a polymerized dye-forming coupler are described in U.S. Pat. Nos. 3,451,820, 4,080,221, 4,367,288, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Bleaching accelerator releasing couplers described in, e.g., RD Nos. 11449 and 24241 and JP-A-61-201247 can be effectively used to reduce a time required for a treatment having a bleaching function. This effect is notable especially when the coupler is added to a light-sensitive material using the tabular silver halide grains described above. Preferable examples of a coupler for imagewise releasing a nucleating agent or a development accelerator are described in British Patents 2,097,140 and 2,131,188, JP-A-59-157638, and JP-A-59-170840. It is also preferable to use compounds described in JP-A-60-107029, JP-A-60-252340, JP-A-1-44940, and JP-A-1-45687, which release, e.g., a fogging agent, a development accelerator, or a silver halide solvent upon a redox reaction with an oxidized form of a developing agent.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a ligand releasing coupler described in, e.g., U.S. Pat. No. 4,553,477; a coupler which releases a leuco dye described in JP-A-63-75747; and a coupler which releases a fluorescent dye described in U.S. Pat. No. 4,774,181.

The couplers for use in this invention can be added to the light-sensitive material by various known dispersion methods.

Examples of a high-boiling organic solvent to be used in the oil-in-water dispersion method are described in, e.g., U.S. Pat. No. 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl)phthalate, bis(2,4-di-t-amylphenyl)isophthalate, and bis(1,1-diethylpropyl)phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearylalcohol and 2,4-di-tert-amylphenol), aliphatic carboxylates (e.g., bis(2-ethylhexyl)sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a co-solvent. Typical examples of the co-solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and West German Patent Application (OLS) Nos. 2,541,274 and 2,541,230.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, 2-phenoxyethanol, and 2-(4-thiazolyl)benzimidazole described in JP-A-63-257747, JP-A-62-272248, and JP-A-1-80941.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers on the side having emulsion layers is 28 μm or less, preferably 23 μm or less, more preferably 18 μm or less, and most preferably 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in this field of art. For example, the film swell speed $T_{\frac{1}{2}}$ can be measured by using a swell meter described in Photogr. Sci Eng., A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness−film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

A color developer used in development of the light-sensitive material of the present invention is preferably an aqueous alkaline solution containing an aromatic primary amine-based color developing agent as a main component. Although an aminophenol-based compound is effective as this color developing agent, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylani line, 3-methyl-4-amino-N-ethyl-β-methoxyethylaniline, and their sulfates, hydrochlorides and p-toluenesulfonates. Of these compounds, it is more preferable to use 3-methyl-4-amino-N-ethyl-N-β-hydroxyethylaniline sulfate. These compounds can be used in a combination of two or more thereof according to the intended use.

In general, the color developer contains a pH buffering agent such as a carbonate, a borate, or a phosphate of an alkali metal, and a development inhibitor or an antifoggant such as a bromide, an iodide, a benzimidazole, a benzothiazole, or a mercapto compound. If necessary, the color developer may also contain a preservative such as hydroxylamine, diethylhydroxylamine, a hydrazine sulfite, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; a fogging agent such as sodium boron hydride; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

Processing solutions except for the color developer and processing steps of the color reversal light-sensitive material of the present invention will be described below.

Of the processing steps of the color reversal light-sensitive material of the present invention, those from B/W development to color development are as follows.

1) B/W development - washing - reversal - color development
2) B/W development - washing - photo-reversal - color development
3) B/W development - washing - color development The washing in any of the processes 1) to 3) can be replaced with rinsing described in U.S. Pat. No. 4,804,616 in order to simplify the process and reduce the quantity of a waste liquor.

Steps after the color development will be described.

4) Color development - control - bleaching - fixing - washing - stabilization
5) Color development - washing - bleaching - fixing - washing - stabilization
6) Color development - control - bleaching - washing - fixing - washing - stabilization
7) Color development - washing - bleaching - washing - fixing - washing - stabilization
8) Color development - bleaching - fixing - washing - stabilization
9) Color development - bleaching - bleach-fixing - washing - stabilization
10) Color development - bleaching - bleach-fixing - fixing - washing - stabilization
11) Color development - bleaching - washing - fixing - washing - stabilization
12) Color development - control - bleach-fixing - washing - stabilization
13) Color development - washing - bleach-fixing - washing - stabilization
14) Color development - bleach-fixing - washing - stabilization
15) Color development - fixing - bleach-fixing - washing - stabilization In the processes 4) to 15), the washing immediately before the stabilization can be omitted, and the last stabilization step need not be performed. One of the processes 1) to 3) and one of the processes 4) to 15) combine together to form a color reversal process.

Processing solutions used in the color reversal process of the present invention will be described below.

As a B/W developing solution for use in the present invention, it is possible to use developing agents known to those skilled in the art. Examples of the developing agent are dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and a heterocyclic compound described in U.S. Pat. No. 4,067,872, in which a 1,2,3,4-tetrahydroquinoline ring and an indolene ring are condensed. These developing agents can be used singly or in a combination of two or more types of them.

The B/W developing solution for use in the present invention can contain, if necessary, a preservative (e.g., sulfite or bisulfite), a buffering agent (e.g., carbonate, boric acid, borate, or alkanolamine), an alkaline agent (e.g., hydroxide or carbonate), a soluble tablet (e.g., polyethyleneglycols or their esters), a pH control agent (e.g., an organic acid such as acetic acid), a sensitizer (e.g., quaternary ammonium salt), a development accelerator, a surfactant, an anti-foaming agent, a film hardener, and a viscosity imparting agent.

It is necessary to add a compound acting as a silver halide solvent to the B/W developing solution used in the present invention. In general, however, sulfite to be added as the preservative described above plays this role as a solvent. Examples of sulfite and other usable silver halide solvents are KSCN, NaSCN, $K_2SO_3$, $Na_2SO_3$, $K_2S_2O_5$, $Na_2S_2O$, $K_2S_2O_3$, and $Na_2S_2O_3$.

Although the pH of a developing solution thus prepared is so selected as to yield desired density and contrast, it falls within the range of about 8.5 to about 11.5.

To perform sensitization using such a B/W developing solution, a processing time is prolonged a maximum of about three times that of standard processing. In this case, raising the processing temperature can shorten the time prolonged for sensitization.

The pH of the color and black-and-white developers is generally 9 to 12. Although the quantity of a replenisher of these developers depends on a color photographic light-sensitive material to be processed, it is generally 3 liters or less per $m^2$ of the light-sensitive material. The quantity of a replenisher can be decreased to be 500 ml or less by decreasing a bromide ion concentration in the replenisher. When the quantity of a replenisher is to be decreased, a contact area of a processing tank with air is preferably decreased to prevent evaporation and oxidation of the replenisher.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A reversal bath used after the B/W development can contain a known fogging agent. Examples of the fogging agent are stannous ion complex salts, such as stannous ion-organic phosphoric acid complex salt (U.S. Pat. No. 3,617,282), stannous ion organic phosphonocarboxylic acid complex salt (JP-B-56-32616), and stannous ionaminopolycarboxylic acid complex salt (U.S. Pat. No. 1,209,050), and boron compounds, such as a boron hydride compound (U.S. Pat. No. 2,984,567) and a heterocyclic amineborane compound (British Patent 1,011,000). The pH of this fogging bath (reversal bath) covers a wide range from acidic to alkaline sides. The pH is 2 to 12, preferably 2.5 to 10, and most preferably 3 to 9. Photoreversal using re-exposure may be performed instead of the reversal bath. Alternatively, the reversal step itself may be omitted by adding the above fogging agent to the color developing solution.

The silver halide color photographic light-sensitive material of the present invention is subjected to bleaching or bleach-fixing after the color development. These processes may be performed immediately after the color development without performing any other processing. Alternatively, in order to prevent unnecessary post-development or aerial fog and reduce a carry-over of the color developing solution to a desilvering step or to wash out or make harmless the color developing agent impregnated in light-sensitive portions, such as sensitizing dyes or dyes contained in the photographic light-sensitive material, and impregnated in the photographic light-sensitive material, the light-sensitive material may be subjected to, e.g., stopping, control, and washing, after the color development before it is subjected to the bleaching or the bleach-fixing.

The photographic emulsion layer is generally subjected to bleaching after color development. The bleaching may be performed either simultaneously with fixing (bleach-fixing) or independently of it In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, according to the intended use. Examples of the bleaching agent are a compound of a multivalent metal such as iron(III); peroxides; quinones; and a nitro compound. Typical examples of the bleaching agent are organic complex salts of iron(III), e.g., complex salts of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; and complex salts of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent environmental contaminations. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfido group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-104232, JP-A-53-124424, and JP-A-53-141623, and JP-A-53-28426, and Research Disclosure No. 17,129 (July, 1978); a thiazolidine derivative described in JP-A-50-140129; iodide salts described in JP-B-45-8506, JP-A-52-20832, JP-A-53-32735, U.S. Pat. No. 3,706,561, and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfido group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are effective especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, for example, acetic acid, propionic acid, or hydroxyacetic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution. The total time of a desilvering step is preferably as short as possible provided that no desilvering defect occurs. A preferable time is one to three minutes, and more preferably, one to two minutes. The processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce a carry-over of a processing solution from a pre-bath to a post-bath, thereby effectively preventing degradation in performance of the processing solution. This effect significantly shortens especially a processing time in each processing step and reduces the quantity of a replenisher for each processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the intended use of the material, the temperature of the water, the number of water tanks (the number of stages), a replenishing scheme such as a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248-253 (May, 1955). According to the above-described multistage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

The pH of the water for washing the photographic light-sensitive material of the present invention is 4 to 9, and preferably, 5 to 8. The water temperature and the washing time can vary in accordance with the properties and the intended use of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilization is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. Various chelating agents or antifungal agents can also be added to this stabilizing bath.

An overflow solution produced upon washing and/or replenishment of the stabilizing solution can be resued in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and a urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

EXAMPLES The present invention will be described in more detail below by way of its examples, but the present invention is not limited to these examples.

EXAMPLE 1

Manufacture of Sample 101

A multilayered color light-sensitive material constituted by layers having the following compositions on a subbed cellulose triacetate film support having a thickness of 127 μm was formed, thereby preparing a sample 101. Numbers represent addition amounts per $m^2$. Note that the effects of the added compounds are not limited to those described below. 1st layer:

| Antihalation layer | |
|---|---|
| Black colloidal silver | 0.20 g |
| Gelatin | 1.9 g |
| Ultraviolet absorbent U-1 | 0.1 g |
| Ultraviolet absorbent U-3 | 0.04 g |

-continued

| | |
|---|---|
| Ultraviolet absorbent U-4 | 0.1 g |
| High-boiling organic solvent Oil-1 | 0.1 g |
| Fine crystal solid dispersion of dye E-1 | 0.1 g |
| 2nd layer: Interlayer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| 3rd layer: Interlayer | |
| Fine grain silver bromoiodide emulsion fogged both on surface and in interior (average grain size = 0.06 μm, variation coefficient = 18%, and AgI content = 1 mol %) silver | 0.05 g |
| Gelatin | 0.4 g |
| 4th layer: Low-speed red-sensitive emulsion layer | |
| Emulsion A silver | 0.1 g |
| Emulsion B silver | 0.4 g |
| Gelatin | 0.8 g |
| Coupler C-1 | 0.15 g |
| Coupler C-2 | 0.05 g |
| Coupler C-3 | 0.05 g |
| Coupler C-8 | 0.05 g |
| Compound Cpd-C | 10 mg |
| High-boiling organic solvent Oil-2 | 0.1 g |
| Additive P-1 | 0.1 g |
| 5th layer: Medium-speed red-sensitive emulsion layer | |
| Emulsion B silver | 0.2 g |
| Emulsion C silver | 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| 6th layer: High-speed red-sensitive emulsion layer | |
| Emulsion D silver | 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| 7th layer: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| 8th layer: Interlayer | |
| Silver bromoiodide emulsion fogged both on surface and in interior (average grain size = 0.06 μm, variation coefficient = 16%, and AgI content = 0.3 mol %) silver | 0.02 g |
| Gelatin | 1.0 g |
| Additive P-1 | 0.2 g |
| Color-mixing inhibitor Cpd-A | 0.1 g |
| 9th layer: Low-speed green-sensitive emulsion layer | |
| Emulsion E silver | 0.1 g |
| Emulsion F silver | 0.3 g |
| Emulsion G silver | 0.3 g |
| Gelatin | 0.5 g |
| Coupler C-4 | 0.2 g |
| Coupler C-7 | 0.4 g |
| Compound Cpd-B | 0.03 g |
| Compound Cpd-C | 10 mg |
| Compound Cpd-D | 0.02 g |
| Compound Cpd-E | 0.02 g |
| Compound Cpd-F | 0.02 g |
| Compound Cpd-G | 0.02 g |
| High-boiling organic solvent Oil-1 | 0.1 g |
| High-boiling organic solvent Oil-2 | 0.1 g |
| 10th layer: High-speed green-sensitive emulsion layer | |

-continued

| | |
|---|---|
| Emulsion H silver | 0.4 g |
| Emulsion I silver | 0.5 g |
| Gelatin | 1.0 g |
| Coupler C-4 | 0.4 g |
| Coupler C-7 | 0.35 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| 11th layer: Interlayer | |
| Gelatin | 0.6 g |
| 12th layer: Yellow filter layer | |
| Yellow colloidal silver silver | 0.07 g |
| Gelatin | 1.1 g |
| Color-mixing inhibitor Cpd-A | 0.01 g |
| High-boiling organic solvent Oil-1 | 0.01 g |
| Fine crystal solid dispersion of dye E-2 | 0.05 g |
| 13th layer: Interlayer | |
| Gelatin | 0.6 g |
| 14th layer: Low-speed blue-sensitive emulsion layer | |
| Emulsion J silver | 0.2 g |
| Emulsion K silver | 0.3 g |
| Emulsion L silver | 0.1 g |
| Gelatin | 0.8 g |
| Coupler C-5 | 0.2 g |
| Coupler C-6 | 0.1 g |
| Coupler C-9 | 0.4 g |
| 15th layer: Medium-speed blue-sensitive emulsion layer | |
| Emulsion L silver | 0.1 g |
| Emulsion M silver | 0.4 g |
| Gelatin | 0.9 g |
| Coupler C-5 | 0.3 g |
| Coupler C-6 | 0.1 g |
| Coupler C-9 | 0.1 g |
| 16th layer: High-speed blue-sensitive emulsion layer | |
| Emulsion N silver | 0.4 g |
| Gelatin | 1.2 g |
| Coupler C-5 | 0.3 g |
| Coupler C-6 | 0.6 g |
| Coupler C-9 | 0.1 g |
| 17th layer: 1st protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Formalin scavenger Cpd-H | 0.4 g |
| Dye D-1 | 0.1 g |
| Dye D-2 | 0.05 g |
| Dye D-3 | 0.1 g |
| 18th layer: 2nd protective layer | |
| Colloidal silver silver | 0.1 mg |
| Fine grain silver bromoiodide emulsion (average grain size = 0.06 μm and AgI content = 1 mol %) silver | 0.1 g |
| Gelatin | 0.4 g |
| 19th layer: 3rd protective layer | |
| Gelatin | 0.4 g |
| Polymethylmethacrylate (average grain size = 1.5 μm) | 0.1 g |
| 4:6 copolymer of methylmethacrylate and acrylic acid (average grain size = 1.5 μm) | 0.1 g |
| Silicone oil | 0.03 g |
| Surfactant W-1 | 3.0 mg |

In addition to the above compositions, additives F-1 to F-8 were added to all the emulsion layers. The layers were also added with a gelatin hardener H-1 and surfactants W-2, W-3, and W-4 for coating and emulsification.

In addition, phenol, 1,2-benzisothiazoline-3-one, 2-phenoxyethanol, phenethylalcohol, and p-benzoic butylester were added as antiseptic and mildewproofing agents.

C-1
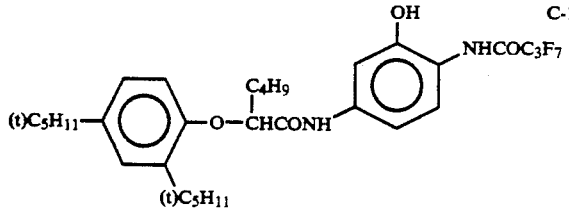
C-2
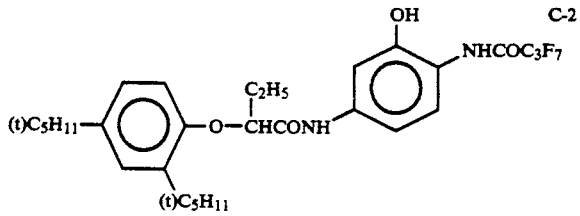
C-3
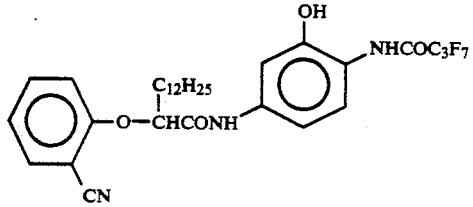
C-4
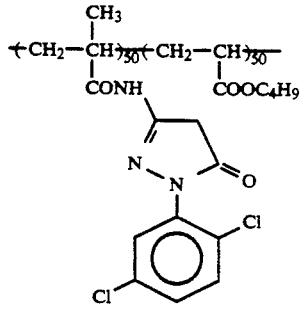
x:y = 50:50 (wt %)
mean molecular weight: about 25,000
C-5
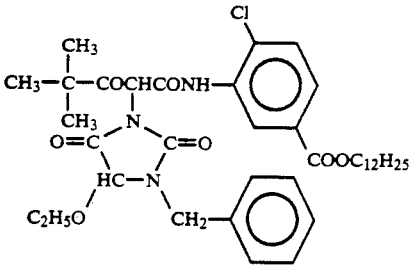
C-6
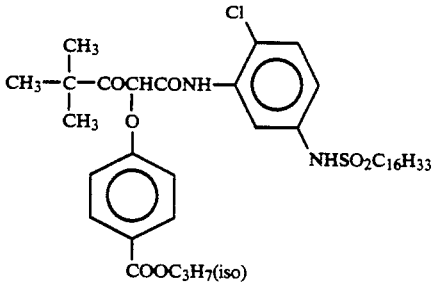
C-7
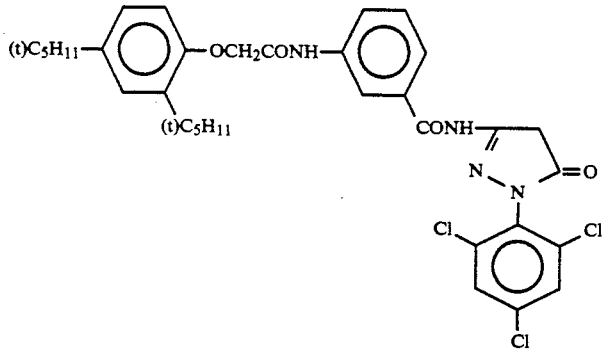
C-8
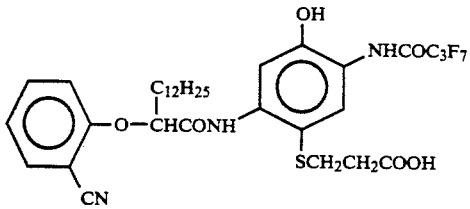
C-9
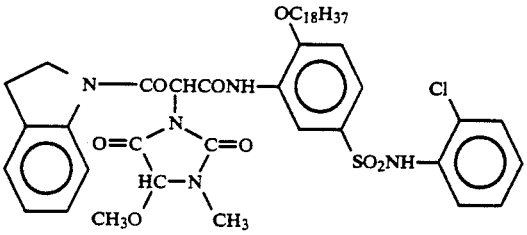
dibutyl phtalate Oil-1
tricresyl phosphate Oil-2
Oil-3
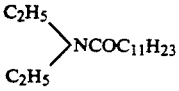
Cpd-A
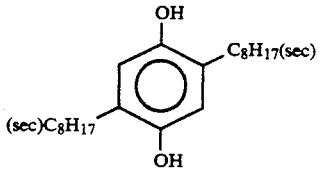

-continued
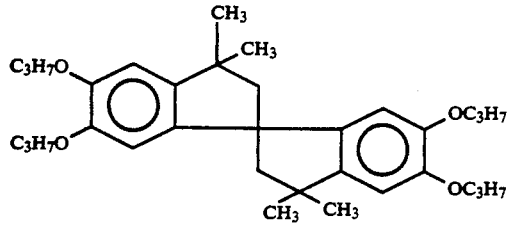
Cpd-B
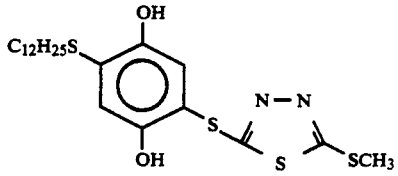
Cpd-C
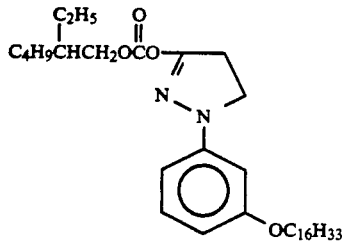
Cpd-D
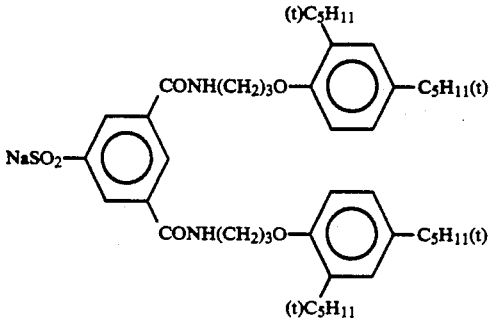
Cpd-E
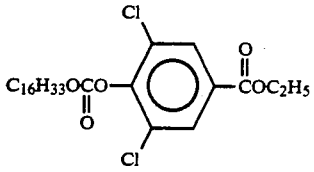
Cpd-F
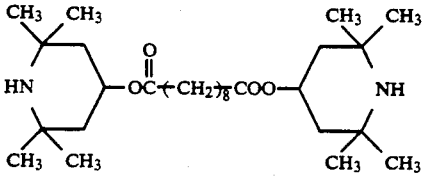
Cpd-G
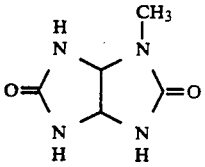
Cpd-H
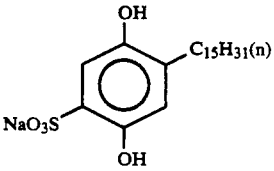
Cpd-I
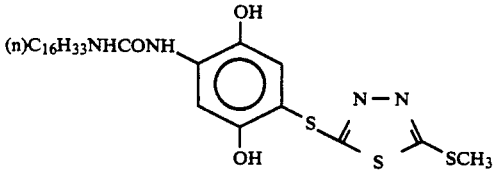
Cpd-J
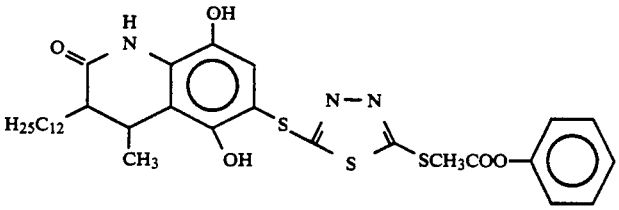
Cpd-K
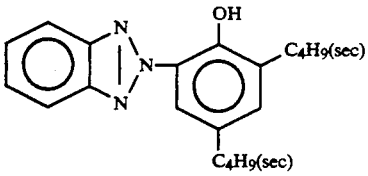
U-1
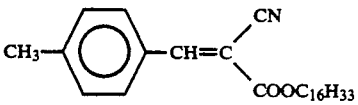
U-2

-continued
U-3
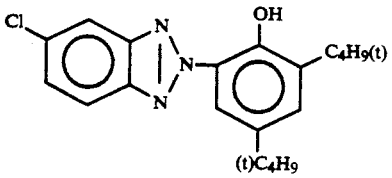
U-4
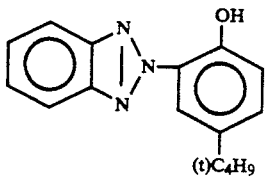
U-5
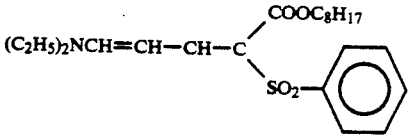
S-1
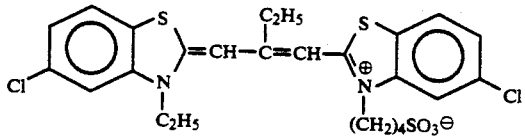
S-2
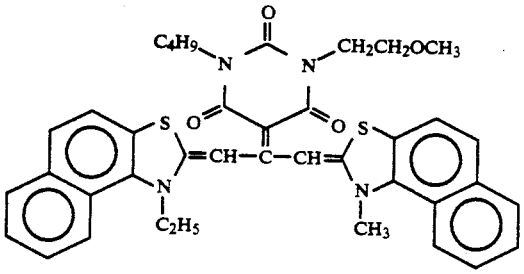
S-3
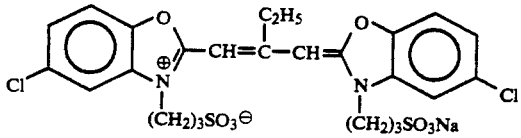
S-4
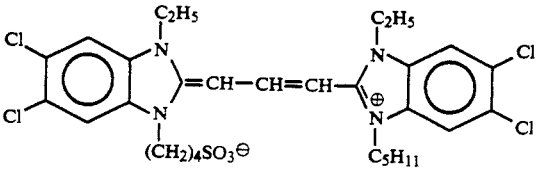
S-5
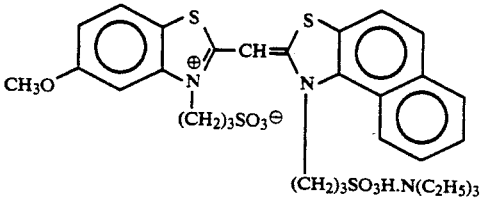
S-6
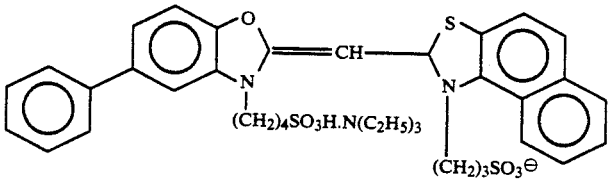
S-7
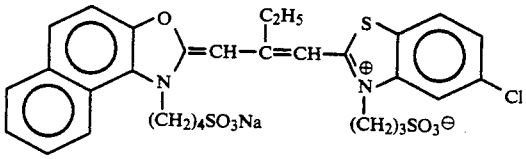
S-8
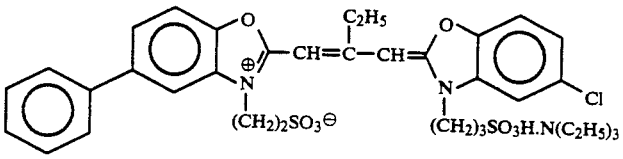
D-1
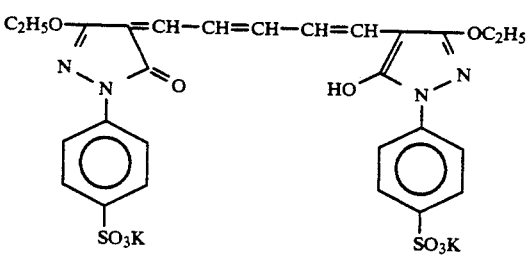
D-2
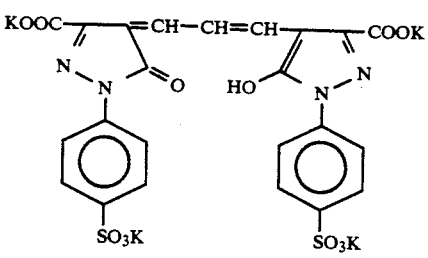

-continued
D-3
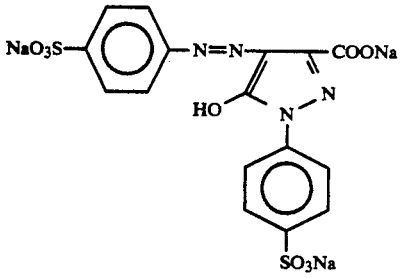
D-4
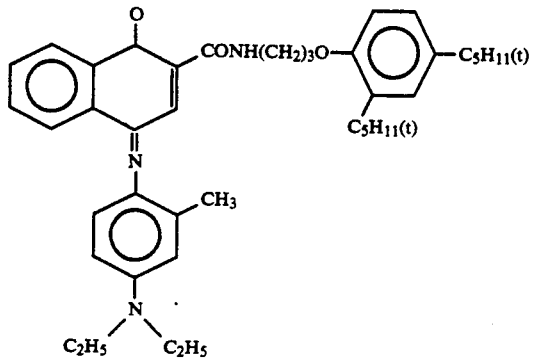
E-1
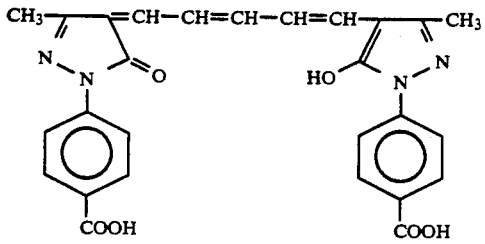
E-2
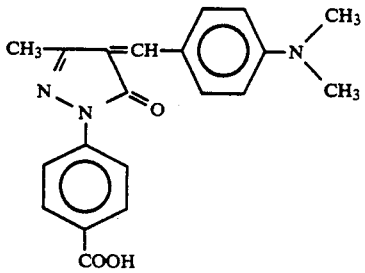
H-1
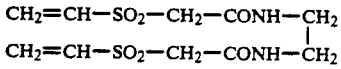
W-1
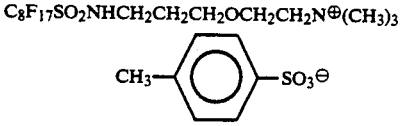
W-2
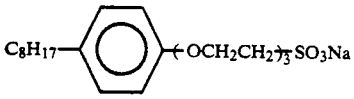
W-3
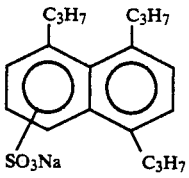
W-4
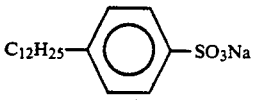
P-1
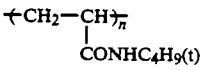
M-1
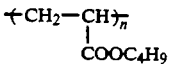
F-1
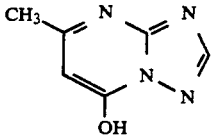
F-2
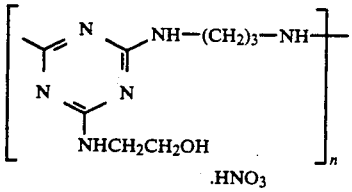
F-3
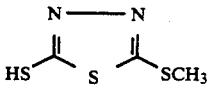

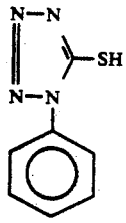

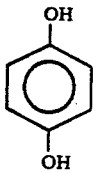

-continued

F-4

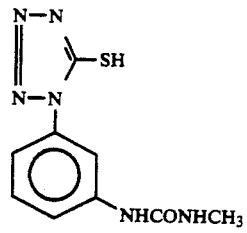

F-5

F-6

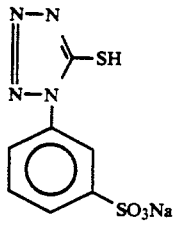

F-7

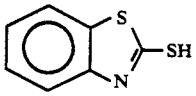

F-8

TABLE 1

Silver bromoiodide emulsions used in the sample 101 (Example 1) and 201 (Example 2) were as follows.

| Emulsion name | Characteristics of grains | Average grain size as sphere (μm) | Variation coefficient (%) | AgI content (%) |
|---|---|---|---|---|
| A | Monodisperse tetradecahedral grain | 0.28 | 16 | 3.7 |
| B | Monodisperse cubic internal internal latent image type grain | 0.30 | 10 | 3.3 |
| C | Monodisperse tabular grain average aspect ratio = 4.0 | 0.38 | 18 | 5.0 |
| D | Tabular grain average aspect ratio = 8.0 | 0.68 | 25 | 2.0 |
| E | Monodisperse cubic grain | 0.20 | 17 | 4.0 |
| F | Monodisperse cubic grain | 0.23 | 16 | 4.0 |
| G | Monodisperse cubic internal latent image type grain | 0.28 | 11 | 3.5 |
| H | Monodisperse cubic internal latent image type grain | 0.32 | 9 | 3.5 |
| I | Tabular grain average aspect ratio = 9.0 | 0.80 | 28 | 1.5 |
| J | Monodisperse tetradecahedral grain | 0.30 | 18 | 4.0 |
| K | Monodisperse tabular grain average aspect ratio = 7.0 | 0.45 | 17 | 4.0 |
| L | Monodisperse cubic internal latent image type grain | 0.46 | 14 | 3.5 |
| M | Monodisperse tabular grain average aspect ratio = 10.0 | 0.55 | 13 | 4.0 |
| N | Tabular grain average aspect ratio = 12.0 | 1.00 | 33 | 1.3 |

TABLE 2

Spectral sensitization of emulsions A to N

| Emulsion name | Added sensitization dye | Addition amount (g) per 1 mol of silver halide |
|---|---|---|
| A | S-1 | 0.025 |
| | S-2 | 0.25 |
| | S-7 | 0.01 |
| B | S-1 | 0.01 |
| | S-2 | 0.25 |
| | S-7 | 0.01 |
| C | S-1 | 0.02 |
| | S-2 | 0.25 |

TABLE 2-continued

Spectral sensitization of emulsions A to N

| Emulsion name | Added sensitization dye | Addition amount (g) per 1 mol of silver halide |
|---|---|---|
| | S-7 | 0.01 |
| D | S-1 | 0.01 |
| | S-2 | 0.10 |
| | S-7 | 0.01 |
| E | S-3 | 0.5 |
| | S-4 | 0.1 |
| F | S-3 | 0.3 |
| | S-4 | 0.1 |
| G | S-3 | 0.25 |
| | S-4 | 0.08 |
| | S-8 | 0.05 |
| H | S-3 | 0.2 |
| | S-4 | 0.06 |
| | S-8 | 0.05 |
| I | S-3 | 0.3 |
| | S-4 | 0.07 |
| | S-8 | 0.1 |
| J | S-6 | 0.2 |
| | S-5 | 0.05 |

TABLE 3

Spectral sensitization of emulsion K to N

| Emulsion name | Added sensitization dye | Addition amount (g) per 1 mol of silver halide |
|---|---|---|
| K | S-6 | 0.2 |
| | S-5 | 0.05 |
| L | S-6 | 0.22 |
| | S-5 | 0.06 |
| M | S-6 | 0.15 |
| | S-5 | 0.04 |
| N | S-6 | 0.22 |
| | S-5 | 0.06 |

Preparing of Samples 102–119

Samples 102 to 119 were prepared following the same procedures as for the sample 101 except that the couplers C-7 and C-4 added to the ninth and tenth layers of the sample 101 were replaced with couplers as listed in Table 4 in amounts of 0.6 times the total number of moles so as to obtain substantially equal maximum densities.

TABLE 4

| Sample No. | Coupler of 9th layer | Coupler of 10th layer | RMS graininess D = 0.5 | RMS graininess D = 2.0 | Red reproducibility |
|---|---|---|---|---|---|
| 101 (Comparative example) | C-4/C-7 | C-4/C-7 | 0.008 | 0.012 | control |
| 102 (Comparative example) | M-7 | C-4/C-7 | 0.009 | 0.014 | ○ |
| 103 (Comparative example) | M-48 | C-4/C-7 | 0.009 | 0.013 | ○ |
| 104 (Comparative example) | M-71 | C-4/C-7 | 0.010 | 0.012 | ○ |
| 105 (Comparative example) | M-7 | M-7 | 0.011 | 0.017 | ◎ |
| 106 (Comparative example) | M-48 | M-71 | 0.012 | 0.017 | ◎ |
| 107 (Comparative example) | M-71 | M-48 | 0.013 | 0.016 | ◎ |
| 108 (Present invention) | M-7 | N-7 | 0.008 | 0.012 | ◎ |
| 109 (Present invention) | M-48 | N-71 | 0.007 | 0.011 | ◎ |
| 110 (Present invention) | M-71 | N-48 | 0.008 | 0.011 | ◎ |
| 111 (Comparative example) | N-7 | M-7 | 0.007 | 0.018 | ◎ |
| 112 (Comparative example) | N-48 | M-71 | 0.007 | 0.019 | ◎ |
| 113 (Comparative example) | N-71 | M-48 | 0.007 | 0.019 | ◎ |
| 114 (Present Invention) | M-8 | N-8 | 0.008 | 0.011 | ◎ |
| 115 (Present Invention) | M-26 | N-26 | 0.006 | 0.013 | ◎ |
| 116 (Present Invention) | M-39 | N-39 | 0.008 | 0.011 | ◎ |
| 117 (Present Invention) | M-49 | N-49 | 0.007 | 0.012 | ◎ |
| 118 (Present Invention) | M-58 | N-58 | 0.007 | 0.012 | ◎ |
| 119 (Present Invention) | M-62 | N-62 | 0.007 | 0.013 | ◎ |

The samples 101 to 119 thus prepared were cut into strips and exposed through an optical wedge in order to measure RMS graininess. The processing was performed in accordance with the following processing steps. Each processed sample was measured by a microdensitometer at an aperture diameter of 48 μm to obtain the RMS graininess. Values measured at two points at a density of 0.5 and 2.0 are listed as the RMS. In practice, the values at both the low and high densities must be improved.

The samples 101 to 119 were formed into 35-mm wide cartridges and subjected to actual photography. As objects to be photographed, a color checker available from Macbeth Co. and a set which is suitable for evaluating red reproducibility were used. The photographed samples were subjected to organoleptic evaluation performed by a plurality of evaluators.

The results are summarized in Table 4. The red reproducibility having a red saturation higher than the control is represented by two-step evaluation. As is apparent from Table 4, the combinations of the present invention are superior to conventional combinations in graininess. Also, the combinations of the present invention have higher saturations in red reproducibility than those using pyrazolone couplers other than the couplers of the present invention.

This cannot be predicted from the conventional techniques but can be achieved by only the combinations of the present invention.

| Step | Time | Temperature | Tank volume | Quantity of replenisher |
|---|---|---|---|---|
| 1st development | 6 min. | 38° C. | 12 l | 2,200 ml/m² |
| 1st washing | 2 min. | 38° C. | 4 l | 7,500 ml/m² |
| Reversal | 2 min. | 38° C. | 4 l | 1,100 ml/m² |
| Color development | 6 min. | 38° C. | 12 l | 2,200 ml/m² |
| Control | 2 min. | 38° C. | 4 l | 1,100 ml/m² |
| Bleaching | 6 min. | 38° C. | 12 l | 220 ml/m² |
| Fixing | 4 min. | 38° C. | 8 l | 1,100 ml/m² |
| 2nd washing | 4 min. | 38° C. | 8 l | 7,500 ml/m² |
| Stabilization | 1 min. | 25° C. | 2 l | 1,100 ml/m² |

The compositions of the processing solutions were as follows.

| (1st developing solution) | (Tank solution) | (Replenisher) |
|---|---|---|
| Nitrilo-N,N,N-trimethylenephosphonic acid pentasodium salt | 1.5 g | 1.5 g |
| Diethylenetriaminepentaacetic acidypentasodium salt | 2.0 g | 2.0 g |
| Sodium sulfite | 30 g | 30 g |
| Hydroquinoneypotassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 ml | 1,000 ml |
| pH | 9.60 | 9.60 |

The pH was controlled by hydrochloric acid or potassium hydroxide.

| (Reversal solution) | (Tank solution) | (Replenisher) |
|---|---|---|
| Nitrilo-N,N,N-trimethylenephosphonic acid pentasodium salt | 3.0 g | the same as tank solution |
| Stannous chlorideydihydrate | 1.0 g | |
| p-aminophenol | 0.1 g | |
| Sodium hydroxide | 8 g | |
| Glacial acetic acid | 15 ml | |
| Water to make | 1,000 ml | |
| pH | 6.0 | |

The pH was controlled by hydrochloric acid or sodium hydroxide.

| (Color developing solution) | (Tank solution) | (Replenisher) |
|---|---|---|
| Nitrilo-N,N,N-trimethylenephosphonic acid pentasodium salt | 2.0 g | 2.0 g |
| Sodium sulfite | 7.0 g | 7.0 g |
| Trisodium phosphateydodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4-aminoaniline 3/2 sulfuric acidymonohydrate | 11 g | 11 g |
| 3,6-dithiaoctane-1,8-diol | 1.0 g | 1.0 g |

-continued

| (Color developing solution) | (Tank solution) | (Replenisher) |
|---|---|---|
| Water to make | 1,000 ml | 1,000 ml |
| pH | 11.80 | 12.00 |

The pH was controlled by hydrochloric acid or potassium hydroxide.

| (Control solution) | (Tank solution) | (Replenisher) |
|---|---|---|
| Ethylenediaminetetraacetic acid disodium salt dihydrate | 8.0 g | 8.0 g |
| Sodium sulfite | 12 g | 12 g |
| 1-thioglycerol | 0.4 g | 0.4 g |
| Formaldehyde sodium bisulfite adduct | 30 g | 35 g |
| Water to make | 1,000 ml | 1,000 ml |
| pH | 6.3 | 6.10 |

The pH was controlled by hydrochloric acid or sodium hydroxide.

| (Bleaching solution) | (Tank solution) | (Replenisher) |
|---|---|---|
| Ethylenediaminetetraacetic acid disodium salt dihydrate | 2.0 g | 4.0 g |
| Ethylenediaminetetraacetic acid Fe(III) ammoniumy dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

The pH was controlled by hydrochloric acid or sodium hydroxide.

| (Fixing solution) | (Tank solution) | (Replenisher) |
|---|---|---|
| Ammonium thiosulfate | 80 g | the same as tank solution |
| Sodium sulfite | 5.0 g | |
| Sodium bisulfite | 5.0 g | |
| Water to make | 1,000 ml | |
| pH | 6.60 | |

The pH was controlled by hydrochloric acid or ammonia water.

| (Stabilizing solution) | |
|---|---|
| Benzoisothiazoline-3-one | 0.02 g |
| Polyoxyethylene-p-monononylphenylether (average polymerization degree = 10) | 0.3 g |
| Water to make | 1,000 ml |
| pH | 7.0 |

As described above, the combinations of the compounds (M) and (N) of the present invention made it possible to obtain color photographic light-sensitive materials excellent in graininess and color reproducibility.

EXAMPLE 2

Manufacture of Sample 201

A multilayered color light-sensitive material constituted by layers having the following compositions on a subbed cellulose triacetate film support having a thickness of 127 μm was formed, thereby preparing a sample 201. Numbers represent addition amounts per m2 Note that the effects of the added compounds are not limited to those described below.

| | |
|---|---|
| 1st layer: Antihalation layer | |
| Black colloidal silver | 0.20 g |
| Gelatin | 1.9 g |
| Ultraviolet absorbent U-1 | 0.1 g |
| Ultraviolet absorbent U-3 | 0.04 g |
| Ultraviolet absorbent U-4 | 0.1 g |
| High-boiling organic solvent Oil-1 | 0.1 g |
| Fine crystal solid dispersion of dye E-1 | 0.1 g |
| 2nd layer: Interlayer | |
| Gelatin | 0.40 g |
| Compound Cpd-C | 5 mg |
| Compound Cpd-J | 5 mg |
| Compound Cpd-K | 3 mg |
| High-boiling organic solvent Oil-3 | 0.1 g |
| Dye D-4 | 0.4 mg |
| 3rd layer: Interlayer | |
| Fine grain silver bromoiodide emulsion fogged both on surface and in interior (average grain size = 0.06 μm, variation coefficient = 18%, and AgI content = 1 mol %) silver | 0.05 g |
| Gelatin | 0.4 g |
| 4th layer: Low-speed red-sensitive emulsion layer | |
| Emulsion A silver | 0.1 g |
| Emulsion B silver | 0.4 g |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 10 mg |
| High-boiling organic solvent Oil-2 | 0.1 g |
| Additive P-1 | 0.1 g |
| 5th layer: Medium-speed red-sensitive emulsion layer | |
| Emulsion B silver | 0.2 g |
| Emulsion C silver | 0.3 g |
| Gelatin | 0.8 g |
| Coupler C-1 | 0.2 g |
| Coupler C-2 | 0.05 g |
| Coupler C-3 | 0.2 g |
| High-boiling organic solvent Oil-2 | 0.1 g |
| Additive P-1 | 0.1 g |
| 6th layer: High-speed red-sensitive emulsion layer | |
| Emulsion D silver | 0.4 g |
| Gelatin | 1.1 g |
| Coupler C-1 | 0.3 g |
| Coupler C-2 | 0.1 g |
| Coupler C-3 | 0.7 g |
| Additive P-1 | 0.1 g |
| 7th layer: Interlayer | |
| Gelatin | 0.6 g |
| Additive M-1 | 0.3 g |
| Color-mixing inhibitor Cpd-I | 2.6 mg |
| Ultraviolet absorbent U-1 | 0.01 g |
| Ultraviolet absorbent U-2 | 0.002 g |
| Ultraviolet absorbent U-5 | 0.01 g |
| Dye D-1 | 0.02 g |
| Compound Cpd-C | 5 mg |
| Compound Cpd-J | 5 mg |
| Compound Cpd-K | 5 mg |
| High-boiling organic solvent Oil-1 | 0.02 g |
| 8th layer: Interlayer | |
| Silver bromoiodide emulsion fogged both on surface and in interior (average grain size = 0.06 μm, variation coefficient = 16%, and AgI content = 0.3 mol %) silver | 0.02 g |
| Gelatin | 1.0 g |
| Additive P-1 | 0.1 g |
| Color-mixing inhibitor Cpd-A | 0.1 g |
| Color-mixing inhibitor Cpd-L | 0.1 g |
| 9th layer: Low-speed green-sensitive emulsion layer | |
| Emulsion E silver | 0.1 g |
| Emulsion F silver | 0.2 g |
| Emulsion G silver | 0.2 g |
| Gelatin | 0.5 g |
| Coupler C-7 | 0.30 g |
| Compound Cpd-B | 0.03 g |
| Compound Cpd-C | 10 mg |

-continued

| | |
|---|---|
| Compound Cpd-D | 0.02 g |
| Compound Cpd-E | 0.02 g |
| Compound Cpd-F | 0.02 g |
| Compound Cpd-G | 0.02 g |
| Compound Cpd-M | 1 mg |
| High-boiling organic solvent Oil-1 | 0.1 g |
| High-boiling organic solvent Oil-2 | 0.1 g |
| High-boiling organic solvent Oil-4 | 0.1 g |
| 10th layer: Medium-speed green-sensitive emulsion layer | |
| Emulsion G silver | 0.3 g |
| Emulsion H silver | 0.1 g |
| Gelatin | 0.6 g |
| Coupler C-4 | 0.4 g |
| Compound Cpd-B | 0.03 g |
| Compound Cpd-D | 0.02 g |
| Compound Cpd-E | 0.02 g |
| Compound Cpd-F | 0.05 g |
| Compound Cpd-G | 0.05 g |
| Compound Cpd-M | 0.001 g |
| High-boiling organic solvent Oil-2 | 0.01 g |
| 11th layer: High-speed green-sensitive emulsion layer | |
| Emulsion I silver | 0.5 g |
| Gelatin | 1.0 g |
| Coupler C-4 | 0.5 g |
| Compound Cpd-B | 0.08 g |
| Compound Cpd-C | 5 mg |
| Compound Cpd-D | 0.02 g |
| Compound Cpd-E | 0.02 g |
| Compound Cpd-F | 0.02 g |
| Compound Cpd-G | 0.02 g |
| Compound Cpd-J | 5 mg |
| Compound Cpd-K | 5 mg |
| High-boiling organic solvent Oil-1 | 0.02 g |
| High-boiling organic solvent Oil-2 | 0.02 g |
| High-boiling organic solvent Oil-4 | 0.02 g |
| 12th layer: Interlayer | |
| Gelatin | 0.6 g |
| 13th layer: Yellow filter layer | |
| Yellow colloidal silver silver | 0.07 g |
| Gelatin | 1.1 g |
| Color-mixing inhibitor Cpd-A | 5 mg |
| Color-mixing inhibitor Cpd-L | 5 mg |
| High-boiling organic solvent Oil-1 | 0.01 g |
| Fine crystal solid dispersion of Dye E-2 | 0.05 g |
| 14th layer: Interlayer | |
| Gelatin | 0.6 g |
| 15th layer: Low-speed blue-sensitive emulsion layer | |
| Emulsion J silver | 0.2 g |
| Emulsion K silver | 0.3 g |
| Emulsion L silver | 0.1 g |
| Gelatin | 0.8 g |

-continued

| | |
|---|---|
| Coupler C-5 | 0.2 g |
| Coupler C-6 | 0.1 g |
| Coupler C-10 | 0.4 g |
| 16th layer: Medium-speed blue-sensitive emulsion layer | |
| Emulsion L silver | 0.1 g |
| Emulsion M silver | 0.4 g |
| Gelatin | 0.9 g |
| Coupler C-5 | 0.3 g |
| Coupler C-6 | 0.1 g |
| Coupler C-10 | 0.1 g |
| 17th layer: High-speed blue-sensitive emulsion layer | |
| Emulsion N silver | 0.4 g |
| Gelatin | 1.2 g |
| Coupler C-5 | 0.3 g |
| Coupler C-6 | 0.6 g |
| Coupler C-10 | 0.1 g |
| 18th layer: 1st protective layer | |
| Gelatin | 0.7 g |
| Ultraviolet absorbent U-1 | 0.2 g |
| Ultraviolet absorbent U-2 | 0.05 g |
| Ultraviolet absorbent U-5 | 0.3 g |
| Compound Cpd-A | 0.07 g |
| Compound Cpd-L | 0.08 g |
| Formalin scavenger Cpd-H | 0.4 g |
| Dye D-1 | 0.1 g |
| Dye D-2 | 0.05 g |
| Dye D-3 | 0.1 g |
| 19th layer: 2nd protective layer | |
| Colloidal silver silver | 0.1 mg |
| Fine grain silver bromoiodide emulsion (average grain size = 0.06 μm and AgI content = 1 mol %) silver | 0.1 g |
| Gelatin | 0.4 g |
| 20th layer: 3rd protective layer | |
| Gelatin | 0.4 g |
| Polymethylmethacrylate (average grain size = 1.5 μm) | 0.1 g |
| 4:6 copolymer of methylmethacrylate and acrylic acid (average grain size = 1.5 μm) | 0.1 g |
| Silicone oil | 0.03 g |
| Surfactant W-1 | 3.0 mg |
| Surfactant W-2 | 0.03 g |

In addition to the above compositions, additives F-1 to F-8 were added to all the emulsion layers. The layers were also added with a gelatin hardener H-1 and surfactants W-3, W-4, W-5, and W-6 for coating and emulsification.

In addition, phenol, 1,2-benzisothiazoline-3-one, 2-phenoxyethanol, and phenethylalcohol were added as antiseptic and mildewproofing agents.

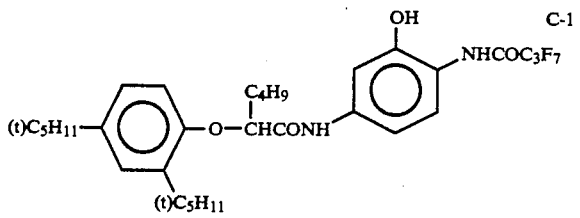

C-1

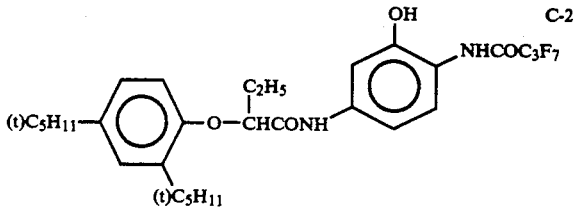

C-2

-continued
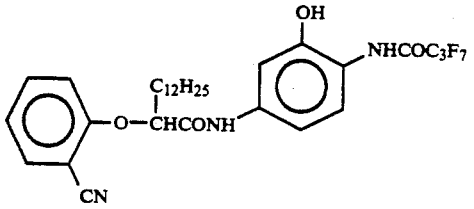
C-3
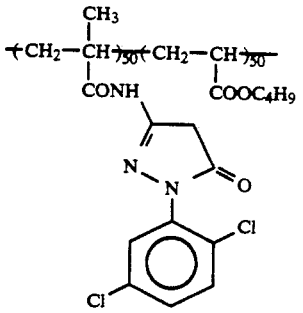
x:y = 50:50 (wt %)
mean molecular weight: about 25,000
C-4
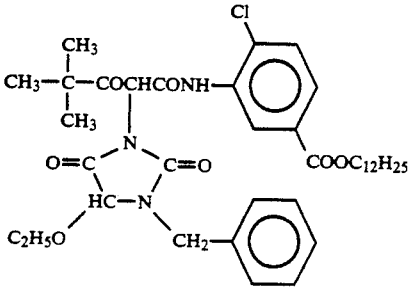
C-5
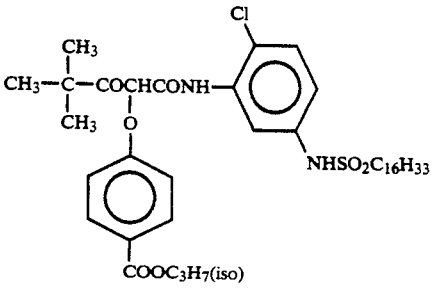
C-6
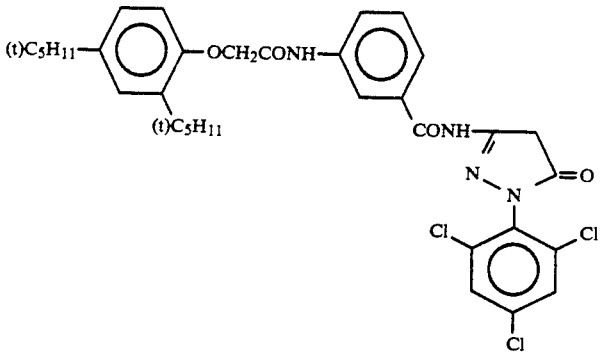
C-7
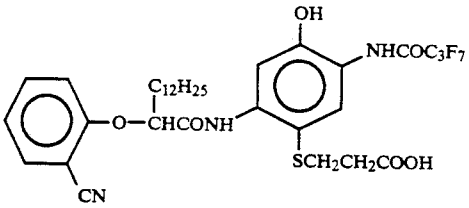
C-9
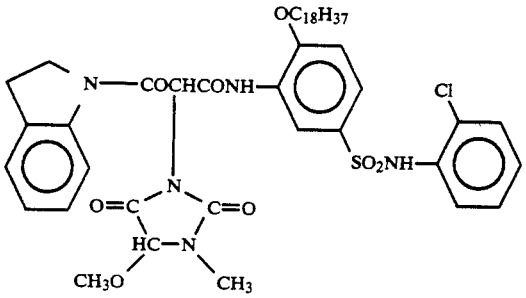
C-10
dibutyl phtalate
Oil-1
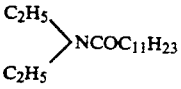
Oil-3
tricresyl phosphate
Oil-2
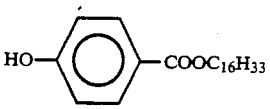
Oil-4

-continued
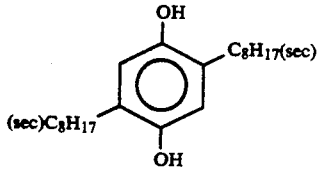
Cpd-A
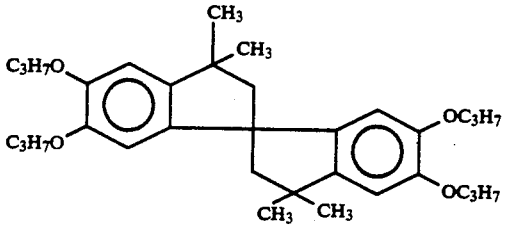
Cpd-B
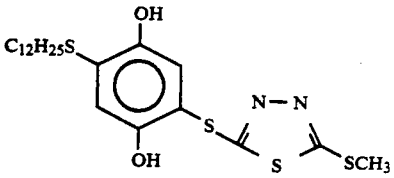
Cpd-C
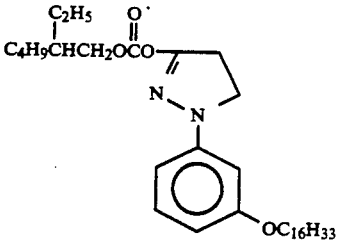
Cpd-D
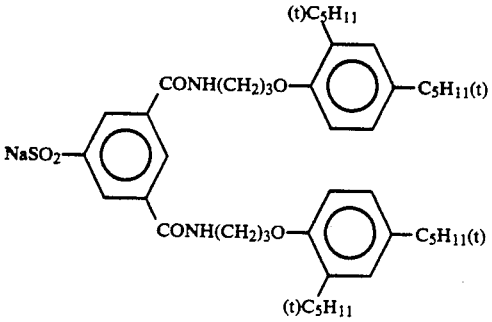
Cpd-E
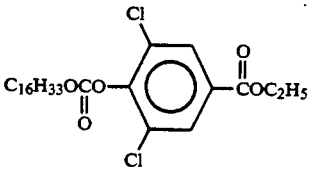
Cpd-F
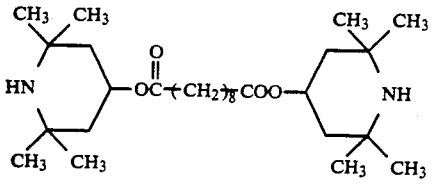
Cpd-G
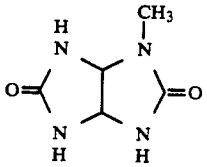
Cpd-H
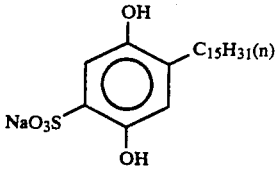
Cpd-I
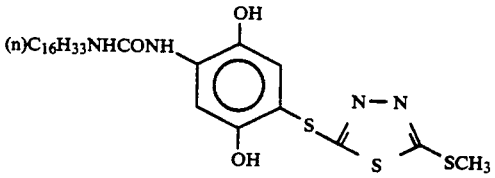
Cpd-J
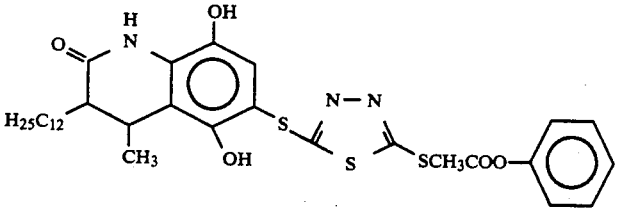
Cpd-K

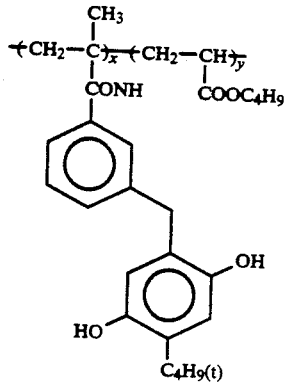
x:y = 36:64 (weight %)
mean molecular weight: about 30,000
-continued
Cpd-L
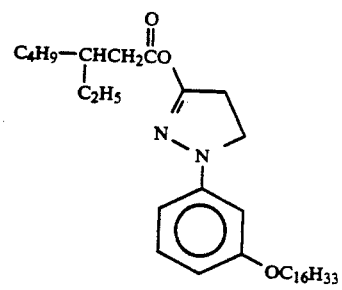
Cpd-M
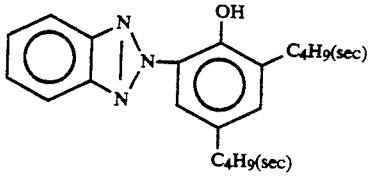
U-1
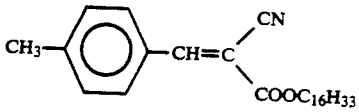
U-2
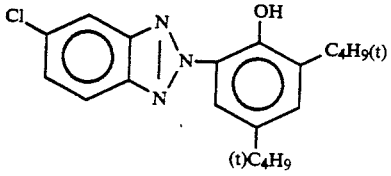
U-3
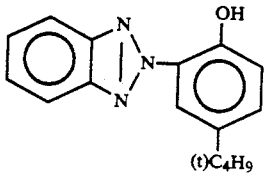
U-4
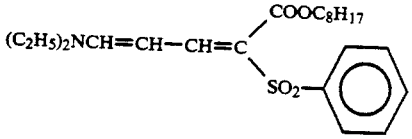
U-5
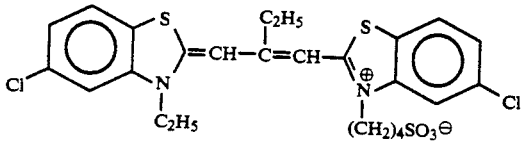
S-1
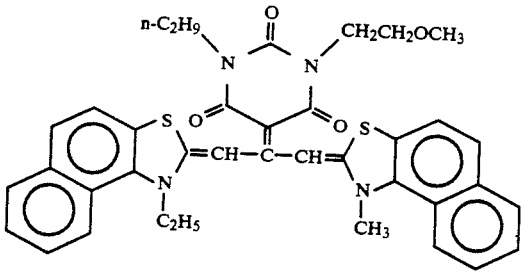
S-2
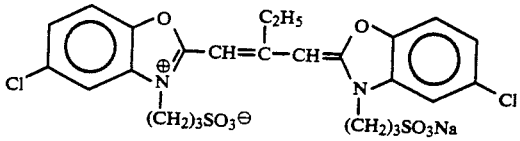
S-3
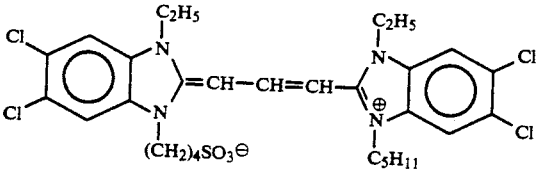
S-4
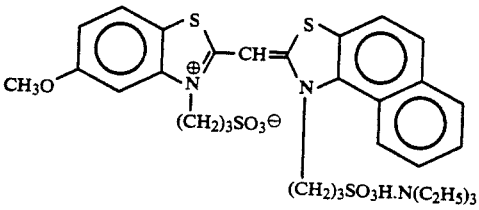
S-5
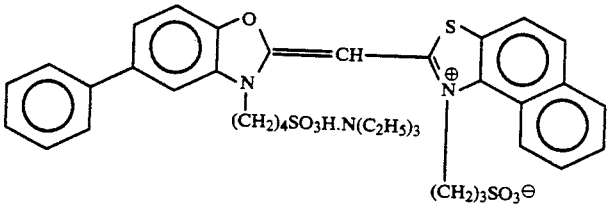
S-6

-continued
S-7
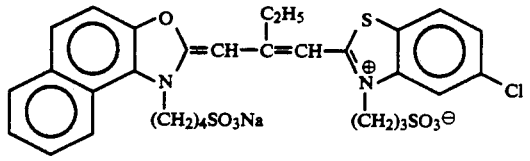
S-8
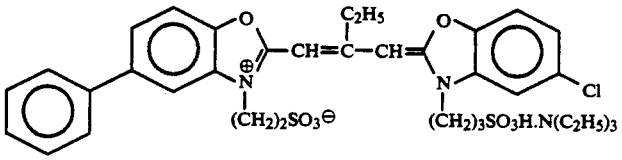
D-1
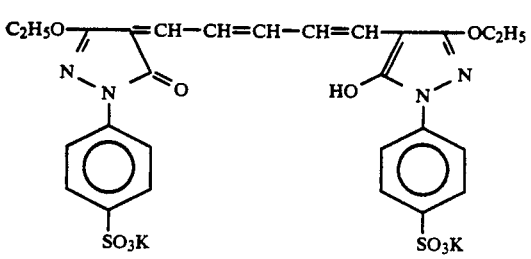
D-2
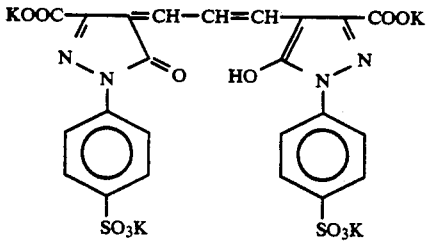
D-3
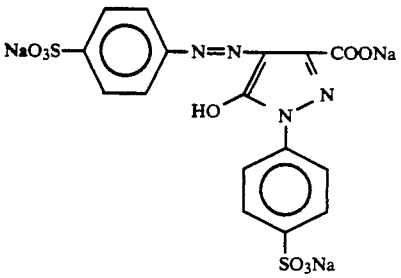
D-4
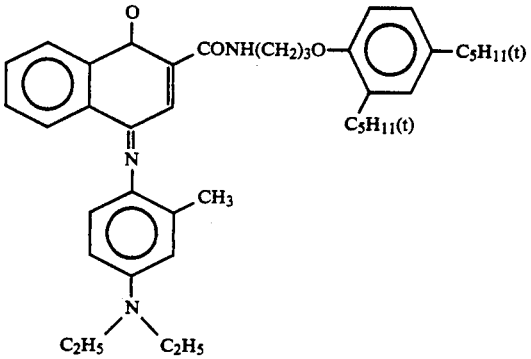
E-1
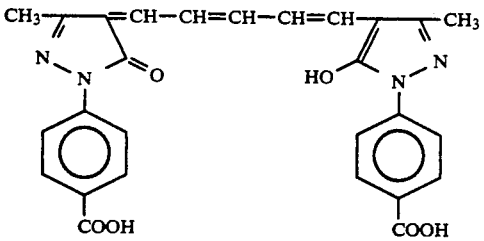
E-2
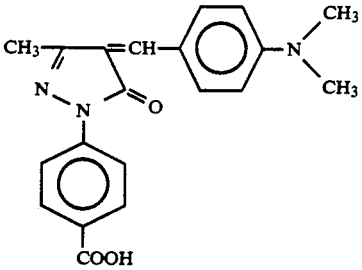
H-1
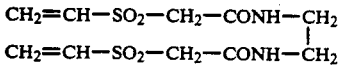
W-1
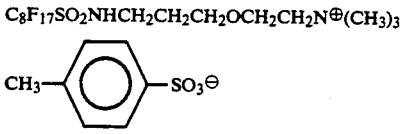
W-2
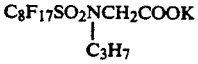
W-3
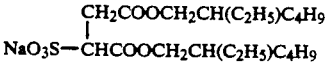

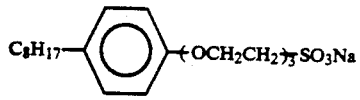

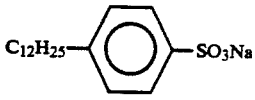

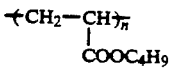

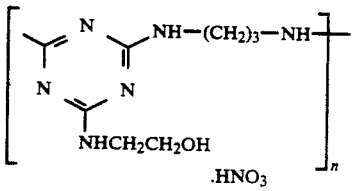

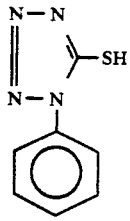

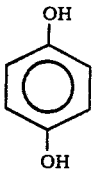

-continued

W-4

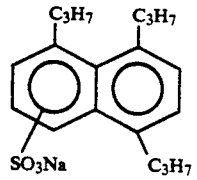

W-5

W-6

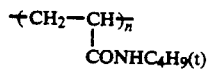

P-1

M-1

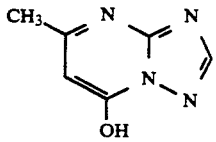

F-1

F-2

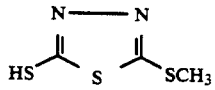

F-3

F-4

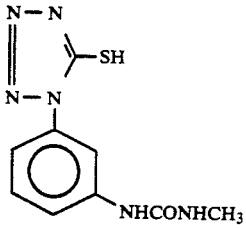

F-5

F-6

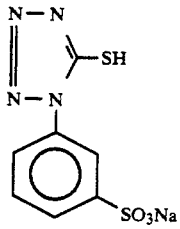

F-7

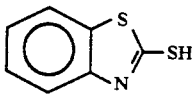

F-8

Preparing of Samples 202–220

Samples 202 to 220 were prepared following the same procedures as for the sample 201 except that the magenta couplers C-7 and C-4 in the ninth to eleventh layers of the sample 201 were replaced with equal molar quantities of magenta couplers of the present invention listed in Table 5 (the compound numbers described in Table 5 are the numbers given to the above exemplified compounds).

The samples 201 to 220 thus prepared were formed into 35-mm wide cartridges and subjected to actual photography. A color checker available from Macbeth Co. was used as an object to be photographed, and development was performed in accordance with the following processing steps. The photographed samples were subjected to five-step evaluation of color reproducibility performed by a plurality of evaluators. The average values of these evaluated values are listed in Table 5 as values representing the color reproducibility in comparison with the sample 202 as a control.

RMS granularity normally used was measured and evaluated as graininess, and values for a magenta image at a density of 1.0 and 2.0 were compared. Each sample was subjected to stepwise exposure and processed as follows. The measurement aperture was set to be a diameter of 48 μm, and the measurement values were multiplied by 1,000 before listed in Table 5.

| Step | Time | Temperature |
|---|---|---|
| 1st development | 6 min. | 38° C. |
| Washing | 2 min. | 38° C. |

-continued

| Step | Time | Temperature |
|---|---|---|
| Reversal | 2 min. | 38° C. |
| Color development | 6 min. | 38° C. |
| Control | 2 min. | 38° C. |
| Bleaching | 6 min. | 38° C. |
| Fixing | 4 min. | 38° C. |
| Washing | 4 min. | 38° C. |
| Stabilization | 1 min. | 25° C. |

The compositions of the processing solutions were as follows.

| (1st developing solution) | |
|---|---|
| Nitrilo-N,N,N-trimethylenephosphonic acid pentasodium salt | 1.5 g |
| Diethylenetriaminepentaacetic acid pentasodium salt | 2.0 g |
| Sodium sulfite | 30 g |
| Hydroquinone potassium monosulfonate | 20 g |
| Potassium carbonate | 15 g |
| Sodim bicarbonate | 12 g |
| 1-phenyl-4-methyl-4-hydroxymethyl-3-pyrazolidone | 1.5 g |
| Potassium bromide | 2.5 g |
| Potassium thiocyanate | 1.2 g |
| Potassium iodide | 2.0 mg |
| Diethyleneglycol | 13 g |
| Water to make | 1,000 ml |
| pH | 9.60 |

The pH was controlled by hydrochloric acid or potassium hydroxide.

| (Reversal solution) | |
|---|---|
| Nitrilo-N,N,N-trimethylenephosphonic acid pentasodium salt | 3.0 g |
| Stannous chloride dihydrate | 1.0 g |
| p-aminophenol | 0.1 g |
| Sodium hydroxide | 8 g |
| Glacial acetic acid | 15 ml |
| Water to make | 1,000 ml |
| pH | 6.0 |

The pH was controlled by hydrochloric acid or sodium hydroxide.

| (Color developing solution) | |
|---|---|
| Nitrilo-N,N,N-trimethylenephosphonic acid pentasodium salt | 2.0 g |
| Sodium sulfite | 7.0 g |
| Trisodium phosphate dodecahydrate | 36 g |
| Potassium bromide | 1.0 g |
| Potassium iodide | 90 mg |
| Sodium hydroxide | 3.0 g |
| Citrazinic acid | 1.5 g |
| N-ethyl-N-(β-methanesulfonamidoethyl)-3-methyl-4-aminoaniline 3/2 sulfuric acid monohydrate | 11 g |
| 3,6-dithiaoctane-1,8-diol | 1.0 g |
| Water to make | 1,000 ml |
| pH | 11.80 |

The pH was controlled by hydrochloric acid or potassium hydroxide.

| (Control solution) | |
|---|---|
| Ethylenediaminetetraacetic acid disodium salt dihydrate | 8.0 g |

-continued

| (Control solution) | |
|---|---|
| Sodium sulfite | 12 g |
| 1-thioglycerol | 0.4 g |
| Formaldehyde sodium bisulfite adduct | 30 g |
| Water to make | 1,000 ml |
| pH | 6.20 |

The pH was controlled by hydrochloric acid or sodium hydroxide.

| (Bleaching solution) | |
|---|---|
| Ethylenediaminetetraacetic acid disodium salt dihydrate | 2.0 g |
| Ethylenediaminetetraacetic acid Fe(III) ammonium dihydrate | 120 g |
| Potassium bromide | 100 g |
| Ammonium nitrate | 10 g |
| Water to make | 1,000 ml |
| pH | 5.70 |

The pH was controlled by hydrochloric acid or sodium hydroxide.

| (Fixing solution) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

The pH was controlled by hydrochloric acid or ammonia water.

| (Stabilizing solution) | |
|---|---|
| Benzoisothiazoline-3-one | 0.02 g |
| Polyoxyethylene-p-monononylphenylether (average polymerization degree = 10) | 0.3 g |
| Water to make | 1,000 ml |
| pH | 7.0 |

TABLE 5

| Sample No. | Magenta coupler 9th layer | 10th layer | 11th layer |
|---|---|---|---|
| Sample 201 | C-7 | C-4 | C-4 |
| Sample 202 | C-7 | C-7 | C-7 |
| Sample 203 | M-48 | M-48 | M-48 |
| Sample 204 | C-7 | Comparative compound A | Comparative compound A |
| Sample 205 | M-48 | Comparative compound A | Comparative compound A |
| Sample 206 | M-48 | C-4 | C-4 |
| Sample 207 | C-7 | (44) | (44) |
| Sample 208 | M-26 | M-26 | M-26 |
| Sample 209 | M-48 | M-48 | (44) |
| Sample 210 | M-26 | M-26 | (44) |
| Sample 211 | M-26 | (44) | (44) |
| Sample 212 | M-26 | (18) | (18) |
| Sample 213 | M-26 | (23) | (23) |
| Sample 214 | M-48 | (33) | (33) |
| Sample 215 | M-48 | M-48, (33) | (33) |
| Sample 216 | M-48 | M-48, (33) | M-48, (33) |
| Sample 217 | M-72 | (25) | (25) |
| Sample 218 | M-72 | M-72, (25) | (25) |
| Sample 219 | M-50 | (17) | (17) |
| Sample 220 | M-50 | M-50, (17) | (17) |

comparative compound A

-continued

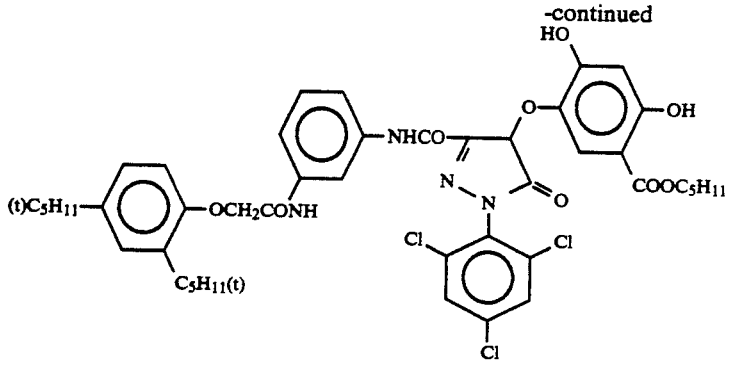

JP-A-1-131560
exemplified compound SDR-14

TABLE 6

| Sample No. | Color reproducibility* Red | Color reproducibility* Magenta | Graininess Density 1.0 | Graininess Density 2.0 | Remarks |
|---|---|---|---|---|---|
| 201 | 3 | 2 | 11 | 22 | Comparative example |
| 202 | 3 | 3 | 10 | 20 | Comparative example |
| 203 | 5 | 5 | 16 | 27 | Comparative example |
| 204 | 3 | 3 | 11 | 18 | Comparative example |
| 205 | 4 | 3 | 13 | 20 | Comparative example |
| 206 | 4 | 4 | 14 | 23 | Comparative example |
| 207 | 4 | 4 | 10 | 17 | Comparative example |
| 208 | 5 | 5 | 17 | 30 | Comparative example |
| 209 | 5 | 4 | 11 | 17 | Present Invention |
| 210 | 5 | 5 | 11 | 17 | Present Invention |
| 211 | 5 | 5 | 11 | 17 | Present Invention |
| 212 | 5 | 5 | 9 | 17 | Present Invention |
| 213 | 5 | 5 | 11 | 17 | Present Invention |
| 214 | 5 | 5 | 11 | 17 | Present Invention |
| 215 | 5 | 5 | 11 | 17 | Present Invention |
| 216 | 5 | 5 | 11 | 17 | Present Invention |
| 217 | 5 | 5 | 11 | 17 | Present Invention |
| 218 | 5 | 5 | 11 | 17 | Present Invention |
| 219 | 5 | 5 | 9 | 17 | Present Invention |
| 220 | 5 | 5 | 9 | 17 | Present Invention |

*1: Poor,
2: Slightly poor,
3: Equivalent,
4: Good,
5: Very Good

As is apparent from Table 6, when the 2-equivalent pyrazolotriazole type magenta coupler was used in emulsion layer having high sensitivity, the color reproducibility was improved but the graininess was significantly degraded as indicated by the sample 203.

When the conventional poly-equivalent coupler having a pyrazolone skeleton were used in layer having high sensitivity (the sample 205), even if the pyrazolotriazole type couplers were used in low-speed layers, the graininess at a low density was inferior to those of the samples 201 and 202, and an improvement in color reproducibility was also insignificant, although degradation in graininess at a high density was not found.

When the poly-equivalent couplers of the present invention were used in layer having high sensitivity and the 2-equivalent couplers of the present invention were used in layers having low sensitivity (the samples 209 to 220), improvements in color reproducibility were remarkable, and the graininess was able to be improved at both low and high densities The sample 212 using couplers represented by Formula (I) was superior to the sample 211 using poly-equivalent couplers represented by Formula (II) in graininess of low-density portions.

The results could not be obtained without the use of the combinations of the present invention.

As described above, the color reproducibility and the graininess were improved by using poly-equivalent couplers represented by Formula (I) and/or Formula (II) of the present invention in layers having high sensitivity and 2-equivalent couplers represented by Formula (M) in layers having low sensitivity.

What is claimed is:

1. A silver halide color photographic light-sensitive material having at least two green-sensitive silver halide emulsion layers having different sensitivities on a support, wherein a layer having the lowest sensitivity of said green-sensitive layers contains at least one coupler represented by Formula (M), and a layer having the highest sensitivity of said green-sensitive layers contains at least one coupler represented by Formula (N), Formula (I) or Formula (II):

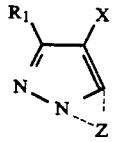

Formula (M)

wherein $R_1$ represents a hydrogen atom or a substituent, Z represents a nonmetallic atom group required to form a 5-membered azole ring containing two to four nitrogen atoms, said azole ring being able to have a substituent including a condensed ring, and X represents a group except for a hydrogen atom, which can split off during a coupling reaction with an oxidized form of a developing agent;

Formula (N) representing a compound represented by Formula (M) in which the split-off group X is replaced by a hydrogen atom;

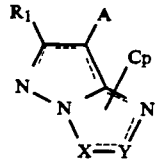

Formula (I)

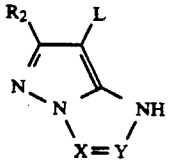

Formula (II)

wherein $R_1$ and $R_2$ each represent a hydrogen atom or a substituent, A represents a hydrogen atom, a halogen atom, an aryloxy group, an alkoxy group, an arylthio group, an alkylthio group, or a 1-azolyl group, Cp represents a coupling back group which reacts with the oxidized form of a color developing agent to produce a colorless or alkali-soluble product and bonds on the nitrogen atom, L represents a scavenger for an oxidized form of a color developing agent, which can capture the oxidized form of a color developing agent through a redox reaction or a coupling reaction after released by a reaction with the oxidized form of a color developing agent, wherein neither Cp nor L is a development inhibitor or a precursor thereof, X and Y each represent a nitrogen atom or a carbon atom, X and Y being not simultaneously nitrogen atoms, and . . . represents a $\pi$ electron pair for forming a conjugated double bond.

2. The silver halide color photographic light-sensitive material according to claim 1, wherein the coupler represented by Formula (M) is represented by Formula (M-III);

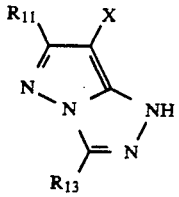

Formula (M-III)

wherein $R_{11}$ represents a hydrogen atom, a halogen atom, an alkyl group, an aryl group, a heterocyclic group, a cyano group, a hydroxyl group, a nitro group, a carboxyl group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, a urethane group, or an azolyl group, $R_{11}$ may be a divalent group capable of being in a bis form, $R_{13}$ represents groups having the same meanings as the substituents enumberated for $R_{11}$, and X represents a group except for a hydrogen atom, which can split off during a reaction with the oxidized form of an aromatic primary amino color developing agent.

3. The silver halide color photographic light-sensitive material according to claim 1, wherein at least one of said green-sensitive emulsion layers contain a monodisperse emulsion.

4. An image forming method using a silver halide color photographic light-sensitive material having at least two green-sensitive silver halide emulsion layers having different sensitivities on a support, wherein a layer having the lowest sensitivity of said green-sensitive layer contains at least one coupler represented by Formula (M), and a layer having the highest sensitivity of said green-sensitive layers contains at least one coupler represented by Formula (N), Formula (I) or Formula (II):

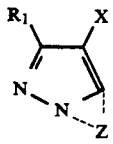

Formula (M)

wherein $R_1$ represents a hydrogen atom or a substituent, Z represents a nonmetallic atom group required to form a 5-membered azole ring containing two to four nitrogen atoms, said azole ring being able to have a substituent including a condensed ring, and X represents a group except for a hydrogen atom, which can split off during a coupling reaction with an oxidized form of a developing agent;

Formula (N) representing a compound represented by Formula (M) in which the split-off group X is replaced by a hydrogen atom;

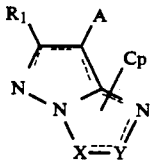

Formula (I)

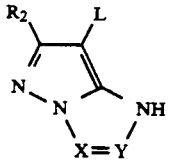

Formula (II)

wherein $R_1$ and $R_2$ each represent a hydrogen atom or a substituent, A represents a hydrogen atom, a halogen atom, an aryloxy group, an alkoxy group, an arylthio group, an alkylthio group, or a 1-azolyl group, Cp represents a coupling block group which reacts with an oxidized form of a color developing agent to produce a colorless or alkali-soluble product and bonds on a nitrogen atom, L represents a scavenger for an oxidized form of a color developing agent, which can capture the oxidized form of a color developing agent through a redox reaction or a coupling reaction after released by a reaction with the oxidized form of a color developing agent, X and Y each represent a nitrogen atom or a carbon atom, X and Y being not simultaneously nitrogen atoms, and . . . represents and $\pi$ electron pair for forming a conjugated double bond;

wherein an image is obtained by performing color development after black/white development.

5. The image forming method according to claim 4, wherein the color development is performed with a color developing solution having a pH of not less than 11.

* * * * *